US005708915A

United States Patent [19]

Noguchi et al.

[11] Patent Number: 5,708,915

[45] Date of Patent: Jan. 13, 1998

[54] IMAGE-QUALITY STABILIZER FOR USE IN AN ELECTROPHOTOGRAPHIC APPARATUS

[75] Inventors: Teruhiko Noguchi, Sakai; Jitsuo Masuda, Yamatotakada; Katsushi Inoue, Yamatokoriyama, all of Japan

[73] Assignee: Sharp Kabushiki Kaisha, Osaka, Japan

[21] Appl. No.: 636,914

[22] Filed: Apr. 24, 1996

Related U.S. Application Data

[63] Continuation of Ser. No. 153,359, Nov. 16, 1993, abandoned.

[30] Foreign Application Priority Data

Nov. 18, 1992 [JP] Japan ..... 4-309095

[51] Int. Cl.[6] ..... G03G 15/00

[52] U.S. Cl. ..... 399/49; 399/50; 399/51; 399/53

[58] Field of Search ..... 399/46, 49, 50, 399/51, 53

[56] References Cited

U.S. PATENT DOCUMENTS

| | | | |
|---|---|---|---|
| 4,312,589 | 1/1982 | Brannan et al. | 355/77 X |
| 4,512,652 | 4/1985 | Buck et al. | 430/902 X |
| 4,531,827 | 7/1985 | Tarumi et al. | 355/208 X |
| 4,572,654 | 2/1986 | Murai et al. | 355/208 |
| 4,970,557 | 11/1990 | Masuda et al. | 355/246 |
| 5,057,867 | 10/1991 | Ishigaki et al. | 355/208 |
| 5,099,279 | 3/1992 | Shimizu | 355/208 |
| 5,200,780 | 4/1993 | Koichi | 355/208 |
| 5,315,351 | 5/1994 | Matsushiro et al. | 355/246 |
| 5,414,531 | 5/1995 | Amemiya et al. | 358/465 |

FOREIGN PATENT DOCUMENTS

| | | |
|---|---|---|
| 53-93030 | 8/1978 | Japan . |
| 55-127575 | 10/1980 | Japan . |

*Primary Examiner*—William J. Royer
*Attorney, Agent, or Firm*—David G. Conlin; Milton Oliver

[57] ABSTRACT

An image-quality stabilizer in a copying machine feedback-controls a charger output according to an amount of toner on a photoreceptor drum detected by a patch sensor during a rotation of the photoreceptor drum after a copying operation. The image-quality stabilizer counts time that the copying machine is unused, i.e., time that the photoreceptor drum is stopped being rotated using a timer, and one-way controls the charger output according to the time immediately before the next copying operation. With these controlling operations, it is possible to correct a change in the copy density which is caused when the copying machine is used or left unused without increasing the consumption of toner and impairing the responsiveness of the copying machine, thereby achieving stable image quality.

68 Claims, 35 Drawing Sheets

IMAGE-QUALITY STABILIZER FOR USE IN AN ELECTROPHOTOGRAPHIC APPARATUS

This is a continuation of application Ser. No. 08/153,359 filed Nov. 16, 1993 now abandoned.

FILED OF THE INVENTION

The present invention relates to an image-quality stabilizer for use in electrophotographic apparatuses such as an analog copying machine, a digital copying machine, and a laser beam printer.

BACKGROUND OF THE INVENTION

In an electrophotographic apparatus such as a copying machine and a laser printer, generally, an electrostatic latent image is formed on a photoreceptor by exposing an image on a document, and a toner image is produced by depositing toner on the electrostatic latent image. An image-forming operation is complete by transferring the toner image to a copy sheet and fixing it on the copy sheet by fusing. In such an electrophotographic apparatus, the surface potential of the photoreceptor and the amount of toner are varied by changes in the property of the photoreceptor drum and of the developer resulting from environmental changes and the dirt on a discharge lamp and an exposure optical system. Therefore, as illustrated by a of FIG. 54, as the number of the image-forming operation performed increases, the copy density and the copy brightness are lowered, resulting in copies with unstable image quality.

The electrophotographic apparatus has an image-quality stabilizer which detects the surface potential of the photoreceptor or the amount of toner on the photoreceptor, and feedback-controls image-forming devices including a charger, a developing device, a discharge lamp, and an exposure optical system so as to cause detected values to be equal to predetermined reference values. When the electrophotographic device is installed, a conventional image-quality stabilizer starts performing feedback-control of the image-forming devices immediately after a main switch is turned on or immediately before starting the imaging operation.

For example, when the feedback-control is executed during a rotation of the photoreceptor performed before the image-forming operation, the copy density and the copy brightness are always kept within suitable ranges as shown by b in FIG. 54, thereby producing copies with stable image quality.

However, such a feedback control process takes a few seconds to detect, calculate and to control the amount of toner on the photoreceptor. Therefore, if the feedback-control is executed immediately before the image-forming operation as mentioned above, it takes an unnecessary long time to start the image-forming operation after receiving an instruction to start the image-forming operation. Such time taken by the feedback control causes a lowering of the responsiveness of the electrophotographic apparatus and a serious drawback particularly in a high-speed electrophotographic apparatus.

To overcome such a drawback, it may be possible to execute the feedback-control after the image-forming operation is complete. If the feedback-control is executed during a rotation of the photoreceptor performed after the image-forming operation, the next image-forming operation is promptly started upon an instruction to start the image-forming operation, preventing a lowering of the responsiveness of the electrophotographic device.

However, even when the feedback control is executed during a rotation of the photoreceptor after the image-forming operation, if the electrophotographic apparatus is kept inactive for a long time after the execution of the control, the photoreceptor recovers from fatigue, producing changes in the image quality as shown by c in the graph of FIG. 55. More specifically, if the photoreceptor recovers, the surface potential increases and the electrophotographic apparatus is overcompensated. As a result, the copy density is increased and a fogged image is produced. Moreover, if the copy density and the copy brightness come outside the suitable ranges, the copy density is increased and a fogged image is produced. Consequently, an amount of toner corresponding to an area shown with hatching in FIG. 55 is wastefully consumed, causing an increase in the toner consumption.

SUMMARY OF THE INVENTION

It is an object of the present invention to provide an image-quality stabilizer for use in an electrophotographic apparatus for stabilizing image quality by appropriately adjusting the image density and image brightness without impairing the responsiveness of the electrophotographic apparatus and increasing the toner consumption.

It is another object of the present invention to provide an image-quality stabilizer for use in an electrophotographic apparatus which efficiently makes an appropriate adjustment of image quality with a minimum number of control operations.

In order to achieve the above object, an image-quality stabilizer for use in an electrophotographic apparatus according to the present invention at least includes:

(1) toner detecting means for detecting an amount of toner forming a reference toner image on a photoreceptor;

(2) a first timer for detecting time that the photoreceptor is inactive; and (3) image-quality adjusting means for controlling image forming means according to a value detected by the toner detecting means during a rotation of the photoreceptor performed after an image-forming operation so as to cause the amount of toner forming the reference toner image to be equal to a predetermined reference value, and controlling the image forming means according to the time detected by the first timer so as to maintain a predetermined relationship.

With the structure, the image-quality adjusting means controls the image forming means according to a value detected by the toner detecting means during a rotation of the photoreceptor performed after the image-forming operation, and controls the image forming means according to the time detected by the first timer so as to maintain the predetermined relationship.

With the control performed after the image-forming operation, unpredictable changes in the image quality resulting from a repeated use of the electrophotographic apparatus are corrected. With the control performed according to the time that the photoreceptor is inactive, predictable changes in the image quality which occur when the photoreceptor recovers during the time while the electrophotographic apparatus is unused are corrected. The image density is adjusted by controlling, for example, a charger output, a development bias output, or an amount of discharging light of the image forming means. The image brightness is adjusted by controlling the exposure level. Moreover, with a combination of the control operations, it is possible to stabilize the image quality in terms of image density and brightness.

Therefore, even when-executing the control during a rotation of the photoreceptor after an image-forming operation according to the amount of toner, if the control is performed before the image-forming operation according to the time that the photoreceptor is inactive, stable image quality is obtained by the next image-forming operation without having an increase in the toner consumption due to the overcompensated electrophotographic apparatus.

Since the control of the image forming means according to the time that the photoreceptor is inactive is one-way control executed to maintain the predetermined relationship, for example, by using correct values determined according to time that the photoreceptor is inactive or surface-potential recovery characteristics of the photoreceptor approximated as a function of time that the photoreceptor is inactive. This control consumes a time shorter than the time taken by the control according to the detected amount of toner. Therefore, even when the one-way control is performed before the image-forming operation, the time taken to start the image-forming operation after giving an instruction to execute the image-forming operation is not prolonged much, preventing the responsiveness of the electrophotographic apparatus from being impaired.

The control according to the time that the photoreceptor is inactive is performed by taking account of the surface-potential recovery characteristics approximated as a function of time that the photoreceptor is inactive. Firstly, the recovery of the surface potential of the photoreceptor is calculated from the time that the photoreceptor is inactive using the function representing the surface-potential recovery characteristics. Then, the image forming means is controlled to adjust the recovery. The image quality is thus appropriately corrected.

In order to achieve the above objects, another image-quality stabilizer for use in an electrophotographic apparatus according to the present invention at least includes:

(1) toner detecting means for detecting an amount of toner forming a reference toner image on a photoreceptor;

(2) a first timer for detecting time that the photoreceptor is inactive; and (3) image-quality adjusting means for controlling image forming means at predetermined intervals according to a value detected by the toner detecting means so as to cause the amount of toner forming the reference toner image to be equal to a predetermined reference value, and controlling the image forming means according to the time detected by the first timer so as to maintain a predetermined relationship.

With the structure, the image-quality adjusting means controls the image forming means at predetermined intervals according to a value detected by the toner detecting means, and controls the image forming means according to the time that the photoreceptor is inactive. It is therefore possible to appropriately correct the image quality without increasing the consumption of toner and impairing the responsiveness of the electrophotographic apparatus.

It is also possible to adjust the image quality only when an adjustment is necessary by performing the control according to the amount of toner on the photoreceptor every time a predetermined number of image-forming operations are performed or at predetermined time intervals so as to make the image density or brightness within a suitable range. In comparison with the control which is performed every time the photoreceptor is rotated after the image-forming operation according to the amount of toner on the photoreceptor, the frequency of performing the control is reduced. Consequently, the image quality is efficiently corrected while saving labor on the control and reducing the consumption of toner.

In order to achieve the above objects, another image-quality stabilizer for use in an electrophotographic apparatus according to the present invention at least includes:

(1) toner detecting means for detecting an amount of toner forming a reference toner image on a photoreceptor;

(2) a first timer for detecting time that the photoreceptor is inactive;

(3) a second timer for detecting time that the photoreceptor is active; and (4) image-quality adjusting means for controlling image forming means according to the time counted by the second timer for detecting time that the photoreceptor is active by taking account of the surface-potential lowering characteristics of the photoreceptor due to fatigue, controlling the image forming means according to the time counted by the first timer for detecting time that the photoreceptor is inactive by taking account of the surface-potential recovery characteristics of the photoreceptor, and controlling the image forming means at predetermined intervals according to a value detected by the toner detecting means so as to cause the amount of toner forming the reference toner image to be equal to a predetermined reference value.

With the structure, the image-quality adjusting means controls the image forming means according to the time counted by the second timer for detecting time that the photoreceptor is active by taking account of the surface-potential lowering characteristics of the photoreceptor, and controls the image forming means according to the time counted by the first timer for detecting time that the photoreceptor is inactive by taking account of the surface-potential recovery characteristics of the photoreceptor. More specifically, when the photoreceptor is active for a short time, it is possible to predict a lowering of the surface potential of the photoreceptor due to fatigue. The image quality is therefore adjusted by controlling the image forming means according to the time that the photoreceptor active and the surface-potential lowering characteristics. Moreover, since changes in the image quality resulting from leaving the photoreceptor inactive are predictable, the image quality is adjusted by controlling the image forming means according to the time that the photoreceptor is inactive.

On the other hand, it is hard to predict changes in the image quality which occur over a long time due to a repeated use of the photoreceptor. Therefore, the image-quality adjusting means controls the image forming means according to the amount of toner on the photoreceptor, for example, every time a predetermined number of copies are produced or at predetermined time intervals. Consequently, the frequency of performing the control according to the amount of toner on the photoreceptor, which consumes a large amount of toner, time and labor, is reduced. Namely, the image quality is efficiently adjusted with a minimum number of control operations without impairing the responsiveness of the electrophotographic apparatus.

In order to achieve the above object, another image-quality stabilizer for use in an electrophotographic apparatus according to the present invention at least includes:

(1) charge detecting means for detecting an amount of charges forming a reference latent image on a photoreceptor;

(2) a first timer for detecting time that the photoreceptor is inactive; and (3) image-quality adjusting means for controlling image forming means according to a value detected by the charge detecting means during a rotation of the photoreceptor performed after an image-forming operation so as to cause the amount of charges forming the reference latent image to be equal to a predetermined reference value, and controlling the image forming means according to the time detected by the first timer so as to maintain a predetermined relationship.

With the structure, changes in the image quality caused when the photoreceptor is active are corrected by controlling the image forming means according to a value detected by the charge detecting means with the image-quality adjusting means during a rotation of the photoreceptor performed after the image-forming operation. Moreover, changes in the image quality caused when the photoreceptor recovers during the time while the photoreceptor is inactive are corrected by controlling the image forming means according to the time detected by the first timer to maintain the predetermined relationship. The image quality is thus appropriately corrected and stable image quality is obtained without increasing the consumption of toner and impairing the responsiveness of the electrophotographic apparatus.

In order to achieve the above objects, another image-quality stabilizer for use in an electrophotographic apparatus according to the present invention at least includes:

(1) charge detecting means for detecting an amount of charges forming a reference latent image on a photoreceptor;

(2) a first timer for detecting time that the photoreceptor is inactive; and (3) image-quality adjusting means for controlling image forming means at predetermined intervals according to a value detected by the charge detecting means so as to cause the amount of charges forming the reference latent image to be equal to a predetermined reference value, and controlling the image forming means according to the time detected by the first timer to maintain a predetermined relationship.

With the structure, the image-quality adjusting means controls the image forming means at predetermined intervals according to a value detected by the charge detecting means, and controls the image forming means according to the time that the photoreceptor is inactive. It is therefore possible to appropriately correct the image quality without increasing the consumption of toner and impairing the responsiveness of the electrophotographic apparatus. Moreover, in comparison with the control which is performed every time the photoreceptor is rotated after the image-forming operation according to the amount of charges on the photoreceptor, the frequency of performing the control is reduced. Consequently, the image quality is efficiently corrected while saving labor and reducing the time taken for the control.

In order to achieve the above objects, another image-quality stabilizer for use in an electrophotographic apparatus according to the present invention at least includes:

(1) charge detecting means for detecting an amount of charges forming a reference latent image on a photoreceptor;

(2) a first timer for detecting time that the photoreceptor is inactive;

(3) a second timer for detecting time that the photoreceptor is active; and (4) image-quality adjusting means for controlling image forming means according to the time counted by the second timer for detecting time that the photoreceptor is active by taking account of the surface-potential lowering characteristics of the photoreceptor due to fatigue, controlling the image forming means according to the time counted by the first timer for detecting time that the photoreceptor is inactive by taking account of the surface-potential recovery characteristics of the photoreceptor, and controlling the image forming means at predetermined intervals according to a value detected by the charge detecting means so as to cause the amount of charges forming the reference latent image to be equal to a predetermined reference value.

With the structure, the image-quality adjusting means controls the image forming means according to the time counted by the second timer for detecting time that the photoreceptor is active and the surface-potential lowering characteristics of the photoreceptor, and controls the image forming means according to the time counted by the first timer for detecting time that the photoreceptor is inactive and the surface-potential recovery characteristics of the photoreceptor. It is therefore possible to correct predictable changes in the image quality which are caused when the photoreceptor is used or left unused.

On the other hand, it is hard to predict changes in the image quality which occur over a long time. Therefore, the image-quality adjusting means controls the image forming means according to the amount of charges on the photoreceptor, for example, every time a predetermined number of copies are produced or at predetermined time intervals. It is thus possible to reduce the frequency of performing the control according to the amount of charges on the photoreceptor, which consumes a large amount of time and labor. Namely, the image quality is efficiently adjusted with a minimum number of control operations without increasing the consumption of toner and impairing the responsiveness of the electrophotographic apparatus.

In order to achieve the above Objects, another image-quality stabilizer for use in an electrophotographic apparatus according to the present invention at least includes:

(1) toner detecting means for detecting an amount of toner forming a reference toner image on a photoreceptor;

(2) a first timer for detecting time that the photoreceptor is inactive;

(3) a third timer for detecting an accumulated time of image forming operations; and (4) image-quality adjusting means for controlling image forming means according to a value detected by the toner detecting means so as to cause the amount of toner forming the reference toner image to be equal to a predetermined reference value when the time detected by the third timer reaches a predetermined time, and controlling the image forming means according to the time counted by the first timer when the time detected by the first timer reaches or exceeds a predetermined time.

With the structure, when the time counted by the first timer reaches or exceeds the predetermined time, the image-quality adjusting means controls the image forming means before starting the next image-forming operation. When the time counted by the third timer reaches the predetermined time, the image-quality adjusting means controls the image forming means according to the value detected by the toner detecting means. With these controlling operations, the image quality is stabilized.

Therefore, when producing a large number of copies, if the image-forming operation is repeatedly performed and the accumulated time of image forming operations reaches the predetermined time, the image forming means is controlled even if, for example, the image-forming operation is in progress. Consequently, changes in the image quality caused when the image forming operation is repeatedly performed are corrected. Additionally, when the image-forming operation is repeatedly started and stopped during a relatively short time, the control is not performed until the accumulated time of the image forming operations reaches the predetermined time. It is thus possible to eliminate unnecessary control.

Furthermore, when the electrophotographic apparatus is left unused for a long time, i.e., when the time that the photoreceptor is inactive reaches or exceeds the predetermined time, the control is performed before starting the image-forming operation. It is therefore possible to correct changes in the image quality resulting from leaving the electrophotographic apparatus unused.

Hence, the image quality is efficiently adjusted depending on the frequency of performing the image forming operation and stable image quality is obtained with a reduced number of control operations without increasing the consumption of toner and impairing the responsiveness of the electrophotographic apparatus.

In order to achieve the above objects, another image-quality stabilizer for use in an electrophotographic apparatus according to the present invention at least includes:

(1) charge detecting means for detecting an amount of charges forming a reference latent image on a photoreceptor;

(2) a first timer for detecting time that the photoreceptor is inactive;

(3) a third timer for detecting an accumulated time of image forming operations; and (4) image-quality adjusting means for controlling image forming means according to a value detected by the charge detecting means so as to cause the amount of charges forming the reference latent image to be equal to a predetermined reference value when the value detected by the third timer reaches a predetermined time, and controlling the image forming means according to the time counted by the first timer when the time detected by the first timer reaches or exceeds a predetermined time.

With the structure, when the time counted by the first timer reaches the predetermined time, the image-quality adjusting means controls the image forming means. And, when the time counted by the third timer reaches the predetermined time, the image-quality adjusting means controls the image forming means according to the value detected by the charge detecting means.

Hence, the image quality is efficiently adjusted depending on the frequency of performing the image forming operation and stable image quality is obtained with a reduced number of control operations without increasing the consumption of toner and impairing the responsiveness of the electrophotographic apparatus.

For a fuller understanding of the nature and advantages of the invention, reference should be made to the ensuing detailed description taken in conjunction with the accompanying drawings.

DESCRIPTION OF THE PREFERRED EMBODIMENTS

Embodiment 1

The following description discusses one embodiment of the present invention with reference to FIGS. 1 to 7.

Figure 2:
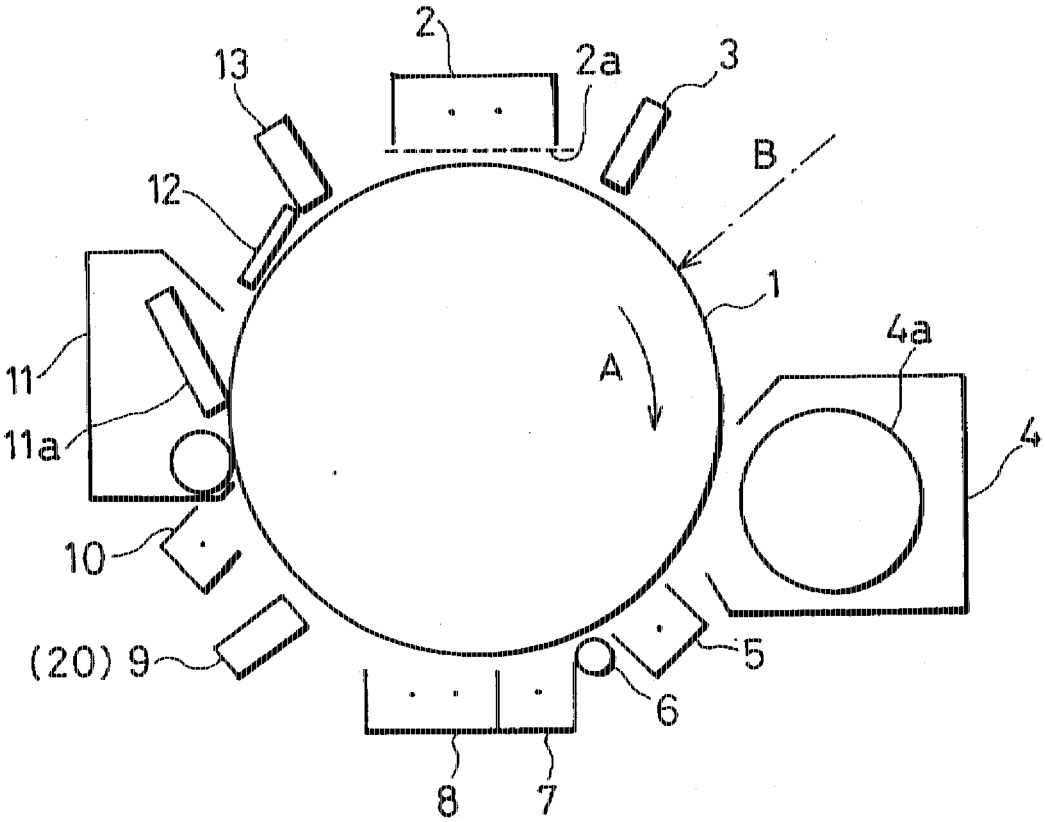
FIG. 2 is a depiction illustrating a structure of the copying machine having the control system.

As illustrated in FIG. 2, a copying machine as an electrophotographic apparatus including an image-quality stabilizer of this embodiment has a cylindrical photoreceptor drum (photoreceptor) 1 which is rotatable in the A direction in the copying machine. When light is applied from a copy lamp (not shown) to a document (not shown), the light is reflected from the document. The reflected light is applied from the B direction to the photoreceptor drum 1 to form an electrostatic latent image of the document on the photoreceptor drum 1.

A scorotron type charger 2 for charging the photoreceptor drum 1 is disposed just above the photoreceptor drum 1. The charger 2 has a grid electrode 2*a*, and its output is controlled by controlling a grid voltage to be applied to the grid electrode 2*a*.

Disposed around the photoreceptor drum 1 are a blank lamp 3, a developing device 4, a pre-transfer charger 5, a pre-transfer lamp 6, a transfer device 7, a separating device 8, a patch sensor (toner detecting means) 9, a pre-cleaning charger 10, a cleaning device 11, a discharge lamp 12, and a fatigue lamp 13.

The blank lamp 3 is composed of LEDs (Light Emitting Diodes) and irradiates light on a non-image area of the photoreceptor drum 1.

The developing device 4 has a magnet roller 4*a* therein. The magnet roller 4*a* includes a cylindrical non-magnetic sleeve forming its housing and magnetic poles therein. The magnet roller 4*a* produces a magnetic brush by causing the developer to be attracted to the sleeve through magnetic forces of the magnetic poles. The developer is supplied to the photoreceptor drum 1 as the sleeve is rotated by a rotation driving force from a driving source, not shown.

The pre-transfer charger 5 removes the charges forming the electrostatic latent image on the photoreceptor drum 1 by a corona discharge of a polarity which is opposite to that of the charger output and equal to that of toner before transferring the toner attracted to the electrostatic latent image in the developing device 4 to a transfer sheet. Consequently, the force of attraction between the toner and the photoreceptor drum 1 is weakened. The pre-transfer lamp 6 removes the charges forming the electrostatic latent image by irradiating light on the photoreceptor drum 1, and weakens the force of attraction between the toner and the photoreceptor drum 1.

The transfer device 7 transfers the toner image on the photoreceptor drum 1 to the transfer sheet by a corona discharge of a polarity equal to the polarity of the charger output. The separating device 8 applies an a.c. corona discharge to the photoreceptor drum 1 and weakens the force of attraction between the toner and the photoreceptor drum 1 so that the transfer sheet carrying the toner image thereon is separated from the photoreceptor drum 1.

After the separation process, the transfer sheet carrying the toner image is transported to a fusing device, not shown. In the fusing device, heat and pressure are applied to the toner image so as to heat-fusing the toner image and to fix the image on the transfer sheet.

The patch sensor 9 includes a light emitting diode and a photo-transistor. When feedback-controlling the charger output to obtain stable image quality, light is applied from the LEDs to a dark toner patch formed on the photoreceptor drum 1 as described later and light reflected by the photoreceptor drum 1 is received by the phototransistor. The patch sensor 9 detects an amount of light received as the amount of toner on the photoreceptor drum 1, and outputs the detected value in the form of an electric signal.

The pre-cleaning charger 10 removes unnecessary charges remaining on the photoreceptor drum 1 by supplying charges of a polarity opposite to that of the charger 2 to the photoreceptor drum 1, and weakens the force of attraction between the residual toner and the photoreceptor drum 1. The cleaning device 11 is provided with a blade 11*a*. The cleaning device 11 removes the toner from the surface of the photoreceptor drum 1 by scraping the toner from the photoreceptor drum 1 and collecting the toner with the blade 11*a*.

The discharge lamp 12 removes charges remaining on the photoreceptor drum 1 after being cleaned by irradiating light thereon. The fatigue lamp 13 irradiates light on the photoreceptor drum 1 for removing charges that still remain on the photoreceptor drum 1 after the irradiation of light by the discharge lamp 12 and causes the photoreceptor drum 1 to get fatigued to a predetermined degree so as to prevent the copy density from being changed by a series of copying operation including the above-mentioned image-forming operations.

Figure 1:
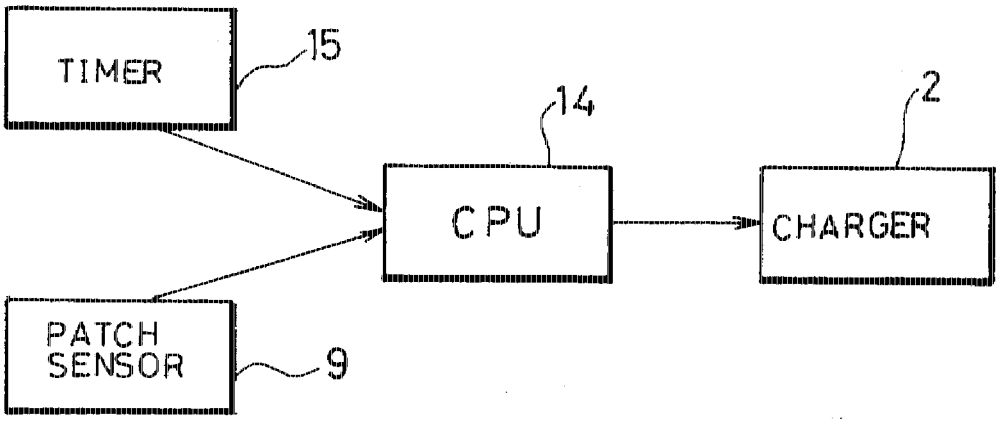
FIG. 1 is a block diagram illustrating a structure of a control system of a copying machine including an image-quality stabilizer according to one embodiment of the present invention.

As illustrated in FIG. 1, the image-quality stabilizer of this embodiment includes a CPU (Central Processing Unit) 14 as image adjusting means for feedback-controlling the charger output according to the output of the patch sensor 9 for detecting the amount of toner forming the dark toner patch on the photoreceptor drum 1. The CPU 14 is connected to a timer 15 for counting time that the photoreceptor drum 1 is not rotated, i.e., the time that the copying machine is unused. The CPU 14 one-way-controls the charger output according to an output of the timer 15 to maintain a relationship to be described later.

With the copying machine having the above-mentioned structure, changes in the image quality such as a lowering of the copy density occur due to the following two main reasons.

(1) Changes in the condition of the photoreceptor drum 1 which occur (i.e. the photoreceptor drum 1 is fatigued or recovers) when the photoreceptor drum 1 is used or left unused.

(2) Changes in the property of the photoreceptor drum 1 and the developer due to environmental changes such as temperatures, and a change in the surface condition of the photoreceptor drum 1.

Figure 3:
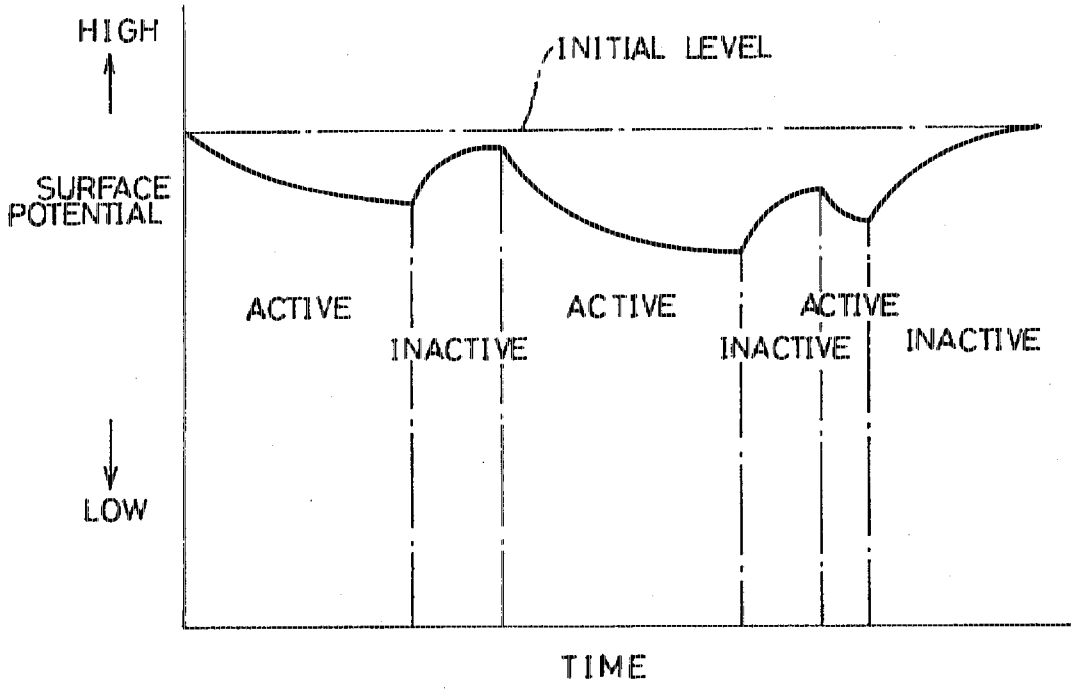
FIG. 3 is a graph showing changes in the surface potential when the photoreceptor drum shown in FIG. 2 is active and inactive.

As illustrated in FIG. 3, the surface potential of the photoreceptor drum 1 is lowered when the photoreceptor drum 1 is used (fatigued) and raised when it is unused (recovers) due to reason (1). Such a change occurs in a relatively short time when holes and electrons are caught in a trap in a photoreceptor layer, not shown, of the photoreceptor drum 1. Therefore, a change in the surface potential due to reason (1) is easily predicted by taking account of a certain relationship.

Figure 4:
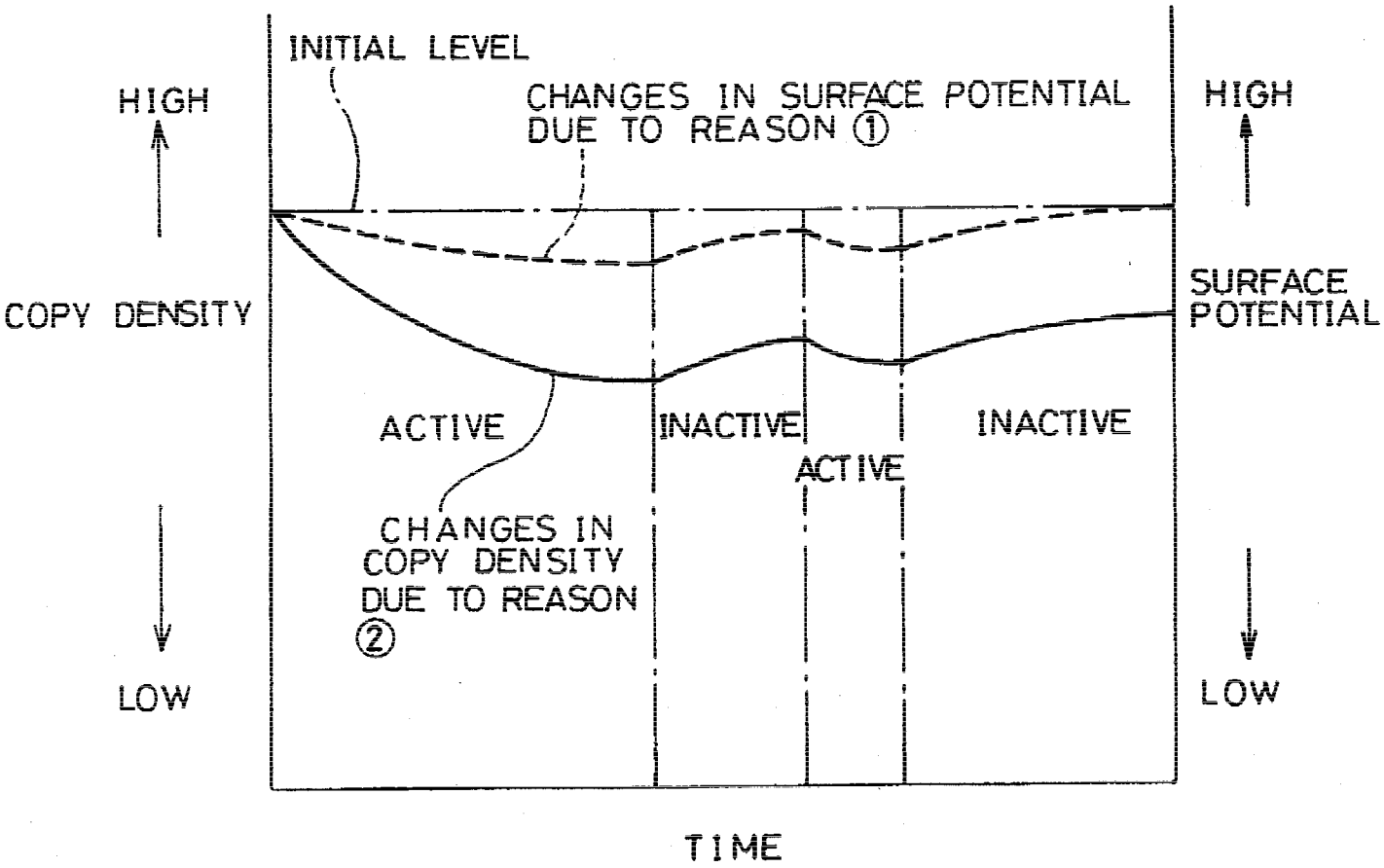
FIG. 4 is a graph showing changes in the copy density and changes in the surface potential when the photoreceptor drum shown in FIG. 2 is active and inactive.

As illustrated in the solid line of FIG. 4, the copy density is decreased when the copying machine is repeatedly used, while it is increased when the copying machine is left unused due to reason (2). Although the copy density changes in a similar manner to the change in the surface potential (shown by the broken line in FIG. 4) caused by reason (1), the rate of change differs from that of the surface potential. The change in the copy density occurs due to various reasons including a change in the surface condition of the photoreceptor drum 1, a rise in the machine temperature resulting from a repeated use of the copying machine, and a lowering of the machine temperature which occurs when the copying machine is left unused. Since such changes occur over a long time, it is particularly difficult to predict a lowering of the copy density caused when the copying machine is used.

In order to correct the changes in the copy density caused by reasons (1) and (2) and to obtain stable image quality, the image-quality stabilizer of the present invention feedback-controls a charger output during a rotation of the photoreceptor drum 1 performed after a copying operation, and one-way-controls the charger output immediately before the next copying operation according to the time that the copying machine is left unused after the feedback control.

The following description discusses each of the controlling operations on the charger output.

The above-mentioned dark toner patch of a predetermined shape is produced on the photoreceptor drum 1 by charging the photoreceptor drum 1 to a predetermined potential by the charger 2 and causing the photoreceptor drum 1 to pass through the developing device 4. The amount of toner forming the dark toner patch is detected by the patch sensor 9. The CPU 14 compares a predetermined reference value and the value detected by the patch sensor 9, and feedback-controls the charger output so as to cause the detected value to be equal to the reference value. The reference value is set before the copying machine is used, i.e., when the copying machine is assembled in a factory or when the copying machine is installed, and stored in a memory device, not shown, connected to the CPU 14.

Figure 5:
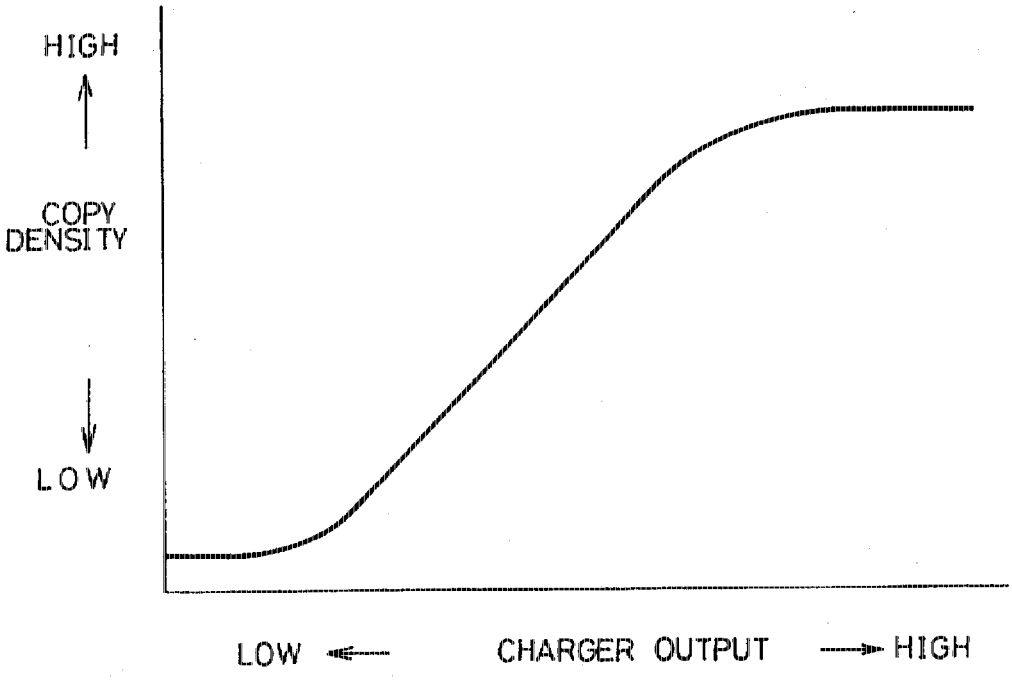
FIG. 5 is a graph showing the relationship between the charger output and the copy density.

As illustrated in FIG. 5, the charger output and the copy density have such a relationship that the copy density is increased as the charger output becomes higher. Therefore, when the copy density is decreased by a repeated use of the copying machine, the charger output is controlled to be raised. Thus, even when the cause of a change in the copy density is unknown, it is possible to appropriately adjust the copy density by feedback-controlling the charger output according to the amount of toner on the photoreceptor drum 1 detected by the patch sensor 9.

Figure 6:
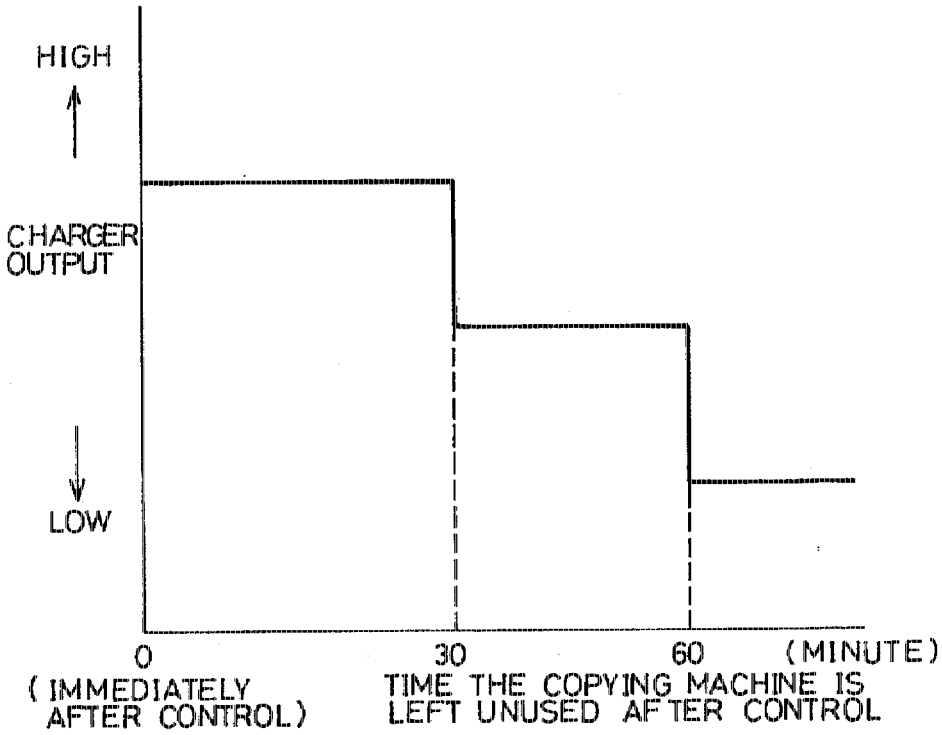
FIG. 6 is a graph showing correct values of the charger output which are set according to the time that the copying machine is left inactive to maintain the relationship between the charger output and the copy density shown in FIG. 5.

If the photoreceptor drum 1 is stopped rotating and the copying machine is left unused for a long time after the feedback control, the photoreceptor drum 1 recovers to a degree. Namely the copying machine is overcompensated. If the next copying operation is performed in this state, the copy density becomes excessively high. Such a change in the copy density caused when the copying machine is left unused is predictable by taking account of a certain relationship. As illustrated in FIG. 6, the correct value of the charger output which is determined in advance according to the relationship between the charger output and the copy density shown in FIG. 5 is stored in the memory device. More specifically, the correct value of the charger output is set so that it gradually decreases as the time that the copying machine is left unused after the feedback control becomes longer.

The CPU 14 one-way-controls the charger output to have the correct value according to the time the copying machine is left unused, counted by the timer 15. Namely, the copy density which has become too high as a result of leaving the copying machine unused is again adjusted by lowering the charger output under control.

Figure 7:
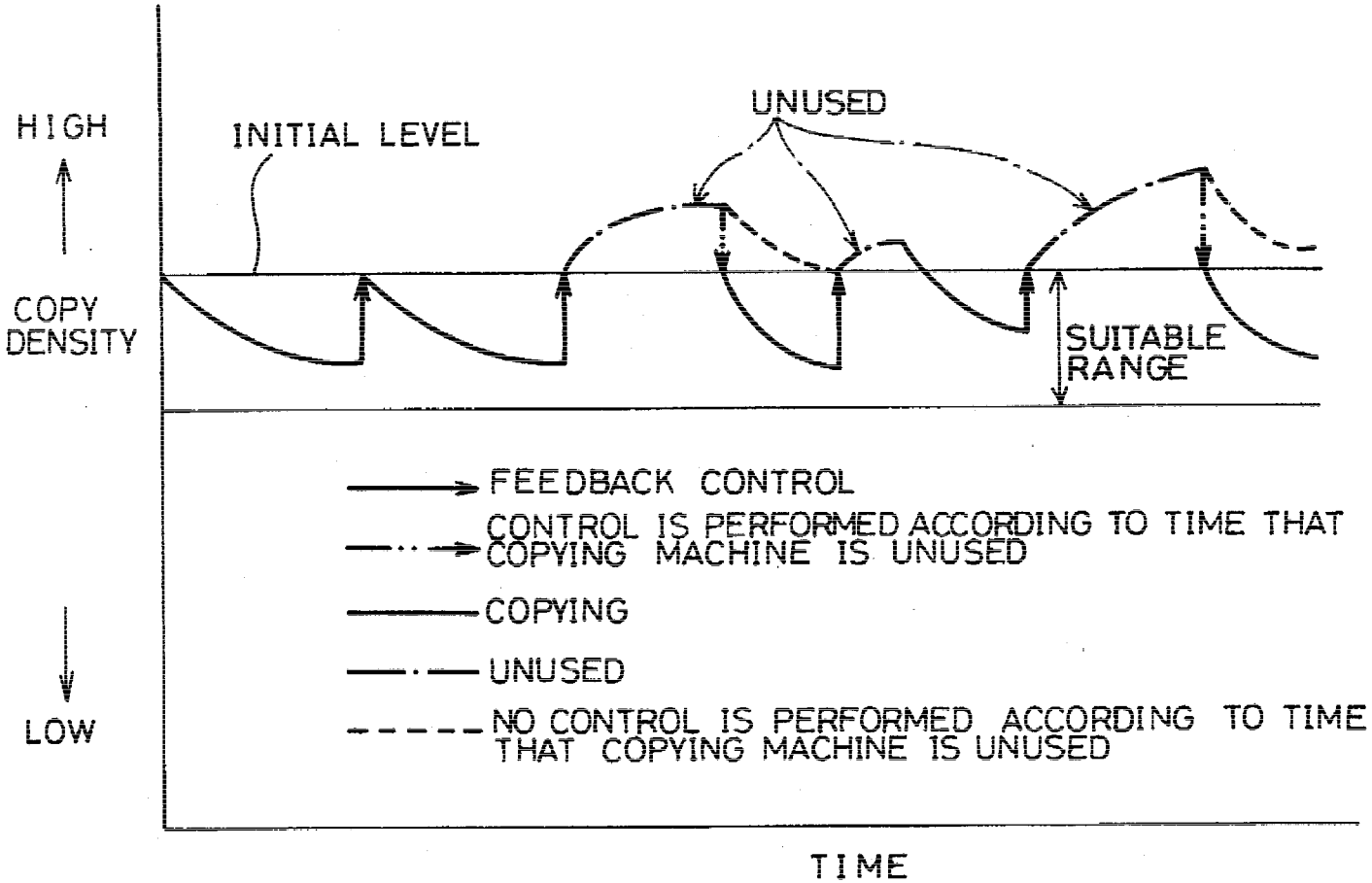
FIG. 7 is a graph showing changes in the copy density when the feedback control is performed during a rotation of the photoreceptor drum 1 after an image-forming operation and when the one-way-control is performed according to the time that the copying machine is left inactive.

As a result, as shown in FIG. 7, even if the copy brightness is made too high when the copying machine is left unused for a long time after the feedback-control of the charger output according to the amount of toner forming the dark toner patch, a copy of an appropriate copy density is obtained by the next copying operation by controlling the charger output according to the time that the copying machine is left unused after the feedback control, counted by the timer 15. It is therefore possible to prevent an excessively high copy density from causing an increase in the toner consumption.

Regarding the control of the charger output performed immediately before the copying operation according to the time that the copying machine is left unused, since the charger output is one-way-controlled to have the above-mentioned correct value, unlike the feedback control, there is no need to detect the amount of toner forming the dark toner patch and compare the detected value with the correct value. Thus, the time taken for the control is shortened and the next copying operation is promptly started.

By employing a combination of feedback control of the charger output performed according to the amount of toner forming the dark toner patch during a rotation of the photoreceptor drum 1 after the copying operation and the one-way control of the charger output performed immediately before the next copying operation according to the time that the copying machine is left unused, it is possible to prevent the overcompensated copying machine from causing an increase in the consumption of toner. Namely, changes in the copy density caused by the above-mentioned reasons (1) and (2) are appropriately corrected. Moreover, since the time taken to start a copying operation after the instruction to start the copying operation is given, i.e., the first copying time is shortened, the responsiveness of the copying machine is improved. Thus, the image-quality stabilizer brings about a great effect particularly if it is used in a high-speed copying machine.

Embodiment 2

The following description discusses another embodiment of the present invention with reference to FIGS. 2, 8 to 10. The members having the same function as in the above-mentioned embodiment will be designated by the same code and their description will be omitted.

Figure 8:
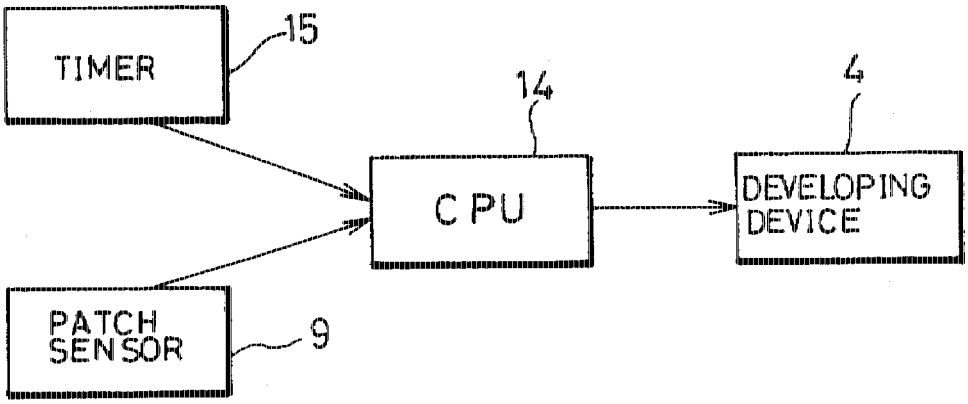
FIG. 8 is a block diagram showing a structure of a control system of a copying machine including an image-quality stabilizer according to another embodiment of the present invention.

As illustrated in FIG. 2, a copying machine as an electrophotographic apparatus including an image-quality stabilizer of this embodiment has the photoreceptor drum 1, and the developing device 4 disposed around the photoreceptor drum 1. The image-quality stabilizer includes the patch sensor 9, the timer 15, and the CPU 14 as shown in FIG. 8.

The CPU 14 feedback-controls a development bias output of the developing device 4 during a rotation of the photoreceptor drum 1 after a copying operation according to the amount of toner on the photoreceptor drum 1 detected by the patch sensor 9, and one-way-controls the development bias output immediately before the next copying operation according to the time that the copying machine is left unused after the feedback control, counted by the timer 15. These control operations correct changes in the copy density caused when the copying machine is used or left unused, thereby providing stable image quality.

The following description discusses the control of the development bias output in detail.

In the same manner as in embodiment 1, a dark toner patch is formed on the photoreceptor drum 1 during a rotation of the photoreceptor drum 1 after a copying operation. The amount of toner forming the dark toner patch is detected by the patch sensor 9. The CPU 14 feedback-controls the development bias output so that the value detected by the patch sensor 9 becomes equal to a predetermined reference value.

Figure 9:
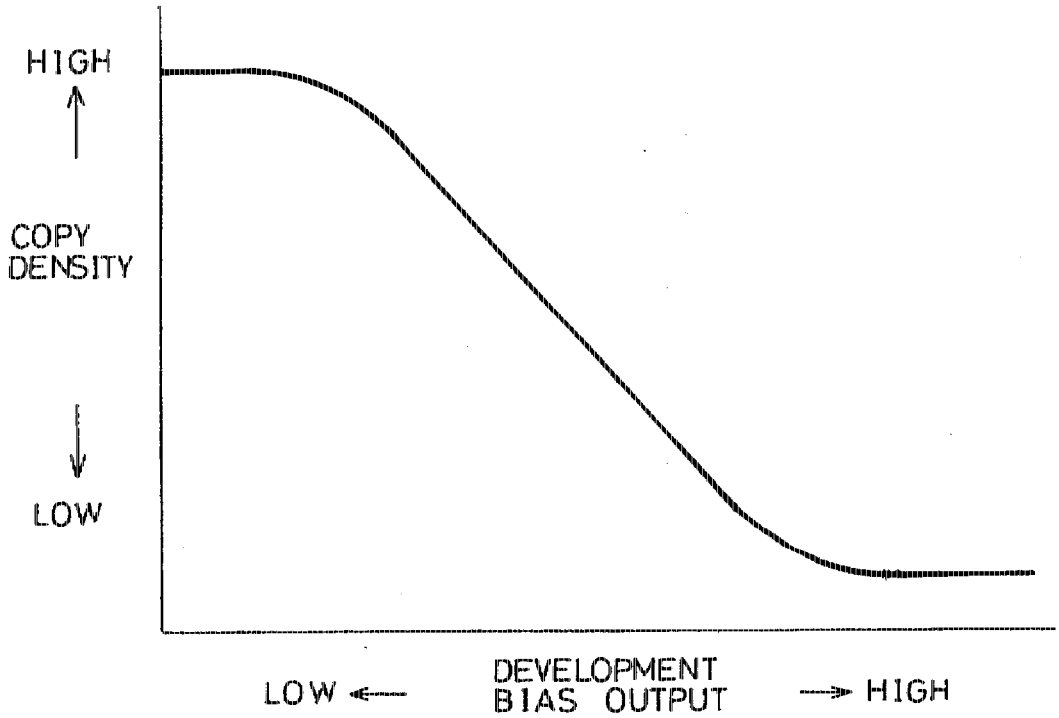
FIG. 9 is a graph showing the relationship between the development bias output and the copy density.

The relationship between the development bias output and the copy density is shown in FIG. 9. As shown in FIG. 9, the copy density is lowered as the development bias output increases. Therefore, even if the copy density is lowered by a repeated use of the copying machine, it is possible to correct the lowered copy density to an initial level by decreasing the development bias output.

Figure 10:
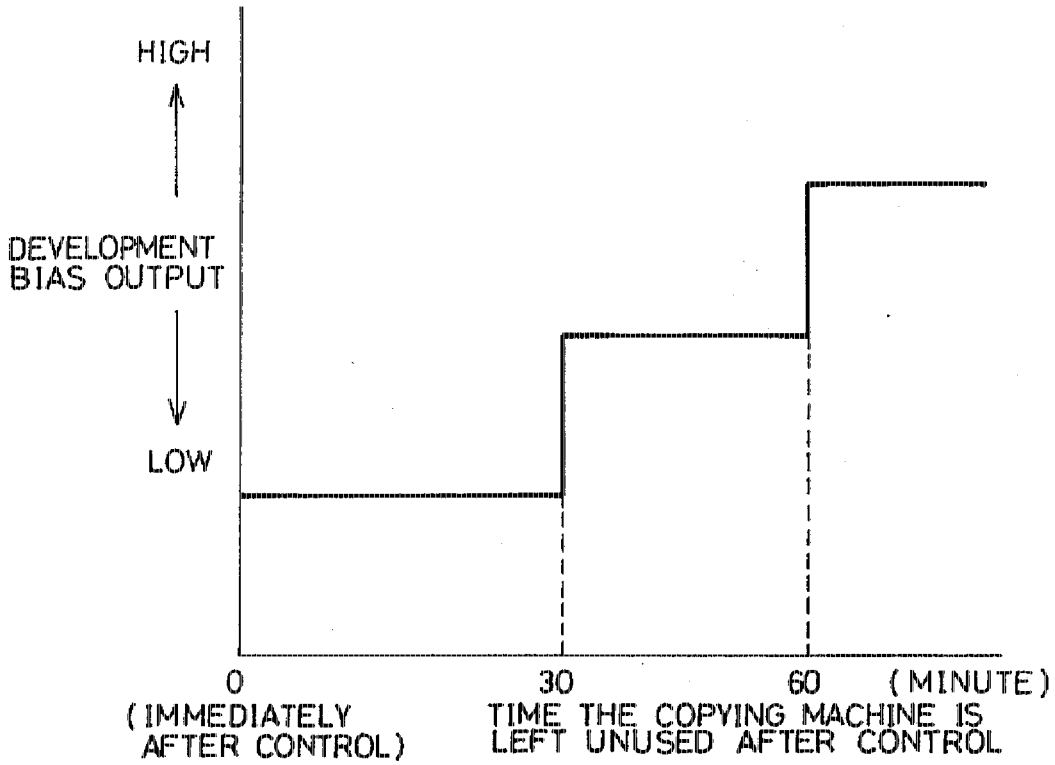
FIG. 10 is a graph showing correct values of the development bias output which are set to maintain the relationship between the development bias output and the copy density shown in FIG. 5.

A memory device (not shown) connected to the CPU 14 stores the correct value of the development bias output which is determined in advance according to the relationship between the development bias output and the copy density as shown in FIG. 10. More specifically, the correct value of the development bias output is set so that it is gradually increased as the time that the copying machine is left unused after the feedback control becomes longer. The CPU 14 one-way-controls the development bias output to have the correct value according to the time that the copying machine is left unused after the feedback control, counted by the timer 15, upon an instruction to start the next copying operation. Namely, the copy density which has been made too high as a result of leaving the copying machine unused is again adjusted by increasing the development bias output. Consequently, an appropriate copy density is obtained by the next copying operation.

By employing a combination of feedback-control of the development bias output performed according to the amount of toner on the photoreceptor drum 1 during a rotation of the photoreceptor drum 1 after the copying operation and the one-way control of the development bias output performed immediately before the next copying operation according to the time that the copying machine is left unused, it is possible appropriately correct changes in the copy density and to obtain stable image quality without increasing the consumption of toner and impairing the responsiveness of the copying machine.

Embodiment 3

The following description discusses another embodiment of the present invention with reference to FIGS. 2, 11 to 13. The members having the same function as in the above-mentioned embodiment will be designated by the same code and their description will be omitted.

Figure 11:
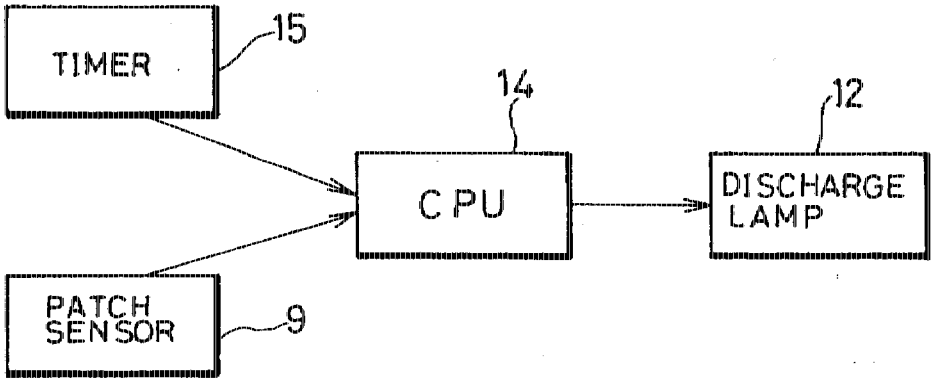
FIG. 11 is a block diagram showing a structure of a control system of a copying machine including an image-quality stabilizer according to still another embodiment of the present invention.

As illustrated in FIG. 2, a copying machine as an electrophotographic apparatus including an image-quality stabilizer of this embodiment has the photoreceptor drum 1, and the discharge lamp 12 disposed around the photoreceptor drum 1. The image-quality stabilizer includes the patch sensor 9, the timer 15, and the CPU 14 as shown in FIG. 11.

The CPU 14 feedback-controls the amount of discharging light of the discharge lamp 12 during a rotation of the photoreceptor drum 1 after a copying operation according to the amount of toner on the photoreceptor drum 1 detected by the patch sensor 9, and one-way-controls the amount of discharging light immediately before the next copying operation according to the time that the copying machine is left unused after the feedback control, counted by the timer 15. These control operations correct changes in the copy density which are caused when the copying machine is used or left unused, thereby providing stable image quality.

The following description discusses the control of the amount of discharging light in detail.

In the same manner as in embodiment 1, a dark toner patch is formed on the photoreceptor drum 1 during a rotation of the photoreceptor drum 1 after a copying operation. The amount of toner forming the dark toner patch is detected by the patch sensor 9. The CPU 14 feedback-controls the amount of discharging light so that the value detected by the patch sensor 9 becomes equal to a predetermined reference value.

Figure 12:
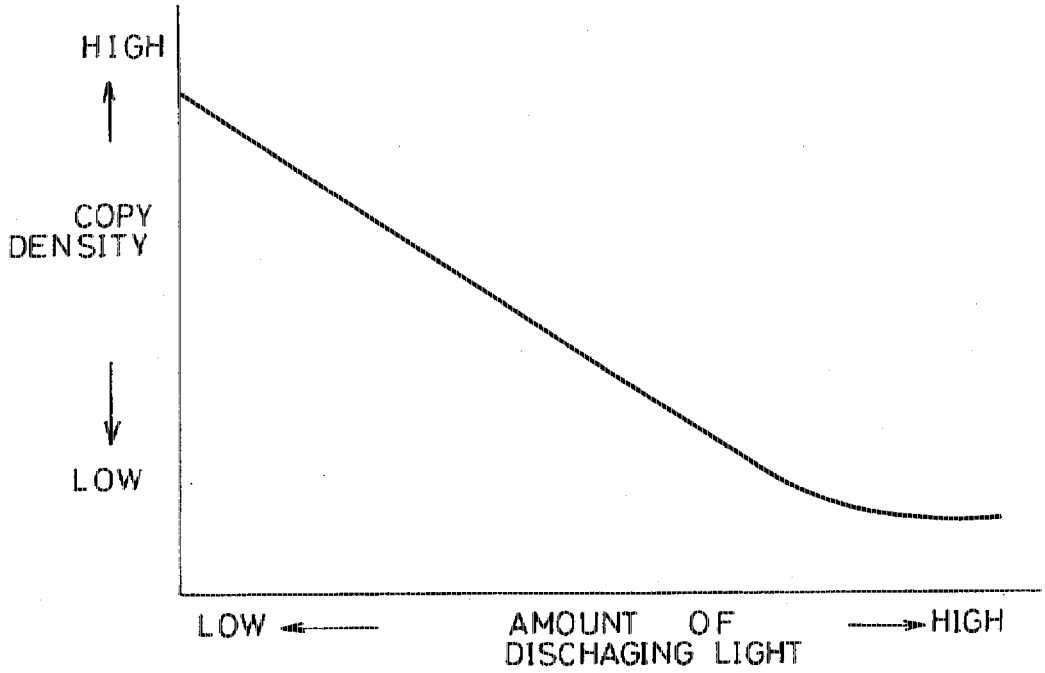
FIG. 12 is a graph showing the relationship between the amount of discharging light and the copy density.

The relationship between the amount of discharging light and the copy density is shown in FIG. 12. As shown in FIG. 12, the copy density is lowered as the amount of discharging light increases. Therefore, even if the copy density is lowered by a repeated use of the copying machine, it is possible to correct the lowered copy density to an initial level by decreasing the amount of discharging light.

Figure 13:
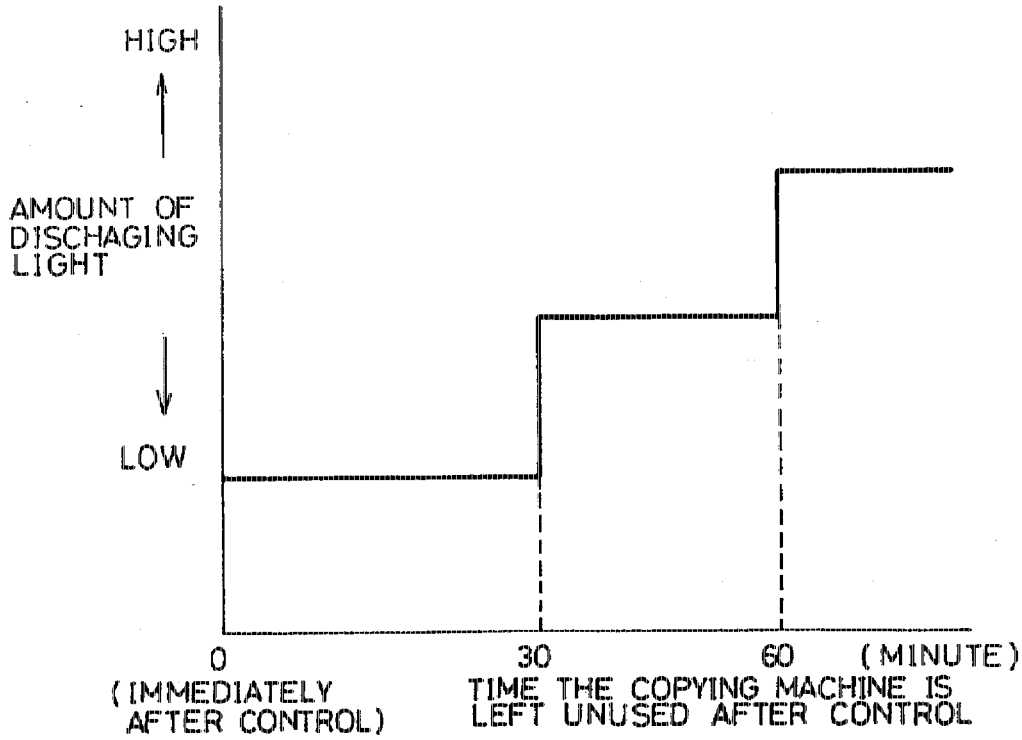
FIG. 13 is a graph showing correct values of discharging light which are set to maintain the relationship between the amount of discharging light and the copy density shown in FIG. 12.

A memory device (not shown) connected to the CPU 14 stores the correct value of the discharging light which is determined in advance according to the relationship between the amount of discharging light and the copy density as shown in FIG. 13. More specifically, the correct value of the discharging light is set so that it is gradually increased as the time that the copying machine is left unused after the feedback control becomes longer. The CPU 14 one-way-controls the amount of discharging light to be equal to the correct value upon an instruction to start the next copying operation according to the time that the copying machine is left unused after the feedback control, counted by the timer 15. Namely, the copy density which has become too high as a result of leaving the copying machine unused is again adjusted by increasing the amount of discharging light. Consequently, a copy of an appropriate copy density is obtained by the next copying operation.

By employing a combination of the feedback control of the amount of discharging light performed according to the amount of toner on the photoreceptor drum 1 during a rotation of the photoreceptor drum 1 after the copying operation and the one-way control of the amount of discharging light performed immediately before the next copying operation according to the time that the copying machine is left unused, it is possible appropriately correct changes in the copy density and to obtain stable image quality without increasing the consumption of toner and impairing the responsiveness of the copying machine.

Embodiment 4

The following description discusses another embodiment of the present invention with reference to FIGS. 2, 14 to 19. The members having the same function as in the above-mentioned embodiment will be designated by the same code and their description will be omitted.

Figure 14:
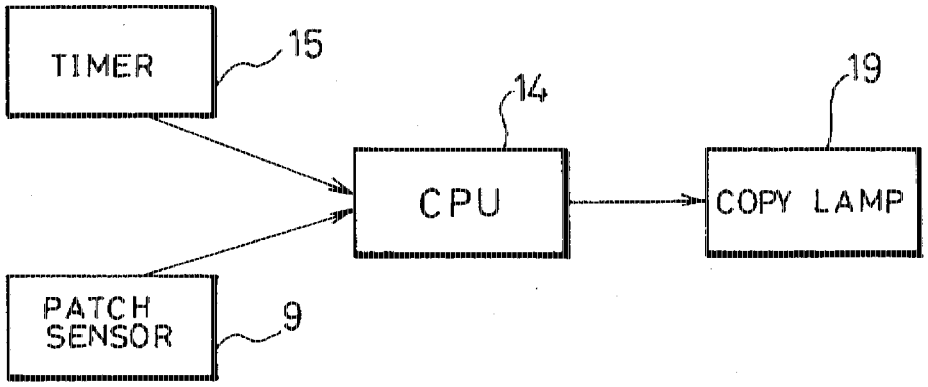
FIG. 14 is a block diagram showing a structure of a control system of a copying machine including an image-quality stabilizer according to still another embodiment of the present invention.

As illustrated in FIGS. 2 and 14, a copying machine as an electrophotographic apparatus including an image-quality stabilizer of this embodiment has the photoreceptor drum 1, and a copy lamp 19 for scanning the image of a document from the B direction. The image-quality stabilizer includes the patch sensor 9, the timer 15, and the CPU 14.

Figure 15:
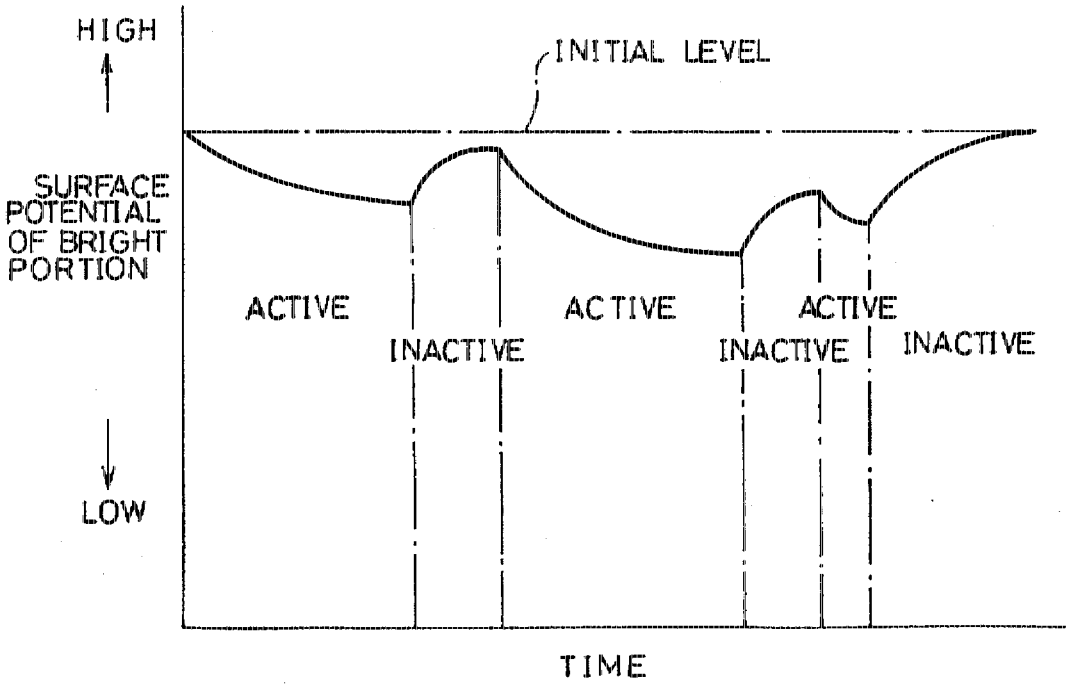
FIG. 15 is a graph showing changes in the surface potential of a light portion of the photoreceptor drum shown in FIG. 2 when the photoreceptor drum is active and left unused.

In this copying machine, a change in the surface potential of a bright portion of the photoreceptor drum 1 exposed to the light from the copy lamp 19 is caused mainly by the reasons (1) and (2) described in embodiment 1. Such a change causes a change in the copy brightness, resulting in unstable image quality. The graph of FIG. 15 shows a change in the surface potential of the bright portion of the photoreceptor drum caused by reason (1). More specifically, the surface potential of the bright portion of the photoreceptor drum 1 is lowered as the photoreceptor drum 1 is used and fatigued, while it is raised when the photoreceptor drum 1 is left unused and recovers from fatigue. Since the change in the surface potential of the bright portion occurs in a relatively short time, the change is easily predicted by taking account of a certain relationship.

Figure 16:
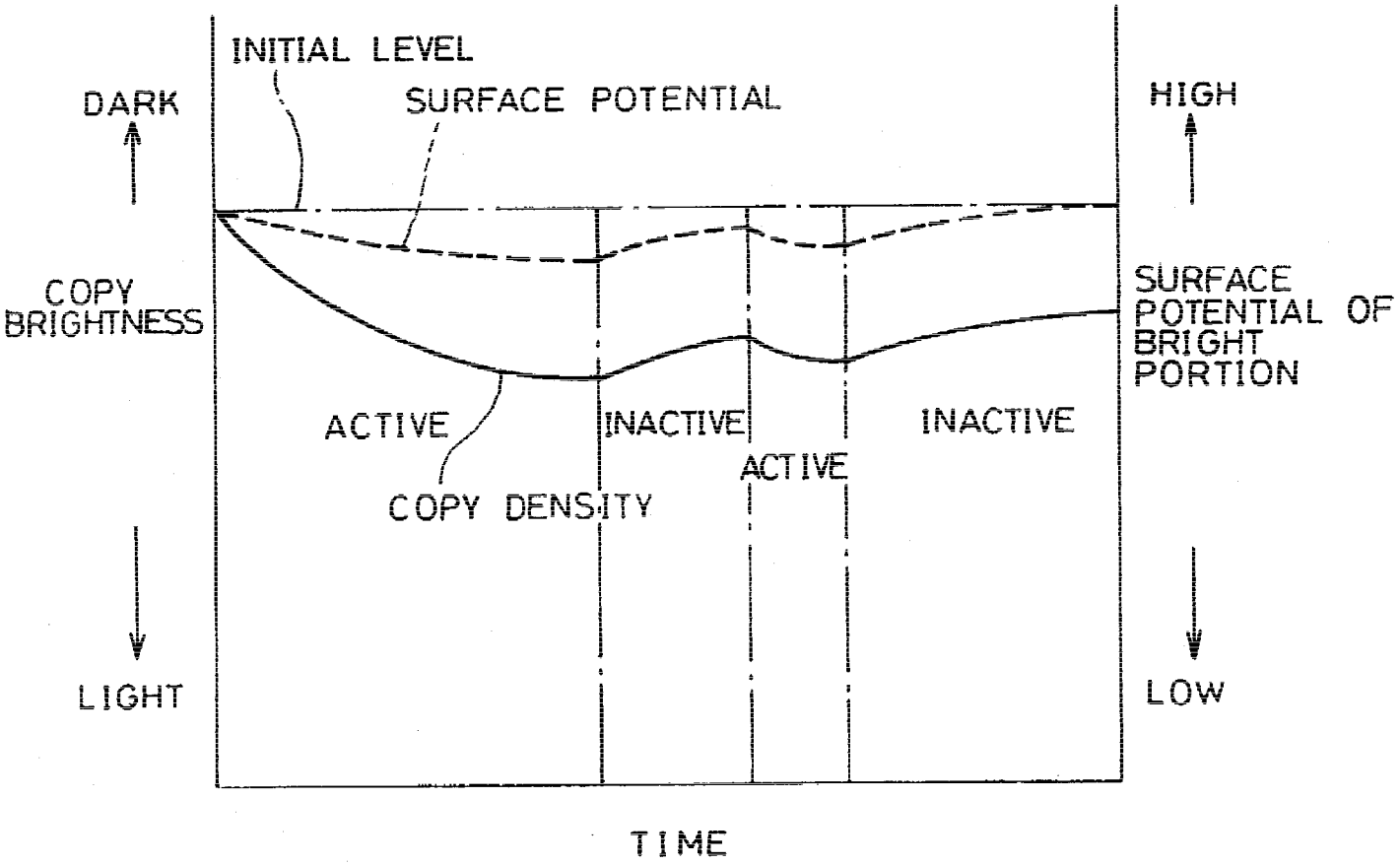
FIG. 16 is a graph showing changes in the copy brightness when the copying machine of FIG. 2 is active and left inactive and changes in the surface potential of a light portion of the photoreceptor drum shown in FIG. 2 when the photoreceptor drum is active and inactive.

The solid line of FIG. 16 shows changes in the copy brightness caused by reason (2). More specifically, when the copying machine is repeatedly used, the surface potential of the right portion of the photoreceptor drum 1 is lowered, the developer deteriorates, and the machine temperature is raised. As a result, the amount of toner attracted to the photoreceptor drum 1 is reduced, and the copy brightness is increased. On the other hand, when the photoreceptor drum 1 is left inactive, the photoreceptor drum 1 and the developer recover, and an increased amount of toner is attracted by the photoreceptor drum 1, thereby producing a fogged image.

Such a change in the copy brightness due to reason (2) occurs in a manner similar to the change in the surface potential of the bright portion of the photoreceptor drum 1 (indicated by the broken line in FIG. 16) due to reason (1). However, the change due to reason (2) is affected by various factors as mentioned above. Moreover, since such a change occurs over a long time, the degree of change due to reason (2) becomes greater than that of change caused by reason (1). It is therefore particularly difficult to predict a change in the copy brightness resulting from a repeated use of the copying machine.

In order to overcome such a drawback, the CPU 14 feedback-controls the amount of light of the copy lamp 19, i.e., the exposure level according to the amount of toner on the photoreceptor drum 1 detected by the patch sensor 9 during a rotation of the photoreceptor drum 1 after the copying operation as shown in FIG. 14. Also, the CPU 14 one-way-controls the exposure level just before the next copying operation according to the time that the copying machine is left unused after the feedback control, counted by the timer 15. With these control operations, the change in the copy brightness caused by reasons (1) and (2) are corrected, and stable image quality is obtained.

The following description discusses the control of the exposure level.

After the copying operation, the photoreceptor drum 1 is charged by the charger 2 whose output is set to a predetermined level, and a predetermined amount of light is applied to a reference plate (not shown) having a predetermined lightness in the exposure optical system by the copy lamp 19. When the photoreceptor drum 1 is exposed to reflected light from the reference plate, a latent image is formed on the photoreceptor drum 1. Then, toner is brought into contact with the latent image in the developing device 4 to form a light toner patch of a predetermined shape on the photoreceptor drum 1.

The amount of toner forming the light toner patch is detected by the patch sensor 9. The CPU 14 compares a predetermined reference value and the value detected by the patch sensor 9, and feedback-controls the exposure level so as to cause the detected value to become equal to the reference value. The reference value is set before the copying machine is used, i.e., when the copying machine is assembled in a factory or When the copying machine is installed, and stored in the memory device, not shown, connected to the CPU 14.

Figure 17:
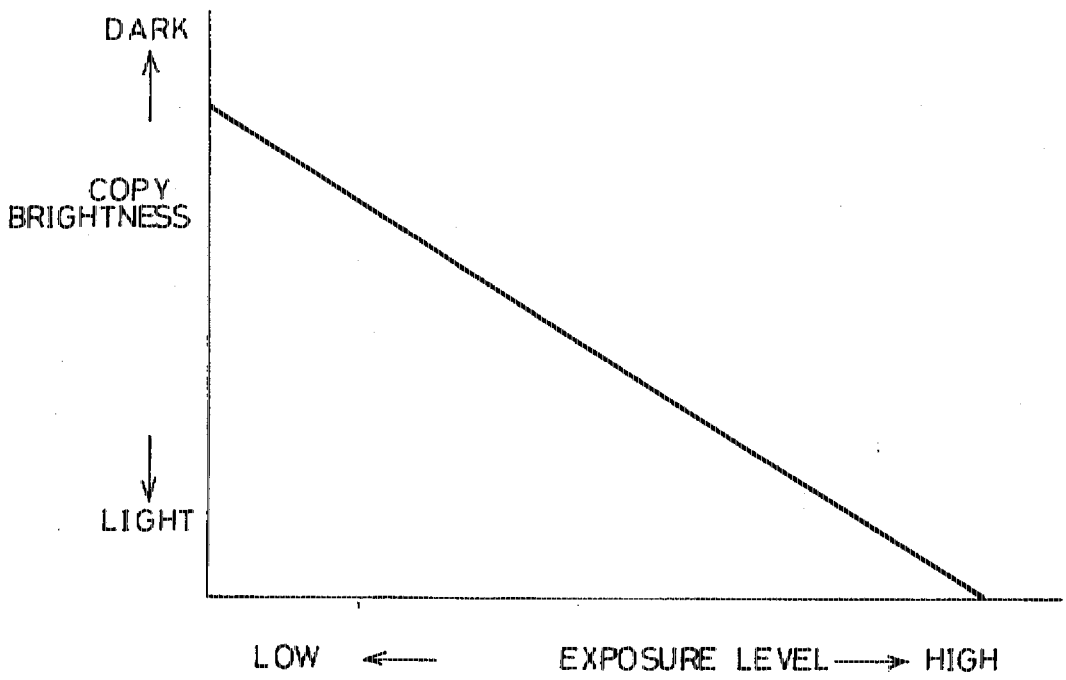
FIG. 17 is a graph showing the relationship between the exposure level and the copy brightness.

As illustrated in FIG. 17, the exposure level and the copy brightness have such a relationship that the copy brightness becomes higher as the exposure level is increased. Namely, as the exposure level is increased, the amount of toner attracted by the exposed portion on the photoreceptor drum 1 is reduced. Therefore, the copy brightness which has been changed by a repeated use of the copying machine is brought back to the initial level by decreasing the exposure level.

When the copying machine is left unused after the feedback control, the surface potential of the bright portion of the photoreceptor drum 1 is increased. This causes the toner to be more easily attracted to the exposed portion, resulting in a fogged image. However, the change in the copy brightness resulting from leaving the copying machine unused is easily predictable. Therefore, the correct value of the exposure level is determined in advance according to the relationship between the exposure level and the copy brightness, and stored in the memory. Namely; the correct value of the exposure level is gradually increased as the time that the copying machine is left unused after the feedback control becomes longer.

When the instruction to perform the next copying operation is given, the CPU 14 one-way-controls the exposure level to become equal to the predetermined correct value according to the time that the copying machine is left unused after the feedback control, counted by the timer 15. Namely, the copy brightness which has become too high as a result of leaving the copying machine unused is again corrected to an appropriate level by increasing the exposure level. Thus, the image produced by the next copying operation has an appropriate copy brightness.

Figure 19:
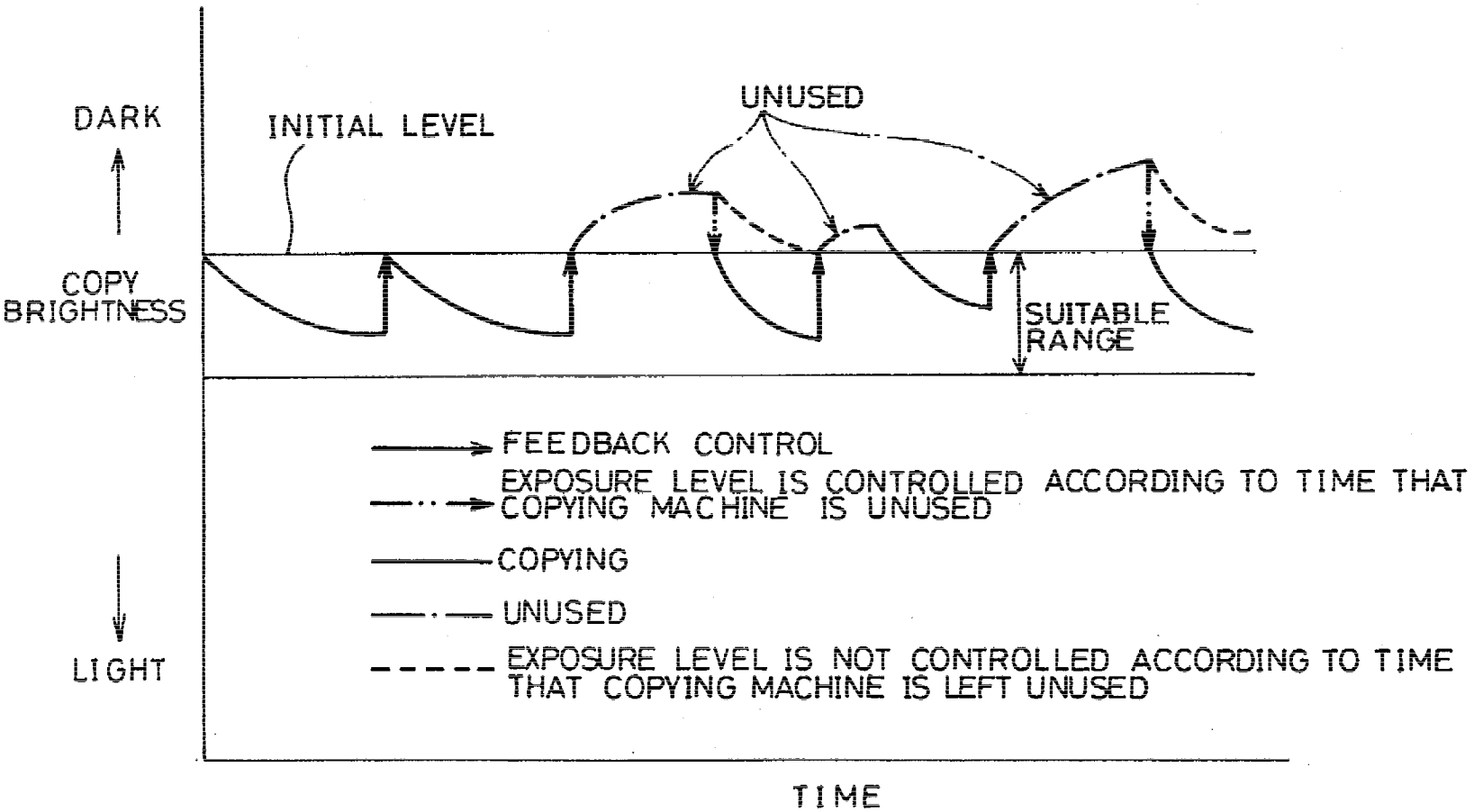
FIG. 19 is a graph showing changes in the copy brightness when the feedback control is performed during a rotation of the photoreceptor drum 1 after an image-forming operation and when the one-way control is performed according to the time that the copying machine of FIG. 2 is left inactive.

Even when the copy brightness is changed as a result of leaving the copying machine unused after the feedback control of the exposure level as shown in FIG. 19, it is possible to prevent a fogged image by executing a combination of the feedback control of the exposure level which is performed according to the amount of toner on the photoreceptor drum 1 during a rotation of the photoreceptor drum 1 after the copying operation and the one-way control of the exposure level which is performed before the next copying operation according to the time that the copying machine is left unused. Namely, an appropriate copy brightness is obtained by the next copying operation. When the exposure level is controlled only during the rotation of the photoreceptor drum 1 after the copying operation, the consumption of toner is increased. When the exposure level is controlled during the rotation of the photoreceptor drum 1 before the copying operation, the responsiveness of the copying machine is impaired. However, with the image-quality stabilizer of this embodiment; it is possible to appropriately correct a change in the copy brightness and to obtain stable image quality without having such drawbacks.

Embodiment 5

The following description discusses another embodiment of the present invention with reference to FIGS. 2, 17, 18, 20 to 25. The members having the same function as in the above-mentioned embodiment will be designated by the same code and their description will be omitted.

Figure 20:
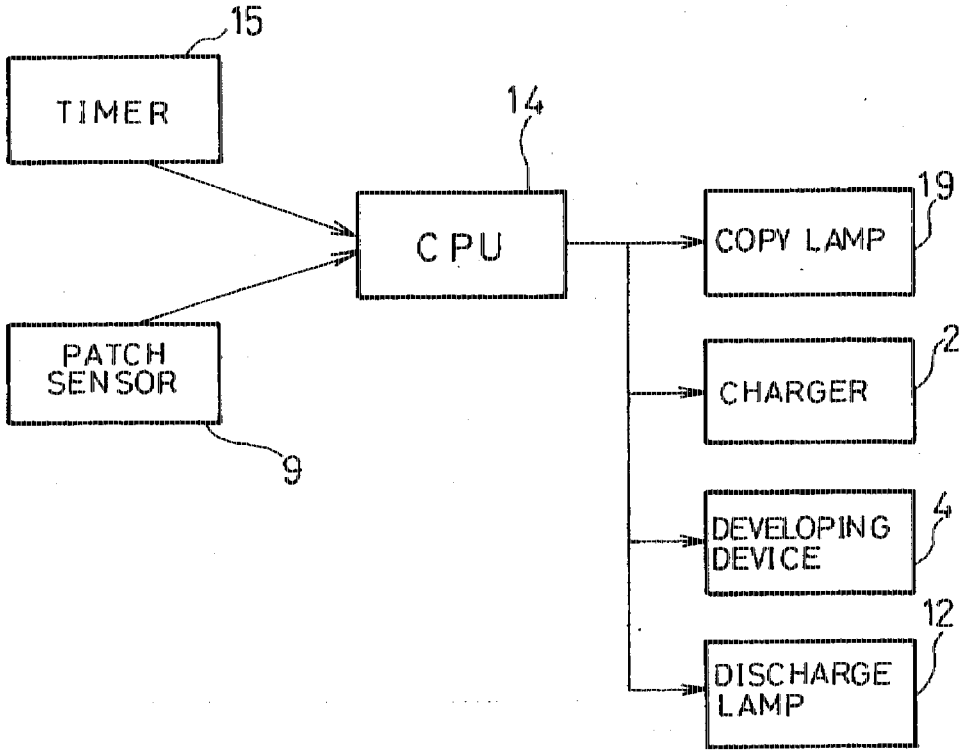
FIG. 20 is a block diagram showing a structure of a control system of a copying machine including an image-quality stabilizer according to still another embodiment of the present invention.

As illustrated in FIGS. 2 and 20, a copying machine as an electrophotographic apparatus including an image-quality stabilizer of this embodiment has the photoreceptor drum 1, the charger 2, the developing device 4 and the discharge lamp 12, disposed around the photoreceptor drum 1, as well as the copy lamp 19 for scanning the image on a document from the B direction. The image-quality stabilizer includes the patch sensor 9, the timer 15, and the CPU 14.

Figure 21:
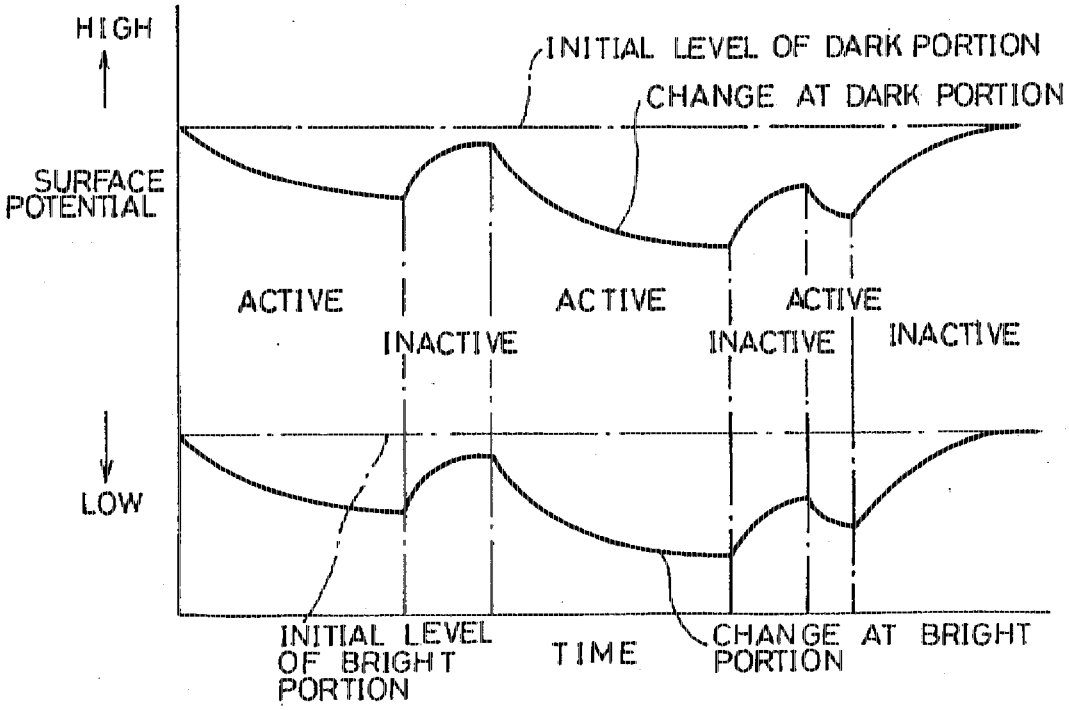
FIG. 21 is a graph showing changes in the surface potential corresponding to a dark portion and in the surface potential corresponding to a light portion when the photoreceptor drum of FIG. 2 is active and inactive.

In the copying machine having such a structure, the surface potential of an unexposed (dark) portion of the photoreceptor drum 1 and the surface potential of an exposed (bright) portion of the photoreceptor drum 1 change as shown in FIG. 21 due to reason (1). Regarding the change in the surface potential of the exposed portion and of the unexposed portion, although the time constant and the degree of change are different in the unexposed portion and the exposed portion, the surface potentials of both of the portions are changed in a similar manner. Namely, the surface potentials are lowered when the photoreceptor drum 1 is used, while they are raised when the photoreceptor drum 1 is left unused.

Figure 22:
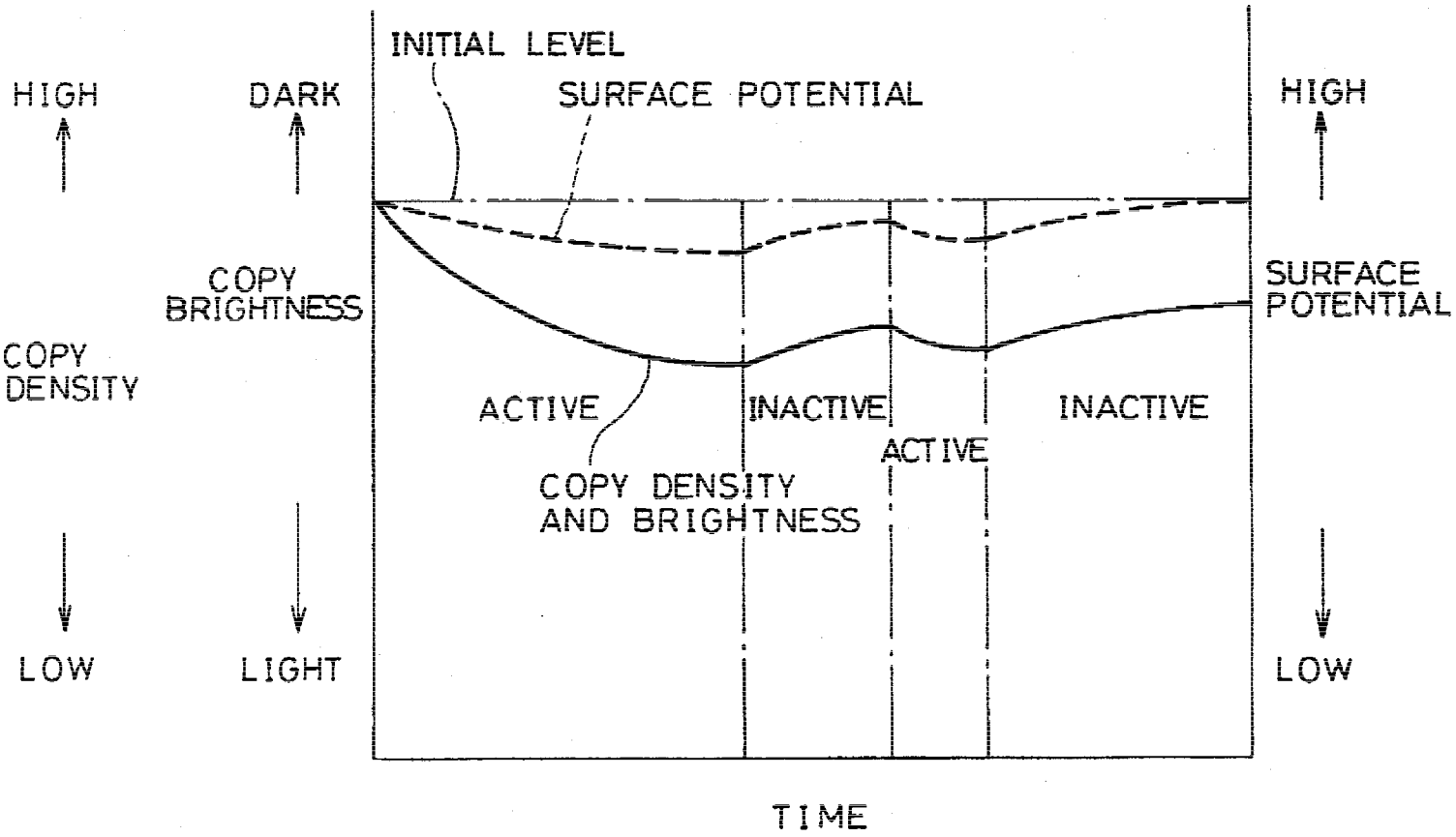
FIG. 22 is a graph showing changes in the copy density and copy brightness when the copying machine of FIG. 2 is active and left inactive, and changes in the surface potential when the photoreceptor drum of FIG. 2 is active and inactive.

Additionally, the copy density and the copy brightness change as shown by the solid line of the graph in FIG. 22 due to reason (2) described in embodiment 1. The changes in the copy density and the copy brightness due to reason (2) occur in a manner similar to the changes in the surface potentials of the exposed and unexposed portions (see the broken line in FIG. 22) due to reason (1), but the rate of change differs from each other. As described above, since the changes in the copy density and the copy brightness due to reason (2) are affected by various factors, it is hard to predict such changes.

Then, the CPU 14 feedback-controls at least one of the charger output, the development bias output of the developing device 4, and the amount of discharging light of the discharge lamp 12 as well as the exposure level (the light amount of the copy lamp 19) according to the amount of toner on the photoreceptor drum 1 detected by the patch sensor 9 during a rotation of the photoreceptor drum 1 after a copying operation. The CPU 14 one-way-controls at least one of the charger output, the development bias output and the amount of discharging light as well as the exposure level just before the next copying operation according to the time that the copying machine is left unused after the feedback control, counted by the timer 15. With these controlling operations, the changes in the image quality which are caused when the copying machine is used or left unused are corrected and stable image quality is obtained.

The following description discusses the control of each of the image forming devices.

Like the copying machine of embodiment 1, a dark toner patch is formed on the photoreceptor drum 1 during a rotation of the photoreceptor drum 1 after a copying operation. The amount of toner forming the dark toner patch is detected by the patch sensor 9. The CPU 14 feedback-controls at least one of the charger output, the development bias output, and the amount of discharging light according to the relationship between the copy density and the charger output, the development bias output or the amount of discharging light shown in FIG. 23 and described in embodiments 1 to 3 and the relationship between the copy density and the exposure level shown in FIG. 17 and discussed in embodiment 4 so that a value detected by the patch sensor 9 becomes equal to a predetermined reference value. With this control, the copy density which has been lowered by a repeated use of the copying machine is brought back to the initial level.

Like embodiment 4, a light toner patch is formed on the photoreceptor drum 1 during a rotation of the photoreceptor drum 1 after a copying operation. The amount of toner forming the light toner patch is detected by the patch sensor 9. The CPU 14 adjusts the light amount of the copy lamp 19 according to the relationship between the copy density and the exposure level (shown in FIG. 17 and discussed in embodiment 4) so that the value detected by the patch sensor 9 becomes equal to the predetermined reference value. With this adjustment, the exposure level of the photoreceptor drum 1 is feedback-controlled, and the copy brightness which has been changed by a repeated use of the copying machine is brought back to the initial level.

Figure 18:
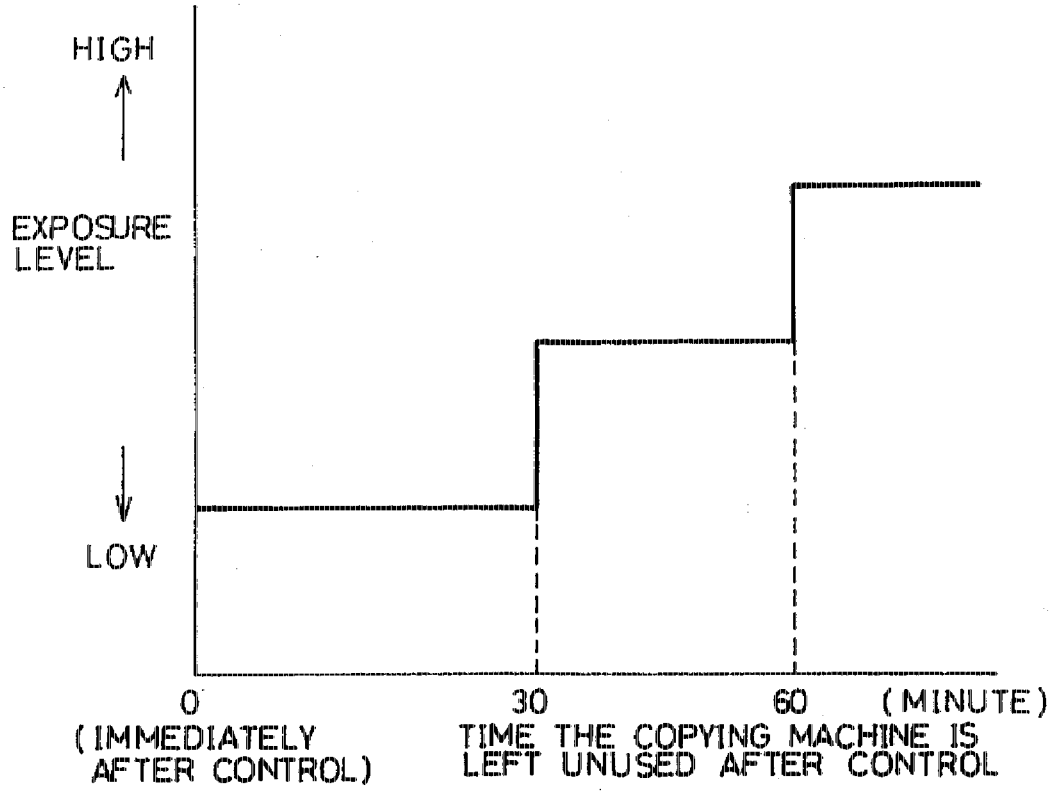
FIG. 18 is a graph showing correct values of the exposure level which are set to maintain the relationship between the exposure level and the copy brightness shown in FIG. 17.
Figure 24:
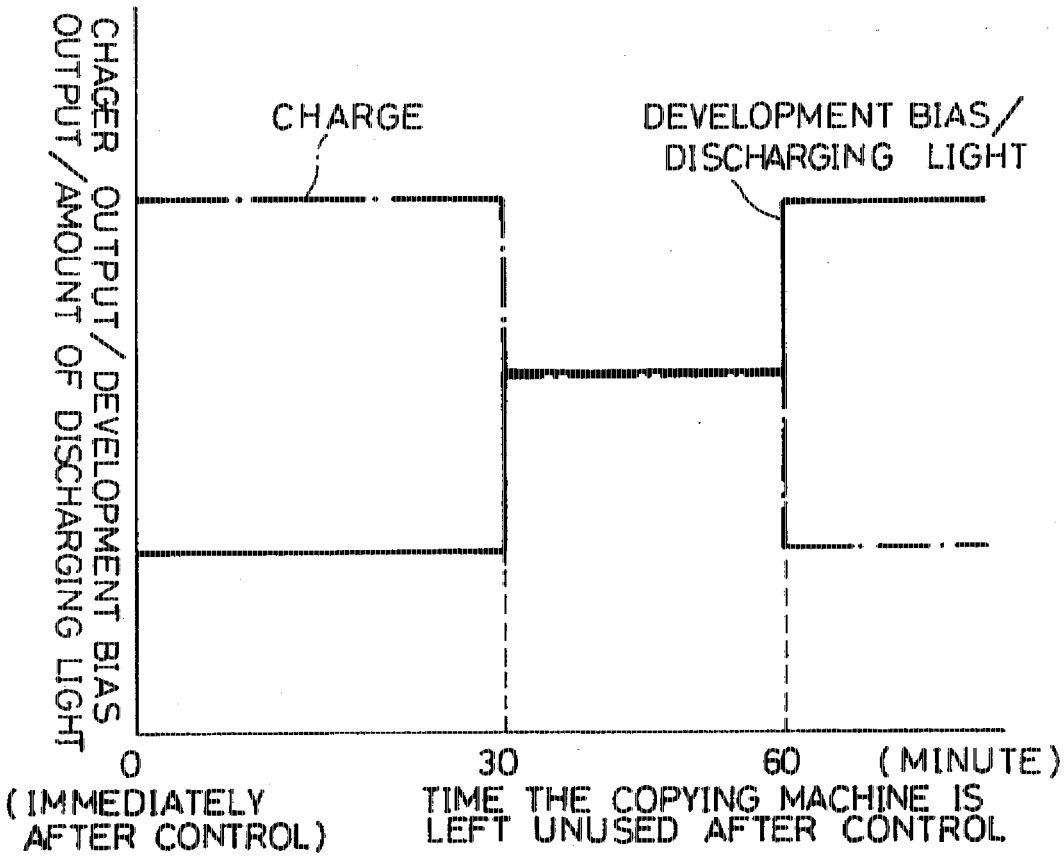
FIG. 24 is a graph showing correct values of the charger output, the development bias output and the discharging light which are set according to the time that the copying machine is left inactive so as to maintain the relationship with the copy density shown in FIG. 23.

Similar to embodiments 1 to 3, the correct values of the charger output, the development bias output and the amount of discharging light which are determined in advance according to the time that the copying machine is left unused after the feedback control as shown in FIG. 24 are stored in the memory device (not shown) connected to the CPU 14. Like embodiment 4, the correct value of the exposure level which is determined in advance according to the time that the copying machine is left unused after the copying operation is stored in the memory device as shown in FIG. 18.

When the instruction to start the next copying operation is given after the feedback control, the CPU 14 one-way-controls at least one of the charger output, the development bias output, and the amount of discharging light as well as the exposure level according to the time that the copying machine is left unused after the feedback control, counted by the timer 15. With these control operations, the copy density which has been become too high as a result of leaving the copying machine unused is corrected, thereby preventing a fogged image.

In the image-quality stabilizer of this embodiment, the copy density is adjusted by controlling at least one of the charger output, the development bias output, and the amount of discharging light with respect to the dark portion of the photoreceptor drum 1 corresponding to a high-dense portion of the image. While the copy brightness is adjusted by controlling the exposure level with respect to the bright portion of the photoreceptor drum 1 corresponding to a low-dense portion of the image. More specifically, the image-quality stabilizer feedback-controls at least one of the charger output, the development bias output, and the amount of discharging light as well as the exposure level during a rotation of the photoreceptor drum 1 after a copying operation, and one-way-controls at least one of the charger output, the development bias output, and the amount of discharging light as well as the exposure level according to the time that the copying machine is left unused after the feedback control.

Figure 25:
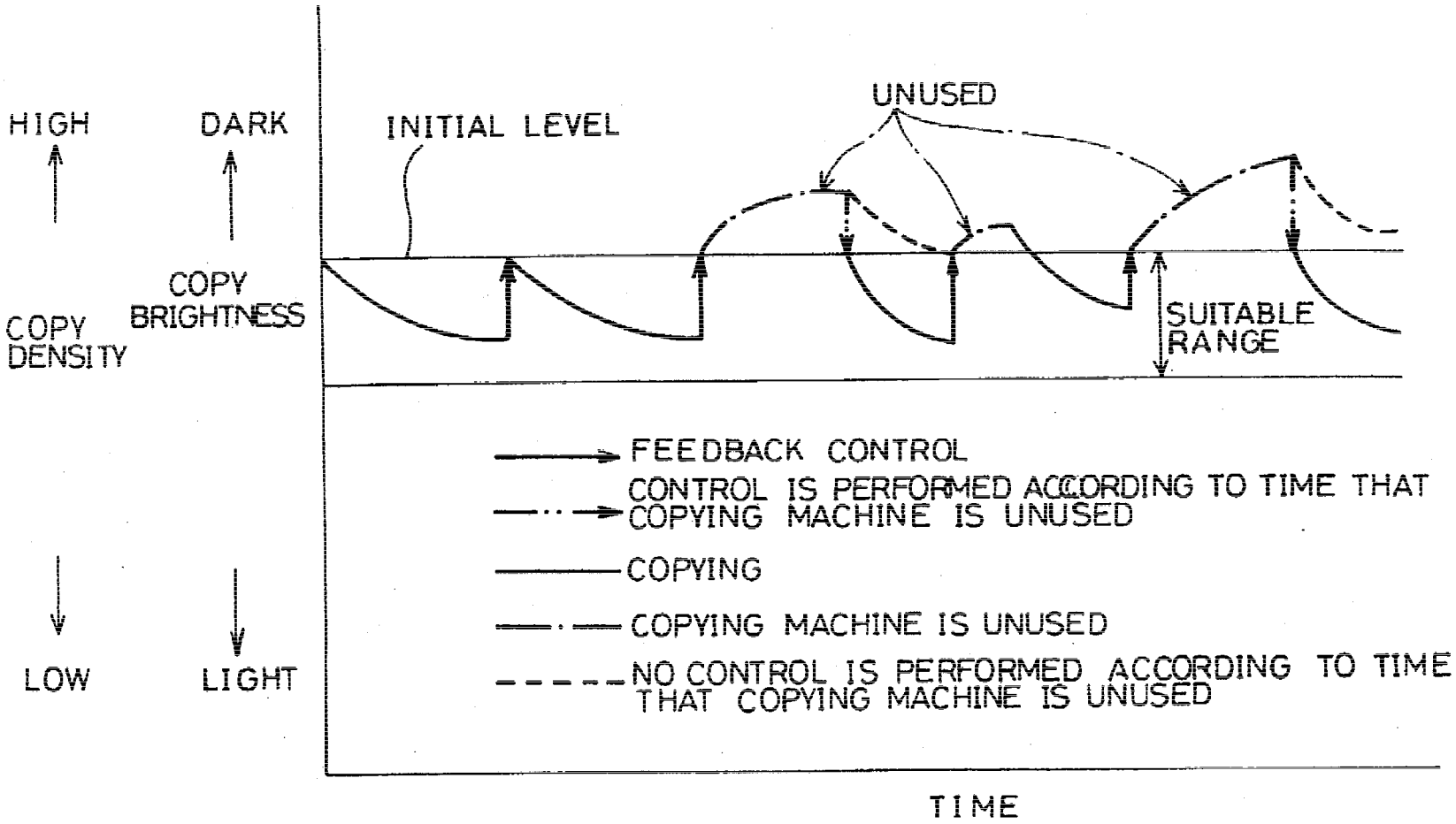
FIG. 25 is a graph showing changes in the copy density and copy brightness when the feedback control is performed during a rotation of the photoreceptor drum 1 after an image-forming operation and when the one-way control is performed according to the time that the copying machine of FIG. 2 is left inactive.

It is therefore possible to appropriately correct the changes in the copy density and the copy brightness resulting from a repeated use of the copying machine or leaving the copying machine left unused, and to provide stable image quality without increasing the consumption of toner and impairing the responsiveness of the copying machine as illustrated in FIG. 25.

Embodiment 6

The following description discusses another embodiment of the present invention with reference to FIGS. 1, 2, 26 and 27. The members having the same function as in the above-mentioned embodiment will be designated by the same code and their description will be omitted.

As illustrated in FIG. 2, a copying machine as an electrophotographic apparatus including an image-quality stabilizer of this embodiment has the photoreceptor drum 1, and the charger 2 disposed around the photoreceptor drum 1. As illustrated in FIG. 1, the image-quality stabilizer includes the patch sensor 9, the timer 15, and the CPU 14. The CPU 14 is connected to the memory device, not shown, storing the relationship between time and the surface potential of the photoreceptor drum 1, i.e., surface-potential recovering ability of the photoreceptor drum 1, as an approximated function of time.

Based on the surface-potential recovering ability, the CPU 14 one-way-controls the charger output according to the time that the copying machine is left unused, counted by the timer 15, and feedback-controls the output of the charger 2 according to the amount of toner on the photoreceptor drum 1 detected by the patch sensor 9 during a rotation of the photoreceptor drum 1 after a copying operation in the same manner as in embodiment 1. With these controlling operations, the changes in the copy density caused when the copying machine is used or left unused are corrected, thereby providing stable image quality.

The following description discusses the control of the charger output.

A decrease in the surface potential of the photoreceptor drum 1 is calculated from a fatigue characteristic (shown by an alternate long and short dash line in FIG. 26) approximated as a function of logarithm of the time that the copying machine is used. For example, if the initial potential of the photoreceptor drum 1 at the start of a copying operation is denoted as $V_0$ and if the copying machine is repeatedly used for the time $T_1$, the surface potential of the photoreceptor drum 1 is decreased to $V_1$ shown by the point C. The decrease in the surface potential causes a decrease in the copy density. However, in reality, the copy density is decreased not only by the fatigue of the photoreceptor drum 1 but also other factors such as the deterioration of the developer property. Namely, predicting the decrease in the surface potential is difficult because it is not obtained only from the fatigue characteristic.

Like the copying machine of embodiment 1, in the copying machine of this embodiment, a toner patch is formed on the photoreceptor drum 1 during a rotation of the photoreceptor drum 1 after a copying operation, and the charger output is feedback-controlled according to the amount of toner detected by the patch sensor 9. With this control, the copy density which has been decreased by a repeated use of the copying machine is corrected to the initial level.

On the other hand, if the photoreceptor drum 1 is stopped rotating and the copying machine is left unused after the copying operation, the photoreceptor drum 1 recovers gradually and its surface potential is increased. Such a surface-potential recovering ability is shown as a recovery characteristic line approximated as a function of logarithm of the time that the copying machine is left unused.

Figure 27:
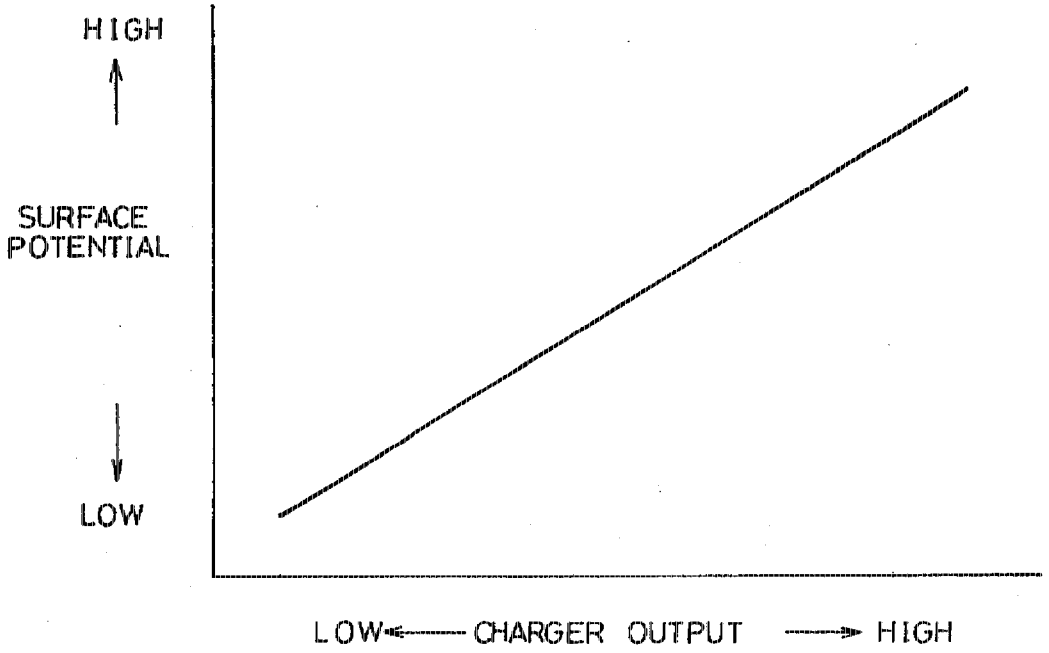
FIG. 27 is a graph showing the relationship between the charger output and the surface potential of the photoreceptor drum.

The recovery of the surface potential of the photoreceptor drum 1 as a function of the time that the copying machine is left unused is obtained from the recovery characteristic line. For example, if the copying machine is unused for the time $T_2$, the surface potential of the photoreceptor drum 1 recovers to $V_2$ shown by point D. As illustrated in FIG. 27, the charger output and the surface potential have such a relationship that the surface potential is raised as the charger output is increased.

Figure 26:
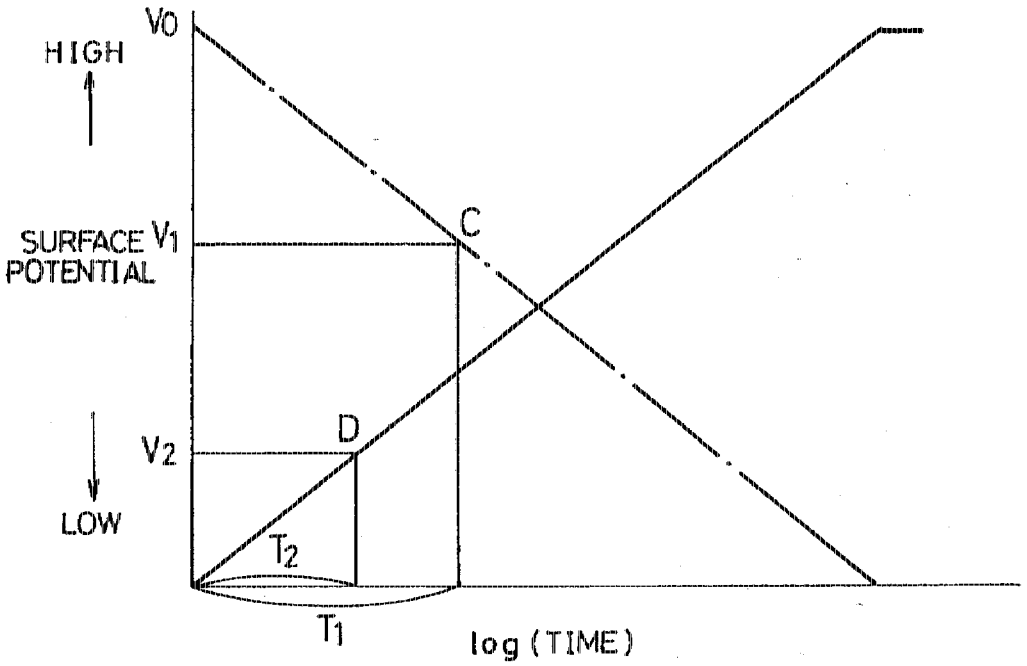
FIG. 26 is a graph showing the relationship between the surface potential of the photoreceptor drum 1 and logarithm of time.

The recovery of the surface potential as a function of time that the copying machine is left unused after the copying operation, counted by the timer 15 is obtained from the recovery characteristic line shown in FIG. 26. To adjust the recovery of the surface potential before starting the next copying operation, the CPU 14 one-way-controls the charger output according to the relationship between the charger output and the surface potential shown in FIG. 27. With this control, the copy density which becomes too high when the copying machine is left unused is corrected. Therefore, a copy produced by the next copying operation has an appropriate copy density.

As described above, the image-quality stabilizer of this embodiment feedback-controls the charger output according to the amount of toner on the photoreceptor drum 1 during a rotation of the photoreceptor drum after a copying operation to correct a decrease in the copy density resulting from a repeated use of the copying machine. The image-quality stabilizer also corrects an increase in the copy density which is caused when the copying machine is left unused by one-way-controlling the charger output according to the time that the copying machine is left unused using the approximate function representing the surface-potential recovery ability. With this structure, it is possible to always have the copy density within an appropriate range without impairing the responsiveness of the copying machine and increasing the consumption of toner.

Furthermore, in comparison with the control by using the correct value predetermined according to the time that the copying machine is left unused described in the embodiment 1, the image-quality stabilizer of this embodiment enables more appropriate adjustment of the image quality by approximating the surface-potential recovering ability of the photoreceptor drum 1 as a function of time that the copying machine is left unused and by controlling the charger output as a function of time.

Embodiment 7

The following description discusses another embodiment of the present invention with reference to FIGS. 2, 8, 26 and 28. The members having the same function as in the above-mentioned embodiment will be designated by the same code and their description will be omitted.

As illustrated in FIG. 2, a copying machine as an electrophotographic apparatus including an image-quality stabilizer of this embodiment has the photoreceptor drum 1, and the developing device 4 disposed around the photoreceptor drum 1. As illustrated in FIG. 8, the image-quality stabilizer includes the patch sensor 9, the timer 15, and the CPU 14. The CPU 14 is connected to the memory, not shown, storing the function representing the surface-potential recovering ability of the photoreceptor drum 1 described in embodiment 6 (see FIG. 26).

The CPU 14 feedback-controls the development bias output of the developing device 4 according to the amount of toner on the photoreceptor drum 1 detected by the patch sensor 9 during a rotation of the photoreceptor drum 1 after a copying operation, and one-way-controls the development bias output using the function according to the time that the copying machine is left unused, counted by the timer 15. These controlling operations correct changes in the copy density caused when the copying machine is used or left unused so as to provide stable image quality.

The following description discusses the control of the development bias output in detail.

Like embodiment 1, a toner patch is formed on the photoreceptor drum 1 during a rotation of the photoreceptor drum 1 after a copying operation. The development bias output is feedback-controlled according to the amount of toner on the photoreceptor drum 1 detected by the patch sensor 9. As a result, a lowered copy density resulting from a repeated use of the copying machine is corrected to the initial level.

The time that the copying machine is left unused after the feedback control is counted by the timer 15, and the recovery of the surface potential is calculated from the time using the function.

The development potential affecting the copy density is given by the equation development potential=surface potential−development bias Therefore, a change in the development potential resulting from a change in the surface potential is corrected by controlling the development bias. More specifically, as shown in FIG. 28, the development potential is decreased as the development bias output is increased.

Figure 28:
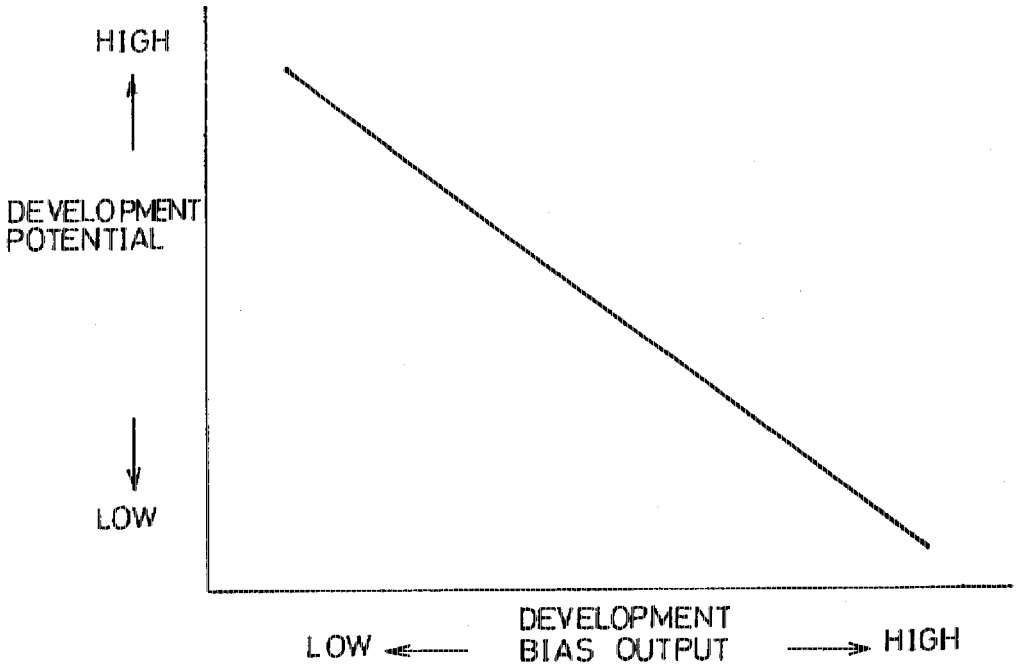
FIG. 28 is a graph showing the relationship between the development bias output and the development potential.

Therefore, like adjusting the recovery of the photoreceptor drum 1 which is calculated using the surface-potential recovering ability as a function, the development bias output is one-way-controlled before starting the next copying operation according to the time that the copying machine is left unused, counted by the timer 15 by taking account of the relationship between the development bias output and the development potential shown in FIG. 28. Namely, since the excessively high copy density caused when the copying machine is left unused is corrected by decreasing the development bias output, an appropriate copy density is obtained by the next copying operation.

As described above, the image-quality stabilizer of this embodiment feedback-controls the development bias output during a rotation of the photoreceptor drum 1 performed after the copying operation and one-way-controls the development bias output according to the approximate function representing the surface-potential recovering ability. With this structure, it is possible appropriately correct the changes in the copy density and to provide stable image quality without increasing the consumption of toner and impairing the responsiveness of the copying machine. Moreover, correcting the copy density which has been raised as a result of leaving the copying machine unused according to the approximate function representing the surface-potential recovering ability achieves a more appropriate correction of the image quality in comparison with the correction which is made by controlling the development bias output to become equal to a predetermined correct value.

Embodiment 8

The following description discusses another embodiment of the present invention with reference to FIGS. 2, 26, 29 and 30. The members having the same function as in the above-mentioned embodiment will be designated by the same code and their description will be omitted.

Figure 29:
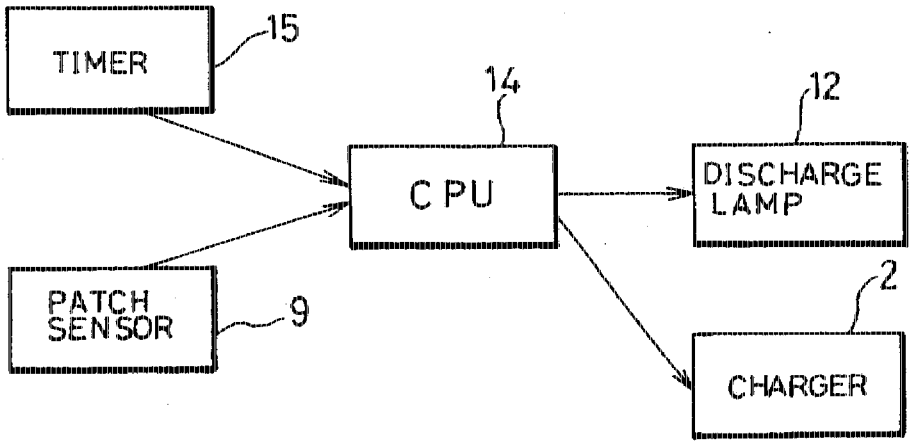
FIG. 29 is a block diagram showing a structure of a control system of a copying machine including an image-quality stabilizer according to still another embodiment of the present invention.

As illustrated in FIG. 2, a copying machine as an electrophotographic apparatus including an image-quality stabilizer of this embodiment has the photoreceptor drum 1, and the charger 2 and the discharge lamp 12 disposed around the photoreceptor drum 1. As illustrated in FIG. 29, the image-quality stabilizer includes the patch sensor 9, the timer 15, and the CPU 14. The CPU 14 is connected to the memory, not shown, storing the function representing the surface-potential recovering ability of the photoreceptor drum 1 (see FIG. 26).

The CPU 14 feedback-controls the output of the charger 2 according to the amount of toner on the photoreceptor drum 1 detected by the patch sensor 9, and one-way-controls the amount of discharging light from the discharge lamp 12 using the function according to the time that the copying machine is left unused. These controlling operations correct changes in the copy density caused when the copying machine used or left unused so as to provide stable image quality.

The following description discusses the control of the charger output and of the amount of discharging light in detail.

Like embodiment 1, a dark toner patch is formed on the photoreceptor drum 1 during a rotation of the photoreceptor drum 1 after a copying operation. The CPU 14 feedback-controls the charger output according to an amount of toner on the photoreceptor drum 1 detected by the patch sensor 9. With this control, a lowered copy density as a result of a repeated use of the copying machine is brought back to the initial level.

Figure 30:
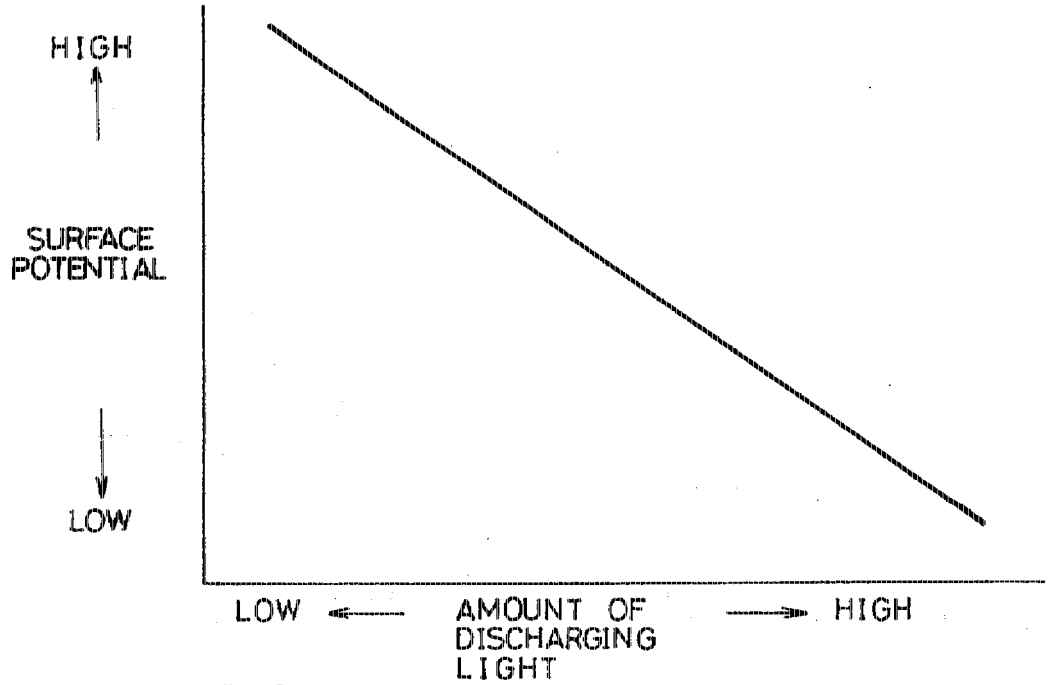
FIG. 30 is a graph showing the relationship between the amount of discharging light and the surface potential of the photoreceptor drum.

As illustrated in FIG. 30, the surface potential is decreased as the amount of discharging light is increased. In order to one-way-control the amount of discharging light according to the time that the copying machine is left unused, the time the copying machine is left unused after a copying operation is counted by the timer 15 and the recovery of the surface potential is calculated using the recovery characteristic line shown in FIG. 26. The recovery is adjusted by one-way-controlling the amount of discharging light according to the relationship between amount of discharging light and the surface potential, shown in FIG. 30, before starting the next copying operation. This control corrects an excessively high copy density resulting from leaving the copying machine unused, and provides stable image quality through the next copying operation.

As described above, the image-quality stabilizer of this embodiment feedback-controls the charger output during a rotation of the photoreceptor drum 1 performed after the copying operation and one-way-controls the amount of discharging light using the approximate function representing the surface-potential recovering ability. With this structure, it is possible appropriately correct changes in the copy density and to provide stable image quality without increasing the consumption of toner and impairing the responsiveness of the copying machine. Moreover, correcting the copy density which has been raised as a result of leaving the copying machine unused using the function representing the surface-potential recovering ability achieves a more appropriate correction of the image quality in comparison with the correction which is done by controlling the amount of discharging light to become equal to a predetermined correct value.

Embodiment 9

The following description discusses another embodiment of the present invention with reference to FIGS. 2, 14, 26 and 31. The members having the same function as in the above-mentioned embodiment will be designated by the same code and their description will be omitted.

As illustrated in FIGS. 2 and 14, a copying machine as an electrophotographic apparatus including an image-quality stabilizer of this embodiment has the photoreceptor drum 1, and the copy lamp 19 for scanning the image of a document from the B direction. The image-quality stabilizer includes the patch sensor 9, the timer 15, and the CPU 14. The CPU 14 is connected to the memory, not shown, storing the function representing the surface-potential recovering ability of the photoreceptor drum 1 (see FIG. 26).

The CPU 14 feedback-controls the exposure level by controlling the amount of light from the copy lamp 19 according to the amount of toner on the photoreceptor drum 1 detected by the patch sensor 9, and one-way-controls the exposure level according to the time that the copying machine is left unused. These controlling operations correct changes in the copy brightness caused when the copying machine is used or left unused so as to provide stable image quality.

The following description discusses the control of the exposure level in detail.

Like embodiment 4, a light toner patch is formed on the photoreceptor drum 1 during a rotation of the photoreceptor drum 1 after a copying operation. The CPU 14 feedback-controls the exposure level according to an amount of toner on the photoreceptor drum 1 detected by the patch sensor 9. With this control, the copy brightness which has been changed by a repeated use of the copying machine is brought back to the initial level.

Figure 31:
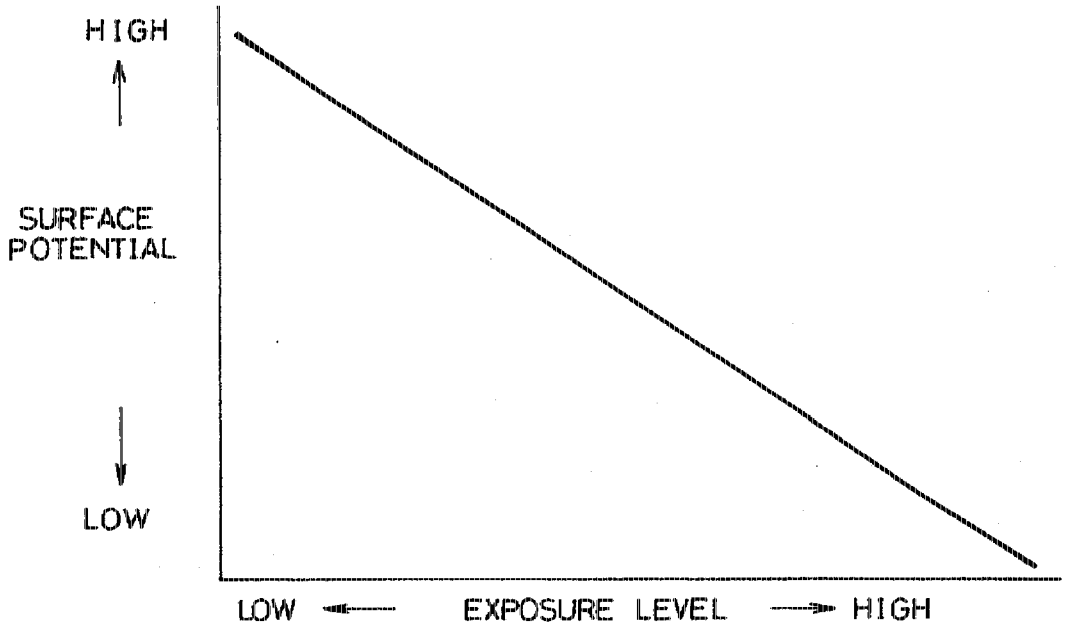
FIG. 31 is a graph showing the relationship between the exposure level and the surface potential of the photoreceptor drum.

As illustrated in FIG. 31, the surface potential is decreased when the exposure level is raised. In order to one-way-control the exposure level according to the time that the copying machine is left unused, the time that the copying machine is left unused after a copying operation is counted by the timer 15 and the recovery of the surface potential is calculated using the function representing the surface-potential recovering ability shown in FIG. 26. The recovery is adjusted by one-way-controlling the exposure level according to the relationship between the exposure level and the surface potential, shown in FIG. 31, before starting the next copying operation. This control corrects an excessively high copy brightness resulting from leaving the copying machine unused so as to prevent a fogged image.

As described above, the image-quality stabilizer of this embodiment feedback-controls the exposure level during the rotation of the photoreceptor drum 1 after a copying operation, and one-way-controls the exposure level according to the time that the copying machine is left unused using the approximate function representing the surface-potential recovering ability. With this structure, it is possible to appropriately correct changes in the copy brightness and to provide stable image quality without increasing the consumption of toner and impairing the responsiveness of the copying machine. Moreover, preventing a fogged image from being caused when the copying machine is left unused using the function representing the surface-potential recovering ability achieves a more appropriate correction of the image quality in comparison with the correction carried out by controlling the exposure level to become equal to a predetermined correct value.

Embodiment 10

The following description discusses another embodiment of the present invention with reference to FIGS. 2, 20, 26, 31 and 32. The members having the same function as in the above-mentioned embodiment will be designated by the same code and their description will be omitted.

As illustrated in FIGS. 2 and 20, a copying machine as an electrophotographic apparatus including an image-quality stabilizer of this embodiment has the photoreceptor drum 1, the charger 2, the developing device 4 and the discharge lamp 12, disposed around the photoreceptor drum 1, as well as the copy lamp 19 for scanning the image of a document from the B direction. The image-quality stabilizer includes the patch sensor 9, the timer 15, and the CPU 14. The CPU 14 is connected to the memory, not shown, storing the function representing the surface-potential recovering ability of the photoreceptor drum 1 (see FIG. 26).

The CPU 14 feedback-controls at least one of the output of the charger 2, the amount of development bias output of the developing device 4, and the amount of discharging light of the discharge lamp 12 as well as the exposure level (the light amount of the copy lamp 19) according to the amount of toner on the photoreceptor drum 1 detected by the patch sensor 9. The CPU 14 one-way-controls at least one of the charger output, the development bias output and the amount of discharging light as well as the exposure level according to the time that the copying machine is left unused, counted by the timer 15, using the function. With these controlling operations, changes in the copy density and brightness caused when the copying machine is used or left unused are corrected, and stable image quality is obtained.

The following description discusses the control of each of the image forming devices.

Like embodiment 5, in the copying machine, a dark toner patch and a light toner patch are formed on the photoreceptor drum 1 during a rotation of the photoreceptor drum 1 after a copying operation. The amount of toner forming the dark toner patch and of the light toner patch are detected by the patch sensor 9. The CPU 14 feedback-controls at least one of the charger output, the development bias output, and the amount of discharging light as well as the exposure level according to the amounts of toner detected. With this control, the copy density and the copy brightness which have been changed by a repeated use of the copying machine are brought back to the initial level.

Figure 32:
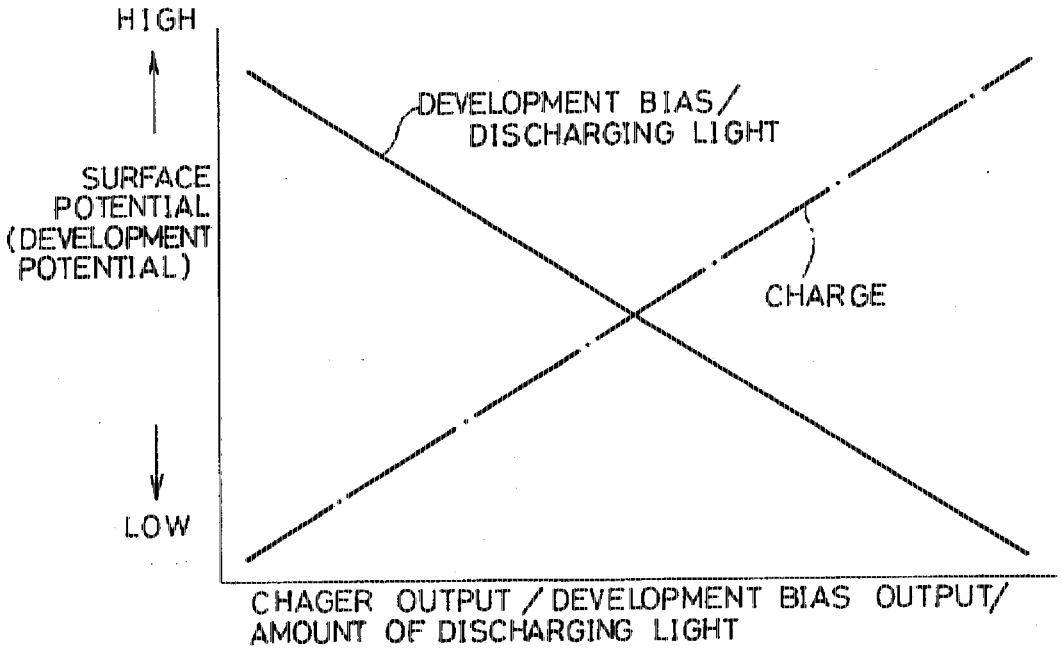
FIG. 32 is a graph showing the relationship between the charger output, the development bias output and the amount of discharging light, and the surface potential of the photoreceptor drum.

Like embodiments 6 to 8, the relationship between the surface potential and the charger output, and the development bias output and the amount of discharging light is shown in FIG. 32. In the copying machine, when an instruction to start the next copying operation is given, the time that the copying machine is left unused after a copying operation is counted with the timer 15. The recovery of the surface potential is calculated from the counted time using the function representing the recovery characteristic line shown in FIG. 26. Then, to adjust the recovery, the CPU 14 one-way-controls at least one of the charger output, the development bias output, and the amount of discharging light according to the relationship shown in FIG. 32 before starting the next operation. With these control operations, an excessively high copy density resulting from leaving the copying machine unused is corrected. Therefore, a copy produced by the next copying operation has an appropriate density.

As described in embodiment 9, the relationship between the exposure level and the surface potential is shown in FIG. 31. The recovery of the photoreceptor drum 1 is calculated from the time that the copying machine is left unused after the copying operation, counted by the timer 15, using the function representing the surface-potential recovery characteristic (see FIG. 26). To adjust the recovery, the CPU 14 one-way-controls the exposure level according to the relationship between the exposure level and the surface potential shown in FIG. 31 before starting the next copying operation. This control corrects an excessively high copy brightness resulting from leaving the copying machine unused, preventing a fogged image.

With this structure, it is possible to always have the copy density and the copy brightness within suitable ranges without impairing the responsiveness of the copying machine and increasing the consumption of toner. Moreover, in comparison with the control performed using the correct value predetermined according to the time that the copying machine is left unused, the image-quality stabilizer of this embodiment achieves a more appropriate correction of the image quality to prevent an increase in the copy density and a fogged image from being caused when the copying machine is left unused by performing the control using the approximate function representing the surface-potential recovering ability.

Furthermore, in terms of the copy density and brightness, stable image quality is obtained by adjusting the density of a dark portion corresponding to a high-dense portion of the image with the control of the charger, the development bias output or the amount of discharging light and by adjusting the brightness of a bright portion corresponding to a low-dense portion of the image with the control of the exposure level.

Embodiment 11

The following description discusses another embodiment of the present invention with reference to FIGS. 1, 2, 6 and 33. The members having the same function as in the above-mentioned embodiment will be designated by the same code and their description will be omitted.

As illustrated in FIG. 2, a copying machine as an electrophotographic apparatus including an image-quality stabilizer of this embodiment has the photoreceptor drum 1, and the charger 2 disposed around the photoreceptor drum 1. As illustrated in FIG. 1, the image-quality stabilizer includes the patch sensor 9, the timer 15, and the CPU 14.

The CPU 14 feedback-controls the output of the charger 2 at intervals of, for example, a predetermined number of copies produced or predetermined period according to the amount of toner on the photoreceptor drum 1 detected by the patch sensor 9, and one-way-controls the charger output according to the time that the copying machine is left unused, counted by the timer 15. These controlling operations correct changes in the copy density caused when the copying machine is used or left unused, and provide stable image quality.

The following description discusses the control of the charger output in detail.

Like embodiment 1, a dark toner patch is formed on the photoreceptor drum 1 every time a predetermined number of copies are produced or at predetermined time intervals. The amount of toner forming the dark toner patch is detected by the patch sensor 9. The CPU 14 feedback-controls the charger output according to the amount of toner detected by the patch sensor 9. This control allows the copy density which has been decreased when the copying machine was used to be corrected to the initial level.

The intervals of performing the feedback control, given for example, by the number of copies produced or time intervals, are determined so as to make the copy density which is lowered by a repeated use of the copying machine within a suitable range before the control.

Similar to embodiment 1, when the copying machine is left unused after a copying operation, the CPU 14 one-way-controls the charger output to have the correct value determined as shown in FIG. 6, according to the time that the copying machine is left unused, counted by the timer 15, just before starting the next copying operation. With this control, an excessively high copy density resulting from leaving the copying machine unused is corrected. Therefore, an appropriate copy density is obtained by the next copying operation.

Figure 33:
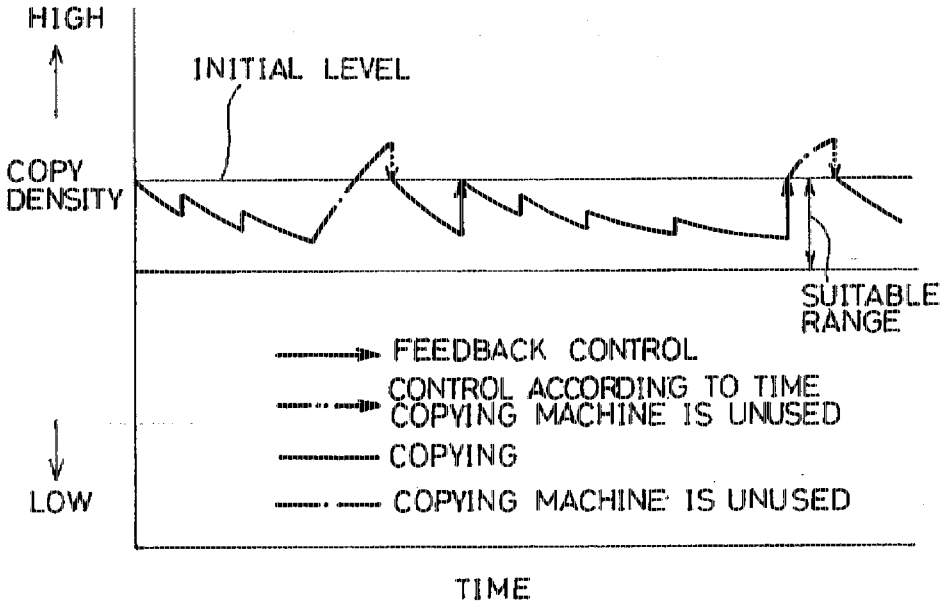
FIG. 33 is a graph showing changes in the copy density when the feedback control is performed at predetermined intervals and when the one-way control is performed according to the time that the copying machine of FIG. 2 is left inactive.

As described above, the image-quality stabilizer of this embodiment feedback-controls the charger output at intervals of predetermined number of copies or predetermined time intervals according to the amount of toner on the photoreceptor drum 1 detected by the patch sensor 9 so as to correct the copy density which is lowered by a repeated use of the copying machine only when needed. Also, the image-quality stabilizer one-way-controls the charger output according to the time that the copying machine is left unused so as to prevent an increase in the copy density from being caused when the copying machine is left unused. It is thus possible to appropriately correct changes in the copy density which are caused when the copying machine is used or left unused and to provide stable image quality without increasing the consumption of toner and impairing the responsiveness of the copying machine as illustrated in FIG. 33.

In addition, in the image-quality stabilizer of this embodiment, since the charger output is feedback-controlled at intervals of, for example, predetermined number of copies or predetermined time intervals, laborsaving control and less toner consumption are achieved in comparison with the feedback control executed by forming a toner patch during a rotation of the photoreceptor drum 1, performed every after a copying operation.

Embodiment 12

The following description discusses another embodiment of the present invention with reference to FIGS. 2, 8 and 10. The members having the same function as in the above-mentioned embodiment will be designated by the same code and their description will be omitted.

As illustrated in FIG. 2, a copying machine as an electrophotographic apparatus including an image-quality stabilizer of this embodiment has the photoreceptor drum 1, and the developing device 4 disposed around the photoreceptor drum 1. The image-quality stabilizer includes the patch sensor 9, the timer 15, and the CPU 14 as shown in FIG. 8.

The CPU 14 feedback-controls a development bias output of the developing device 4 at intervals of, for example, predetermined number of copies or predetermine time intervals according to the amount of toner on the photoreceptor drum 1 detected by the patch sensor 9, and one-way-controls the development bias output according to the time that the copying machine is left unused, counted by the timer 15. These controlling operations correct changes in the copy density caused when the copying machine is used or left unused, thereby achieving stable image quality.

The following description discusses the control of the development bias output in detail.

Like embodiment 1, a dark toner patch is formed on the photoreceptor drum 1 every time a predetermined number of copies are produced or at predetermined time intervals. The amount of toner forming the dark toner patch is detected by the patch sensor 9. The CPU 14 feedback-controls the development bias output at predetermined intervals according to the amount of toner detected by the patch sensor 9. This control allows the copy density which has been decreased when the copying machine was used to be corrected to the initial level.

Similar to embodiment 2, when the copying machine is left unused after a copying operation, the CPU 14 one-way-controls the development bias output to have the correct value determined as shown in FIG. 10 according to the time that the copying machine is left unused, counted by the timer 15, just before starting the next copying operation. With this control, an excessively high copy density resulting from leaving the copying machine unused is corrected. Therefore, an appropriate copy density is obtained by the next copying operation.

As described above, the image-quality stabilizer of this embodiment feedback-controls the development bias output at intervals of predetermined number of copies or predetermined time intervals according to the amount of toner on the photoreceptor drum 1 detected by the patch sensor 9, and one-way-controls the development bias output according to the time that the copying machine is left unused. It is thus possible to appropriately correct the changes in the copy density caused when the copying machine is used or left unused and to provide stable image quality without increasing the consumption of toner and impairing the responsiveness of the copying machine.

In addition, in the image-quality stabilizer of this embodiment, since the development bias output is feedback-controlled at intervals of, for example, predetermined number of copies or predetermined time intervals, laborsaving control and less toner consumption are achieved in comparison with the feedback control executed by forming a toner patch during a rotation of the photoreceptor drum 1, performed every after a copying operation.

Embodiment 13

The following description discusses another embodiment of the present invention with reference to FIGS. 2, 11 and 13. The members having the same function as in the above-mentioned embodiment will be designated by the same code and their description will be omitted.

As illustrated in FIG. 2, a copying machine as an electrophotographic apparatus including an image-quality stabilizer of this embodiment has the photoreceptor drum 1, and the discharge lamp 12 disposed around the photoreceptor drum 1. The image-quality stabilizer includes the patch sensor 9, the timer 15, and the CPU 14 as illustrated in FIG. 11.

The CPU 14 feedback-controls the amount of discharging light of the discharge lamp 12 at intervals of, for example, predetermined number of copies or predetermined time intervals according to the amount of toner on the photoreceptor drum 1 detected by the patch sensor 9, and one-way-controls the amount of discharging light according to the time that the copying machine is left unused, counted by the timer 15. These controlling operations correct changes in the copy density caused when the copying machine is used or left unused, thereby achieving stable image quality.

The following description discusses the control of the amount of discharging light in detail.

Like embodiment 1, a dark toner patch is formed on the photoreceptor drum 1 every time a predetermined number of copies are produced or at predetermined time intervals. The amount of toner forming the dark toner patch is detected by the patch sensor 9. The CPU 14 feedback-controls the amount of discharging light at predetermined intervals according to the amount of toner detected by the patch sensor 9. This control allows the copy density which is decreased when the copying machine is used to be corrected to the initial level.

Similar to embodiment 3, when the copying machine is left unused after a copying operation, the CPU 14 one-way-controls the amount of discharging light to have the correct value determined as shown in FIG. 13 according to the time that the copying machine is left unused, counted by the timer 15, just before starting the next copying operation. With this control, an excessively high copy density caused when the copying machine is left unused is corrected. Therefore, an appropriate copy density is obtained by the next copying operation.

As described above, the image-quality stabilizer of this embodiment feedback-controls the amount of discharging light at intervals of predetermined number of copies or predetermined time intervals according to the amount of toner on the photoreceptor drum 1 detected by the patch sensor 9, and one-way-controls the amount of discharging light according to the time that the copying machine is left unused. It is thus possible to appropriately correct the changes in the copy density caused when the copying machine is used or left unused and to provide stable image quality without increasing the consumption of toner and impairing the responsiveness of the copying machine.

In addition, in the image-quality stabilizer of this embodiment, since the amount of discharging light is feedback-controlled at intervals of, for example, predetermined number of copies or predetermined time intervals, laborsaving control and less toner consumption are achieved in comparison with the feedback control executed by forming a toner patch during a rotation of the photoreceptor drum 1, performed every after a copying operation.

Embodiment 14

The following description discusses another embodiment of the present invention with reference to FIGS. 2, 14, 18 and 34. The members having the same function as in the above-mentioned embodiment will be designated by the same code and their description will be omitted.

As illustrated in FIGS. 2 and 14, a copying machine as an electrophotographic apparatus including an image-quality stabilizer of this embodiment has the photoreceptor drum 1, and the copy lamp 19 for scanning the image of a document from the B direction. The image-quality stabilizer includes the patch sensor 9, the timer 15, and the CPU 14.

The CPU 14 feedback-controls the exposure level by controlling the amount of light from the copy lamp 19 at intervals of, for example, predetermined number of copies or predetermined time intervals according to the amount of toner on the photoreceptor drum 1 detected by the patch sensor 9, and one-way-controls the exposure level according to the time that the copying machine is left unused, counted by the timer 15. These controlling operations correct changes in the copy brightness caused when the copying machine is used or left unused, thereby achieving stable image quality.

The following description discusses the control of the exposure level in detail.

Like embodiment 4, a light toner patch is formed on the photoreceptor drum 1 every time a predetermined number of copies are produced or at predetermined time intervals. The amount of toner forming the light toner patch is detected by the patch sensor 9. The CPU 14 feedback-controls the exposure level at predetermined intervals according to amount of toner detected by the patch sensor 9. This control allows the copy brightness which has been changed when the copying machine was used to be corrected to the initial level.

Similar to embodiment 4, when the copying machine is left unused after a copying operation, the CPU 14 one-way-controls the exposure level to have the correct value determined as shown in FIG. 18 according to the time that the copying machine is left unused, counted by the timer 15, just before starting the next copying operation. With this control, an excessively high copy brightness resulting from leaving the copying machine unused is corrected. Therefore, an appropriate copy brightness is obtained by the next copying operation.

Figure 34:
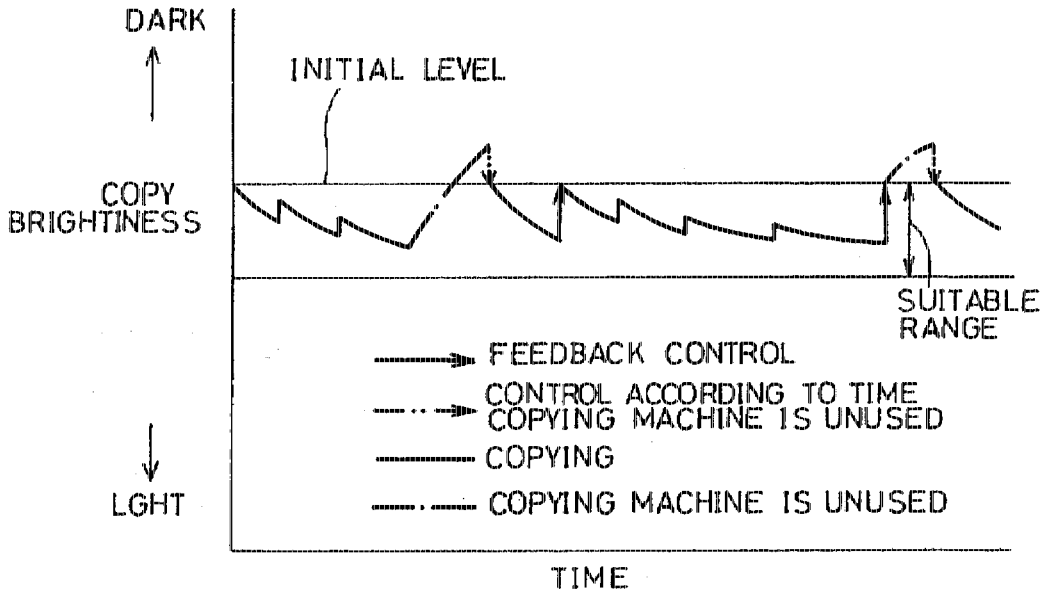
FIG. 34 is a graph showing changes in the copy brightness when the feedback control is performed at predetermined intervals and when the one-way control is performed according to the time that the copying machine of FIG. 2 is left inactive.
Figure 35:
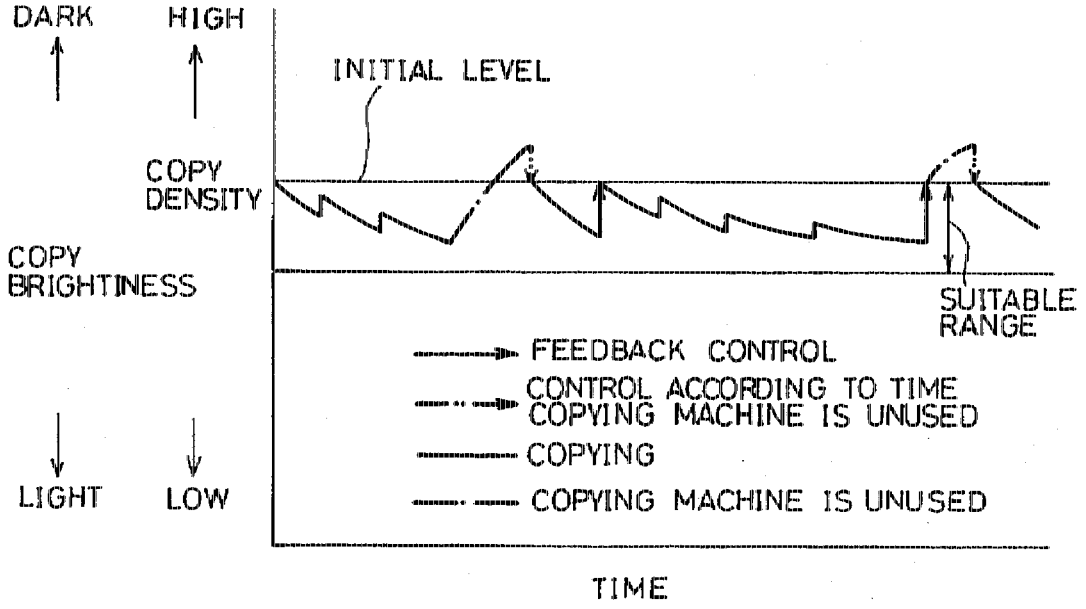
FIG. 35 is a graph showing changes in the copy density and copy brightness when the feedback control is performed at predetermined intervals and when the one-way control is performed according to the time that the copying machine of FIG. 2 is left inactive.

As described above, the image-quality stabilizer of this embodiment feedback-controls the exposure level at intervals of predetermined number of copies or predetermined time intervals according to the amount of toner on the photoreceptor drum 1 detected by the patch sensor 9, and one-way-controls the exposure level according to the time that the copying machine is left unused. It is thus possible to appropriately correct changes in the copy brightness caused when the copying machine is used or left unused and to provide stable image quality as shown in FIG. 34 without increasing the consumption of toner and impairing the responsiveness of the copying machine.

In addition, in the image-quality stabilizer of this embodiment, since the exposure level is feedback-controlled at intervals of, for example, predetermined number of copies or predetermined time intervals, laborsaving control and less toner consumption are achieved in comparison with the feedback control executed by forming a toner patch during a rotation of the photoreceptor drum 1, performed every after a copying operation.

Embodiment 15

The following description discusses another embodiment of the present invention with reference to FIGS. 2, 18, 20, 24 and 35. The members having the same function as in the above-mentioned embodiment will be designated by the same code and their description will be omitted.

As illustrated in FIGS. 2 and 20, a copying machine as an electrophotographic apparatus including an image-quality stabilizer of this embodiment has the photoreceptor drum 1, the charger 2, the development device 4 and the discharge lamp 12, disposed around the photoreceptor drum 1, and the copy lamp 19 for scanning the image on a document from the B direction. The image-quality stabilizer includes the patch sensor 9, the timer 15, and the CPU 14.

The CPU 14 feedback-controls at least one of the output of the charger 2, the development bias output of the developing device 4, and the amount of discharging light of the discharge lamp 12 as well as the exposure level (the light amount of the copy lamp 19) at intervals of predetermined number of copies or predetermined time intervals according to the amount of toner on the photoreceptor drum 1 detected by the patch sensor 9. The CPU 14 also one-way-controls at least one of the charger output, the development bias output and the amount of discharging light as well as the exposure level according to the time that the copying machine left unused, counted by the timer 15. With these controlling operations, the changes in the copy density and brightness caused when the copying machine is used or left unused are corrected, and stable image quality is obtained.

The following description discusses the control of each of the image forming devices.

Like embodiments 1 to 4, a dark toner patch and a light toner patch are formed on the photoreceptor drum 1 at intervals of predetermined number of copies or predetermined time intervals. The amount of toner forming the dark toner patch and of the light toner patch are detected by the patch sensor 9. The CPU 14 feedback-controls at least one of the charger output, the development bias output, and the amount of discharging light as well as the exposure level according to the toner amounts detected. With this control, the copy density and the copy brightness which have been changed when the copying machine was used are corrected.

Like embodiment 5, before starting the next operation the CPU 14 one-way-controls at least one of the charger output, the development bias output, and the amount of discharging light to have a correct value determined as shown in FIG. 24, and the exposure level to have a correct value shown in FIG. 18 according to the time that the copying machine is left unused, counted by the timer 15. With this control, the copy density and the copy brightness which have become excessively high when the copying machine was left unused are further adjusted. Therefore, a copy produced by the next copying operation has appropriate copy density and brightness.

As described above, in the image-quality stabilizer of this embodiment, at least one of the charger output, the development bias output, and the amount of discharging light as well as the exposure level are feedback-controlled at intervals of predetermined number of copies or predetermined time intervals. Also, at least one of the charger output, the development bias output and the amount of discharging light as well as the exposure level are one-way-controlled according to the time that the copying machine is left unused. It is thus possible to appropriately correct the changes in the copy density and the copy brightness caused when the copying machine is used or left unused and to provide stable image quality without increasing the consumption of toner and impairing the responsiveness of the copying machine.

Additionally, since the feedback-control is performed at intervals of predetermined number of copies or predetermined time intervals, the frequency to perform the feedback control is reduced in comparison with the feedback control executed by forming a toner patch during a rotation of the photoreceptor drum 1, performed every after a copying operation. Thus, laborsaving control and less toner consumption are achieved.

Like the above-mentioned embodiments, stable image quality is also obtained by performing a combination of the control of the charger output, the development bias output, the amount of discharging light and the exposure level according to the time that the copying machine is left unused, using the function representing the surface-potential recovering ability of the photoreceptor drum 1 (see FIG. 26) as described in embodiments 6 to 10 and the feedback control of the charger output, the development bias output, the amount of discharging light and the exposure level to be performed at intervals of predetermined number of copies or predetermined time intervals according to the amount of toner on the photoreceptor drum 1 as described in embodiments 11 to 15.

It is also possible incorporate into the image-quality stabilizer two timers, one counting time that the photoreceptor drum is active and the other counting time that the photoreceptor drum is inactive. With this structure, the control corresponding to the fatigue characteristic of the photoreceptor drum 1 shown in FIG. 26 is performed by a CPU as image-quality adjusting means according to the time that the photoreceptor drum 1 is active, counted by one of the timers, while the control corresponding to the surface-potential recovering ability is performed according to the time that the photoreceptor drum 1 is inactive, counted by the other timer. Furthermore, the feedback control is executed at intervals of predetermined number of copies or predetermined time intervals according to the amount of toner on the photoreceptor drum 1.

With this structure, like the above-mentioned embodiments, it is possible to correct the changes in the image quality caused when the copying machine is used or left unused. More specifically, the fatigue of the photoreceptor drum 1 caused in a relatively short time is one-way-controlled according to the time that the photoreceptor drum 1 is active. And, a change in the image quality that is hard to predict and caused over a relatively long time is feedback-controlled according to the amount of toner on the photoreceptor drum 1 at predetermined intervals regardless of if a copying operation, or a rotation of the photoreceptor drum after/before a copying operation is in progress. By executing a combination of the one-way control to be performed according to the time that the photoreceptor drum 1 is active or inactive and the feedback control to be performed at predetermined intervals according to the amount of toner on the photoreceptor drum 1, the image quality is more appropriately corrected while lowering the frequency to perform the feedback control which consumes a large amount toner, time and labor.

In this case, like the above-mentioned embodiments, the charger output, the development bias output, the amount of discharging light and the exposure level, or a combination thereof are controlled.

Embodiment 16

Figure 36:
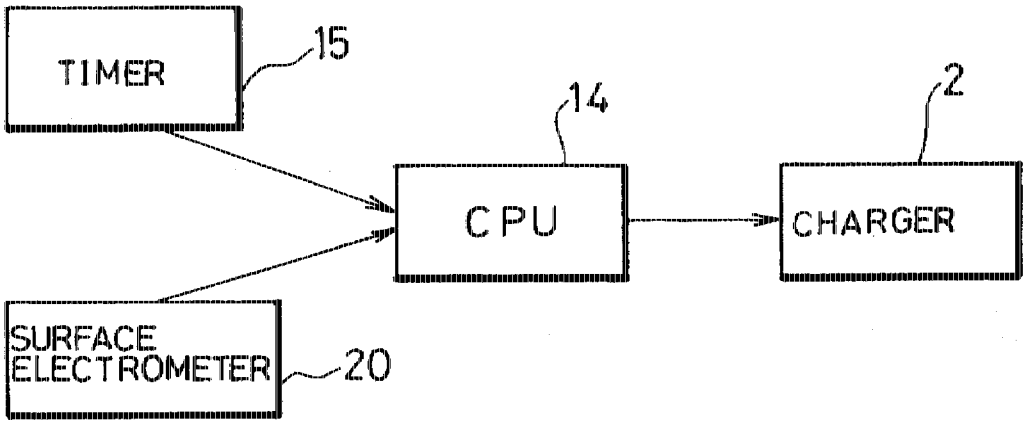
FIG. 36 is a block diagram illustrating a structure of a control system in a copying machine having an image-quality stabilizer according to still another embodiment of the present invention.

The following description discusses another embodiment of the present invention with reference to FIGS. 2, 6 and 36. The members having the same function as in the above-mentioned embodiment will be designated by the same code and their description will be omitted.

As illustrated in FIG. 2, a copying machine as an electrophotographic apparatus including an image-quality stabilizer of this embodiment has the photoreceptor drum 1, and the charger 2 disposed around the photoreceptor drum 1. This image-quality stabilizer includes a surface electrometer (surface charge detecting means) 20, located between the separation device 8 and the pre-cleaning charger 10 disposed around the photoreceptor drum 1. However, it is not necessary to dispose the surface electrometer 20 at this location, and it may be located other location between the charger 2 and the pre-cleaning charger 10.

As illustrated in FIG. 36, the image-quality stabilizer also includes the timer 15, and the CPU 14 in addition to the, surface electrometer 20. The CPU 14 feedback-controls the output of the charger 2 during a rotation of the photoreceptor drum 1 after a copying operation according to the amount of charges on the photoreceptor drum 1 detected by the surface electrometer 20, and one-way-controls the charger output according to the time that the copying machine is left unused after the feedback control, counted by the timer 15. With these controlling operations, the changes in the copy density caused when the copying machine is used or left unused are corrected, providing stable image quality.

The following description discusses the control of the charger output.

A latent dark patch is formed on the photoreceptor drum 1 by charging the photoreceptor drum 1 with a predetermined charger output during a rotation of the photoreceptor drum 1 after a copying operation. The amount of charges forming the latent dark patch is detected by the surface electrometer 20. The CPU 14 feedback-controls the charger output so that the value detected by the surface electrometer 20 becomes equal to a predetermined reference value of the charger output. With this control, a decreased copy density resulting from a repeated use of the copying machine is brought back to the initial level.

The reference value is set before the copying machine is used, i.e., when the copying machine is assembled in a factory or when the copying machine is installed, and stored in the memory device, not shown, connected to the CPU 14.

Like embodiment 1, when the copying machine is left unused, the CPU 14 one-way-controls the charger output to have a predetermined correct value shown in FIG. 6 according to the time that the copying machine is left unused, counted by the timer 15, before starting the next copying operation.

With this control, an excessively high copy density caused when the copying machine is left unused is further adjusted. Therefore, a copy produced by the next copying operation has an appropriate copy density.

With a combination of the feedback-control of the charger output performed during a rotation of the photoreceptor drum 1 according to the amount of charges on the photoreceptor drum 1 and the one-way-control performed during a rotation of the photoreceptor drum 1 before the next copying operation according to the time that the copying machine is left unused, it is possible to appropriately correct the changes in the copy density and to provide stable image quality without increasing the consumption of toner and impairing the responsiveness of the copying machine.

Embodiment 17

Figure 37:
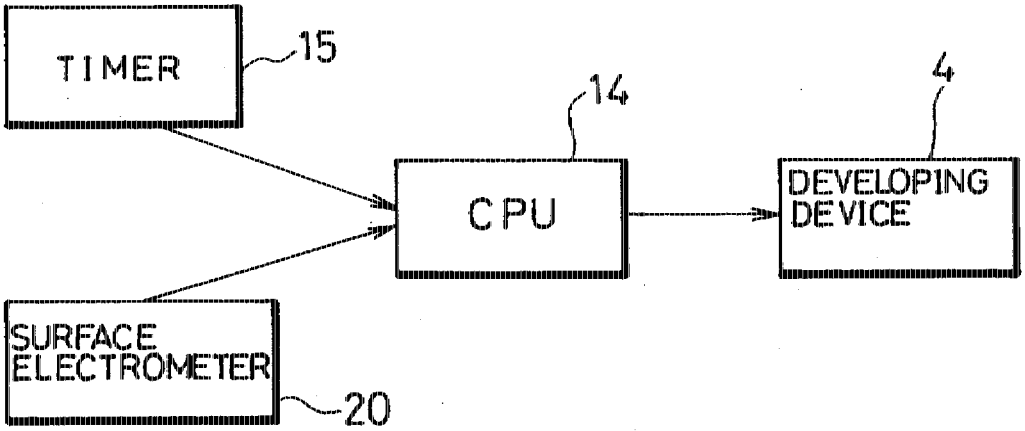
FIG. 37 is a block diagram illustrating a structure of a control system in a copying machine having an image-quality stabilizer according to another embodiment of the present invention.

The following description discusses another embodiment of the present invention with reference to FIGS. 2, 10 and 37. The members having the same function as in the above-mentioned embodiment will be designated by the same code and their description will be omitted.

As illustrated in FIG. 2, a copying machine as an electrophotographic apparatus including an image-quality stabilizer of this embodiment has the photoreceptor drum 1, and the developing device 4 disposed around the photoreceptor drum 1. As illustrated in FIG. 37, this image-quality stabilizer includes the surface electrometer 20, the timer 15, and the CPU 14. The CPU 14 feedback-controls the development bias output of the developing device 4 during a rotation of the photoreceptor drum 1 after a copying operation according to the amount of charges on the photoreceptor drum 1 detected by the surface electrometer 20, and one-way-controls the development bias output according to the time that the copying machine is left unused after the feedback control, counted by the timer 15. With these controlling operations, the changes in the copy density caused when the copying machine is used or left unused are corrected, providing stable image quality.

The following description discusses the control of the development bias output.

Like embodiment 16, a latent dark patch is formed on the photoreceptor drum 1 during a rotation of the photoreceptor drum 1 after a copying operation. The amount of charges forming the latent dark patch is detected by the surface electrometer 20. The CPU 14 feedback-controls the development bias output so that the value detected by the surface electrometer 20 becomes equal to a predetermined reference value.

The development potential determining the copy density is given by the equation $$\text{development potential} = \text{surface potential} - \text{development bias}$$

Therefore, a change in the surface potential is detectable from the amount of charges on the surface of the photoreceptor drum 1 detected by the surface electrometer 20. The CPU 14 controls the development bias output according to the detected change so as to keep the development potential to have a predetermined value. Thus, with this control, a decreased copy density resulting from a repeated use of the copying machine is brought back to the initial level.

When an instruction to start the next copying operation is given, the CPU 14 one-way-controls the development bias output to have a correct value, which is determined in advance as shown in FIG. 6 like embodiment 2 according to the time that the copying machine is left unused, counted by the timer 15. With this control, an excessively high copy density caused when the copying machine is left unused is further adjusted so that a copy produced by the next copying operation has an appropriate copy density.

With a combination of the feedback-control of the development bias output executed according to the amount of charges on the photoreceptor drum 1 during a rotation of the photoreceptor drum 1 performed after a copying operation and the one-way-control executed before the next copying operation according to the time that the copying machine is left unused, it is possible to appropriately correct the changes in the copy density and to provide stable image quality without increasing the consumption of toner and impairing the responsiveness of the copying machine.

Embodiment 18

Figure 38:
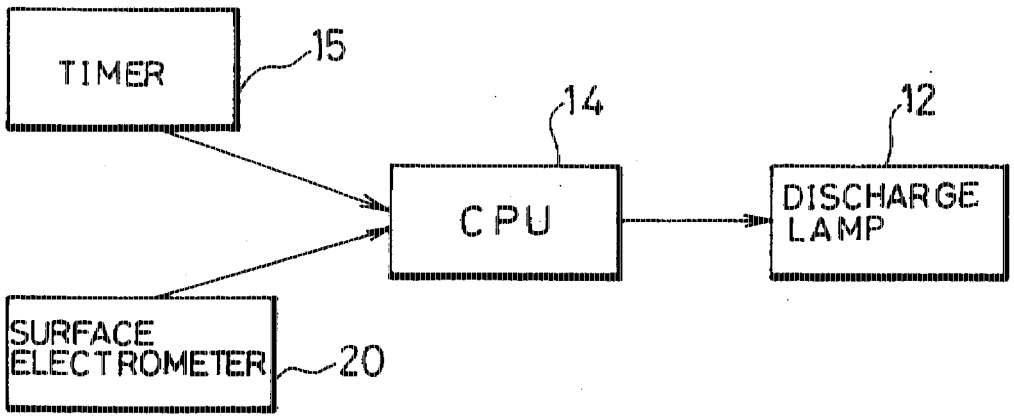
FIG. 38 is a block diagram illustrating a structure of a control system in a copying machine having an image-quality stabilizer according to yet another embodiment of the present invention.

The following description discusses another embodiment of the present invention with reference to FIGS. 2, 13 and 38. The members having the same function as in the above-mentioned embodiment will be designated by the same code and their description will be omitted.

As illustrated in FIG. 2, a copying machine as an electrophotographic apparatus including an image-quality stabilizer of this embodiment has the photoreceptor drum 1, and the discharge lamp 12 disposed around the photoreceptor drum 1. As illustrated in FIG. 38, this image-quality stabilizer includes the surface electrometer 20, the timer 15, and the CPU 14. The CPU 14 feedback-controls the amount of discharging light of the discharge lamp 12 during a rotation of the photoreceptor drum 1 after a copying operation according to the amount of charges on the photoreceptor drum 1 detected by the surface electrometer 20, and one-way-controls the amount of discharging light according to the time that the copying machine is left unused, counted by the timer 15. With these controlling operations, the changes in the copy density caused when the copying machine is used or left unused are corrected, thereby providing stable image quality.

The following description discusses the control of the amount of discharging light.

Like embodiment 16, a latent dark patch is formed on the photoreceptor drum 1 during a rotation of the photoreceptor drum 1 after a copying operation. The amount of charges forming the latent dark patch is detected by the surface electrometer 20. The CPU 14 feedback-controls the amount of discharging light so that the value detected by the surface electrometer 20 becomes equal to a predetermined reference value. With this control, a decreased copy density resulting from a repeated use of the copying machine is brought back to the initial level.

When an instruction to start the next copying operation is given, the CPU 14 one-way-controls the amount of discharging light to have a correct value, which is determined in advance as shown in FIG. 13 like embodiment 3, according to the time that the copying machine is unused, counted by the timer 15. With this control, an excessively high copy density caused when the copying machine is left unused is further adjusted so that a copy produced by the next copying operation has an appropriate copy density.

With a combination of the feedback-control of the amount of discharging light to be executed during a rotation of the photoreceptor drum 1 performed after a copying operation according to the amount of charges on the photoreceptor drum 1 and the one-way-control to be executed before starting the next copying operation according to the time that the copying machine is left unused, it is possible to appropriately correct the changes in the copy density and to provide stable image quality without increasing the consumption of toner and impairing the responsiveness of the copying machine.

Embodiment 19

Figure 39:
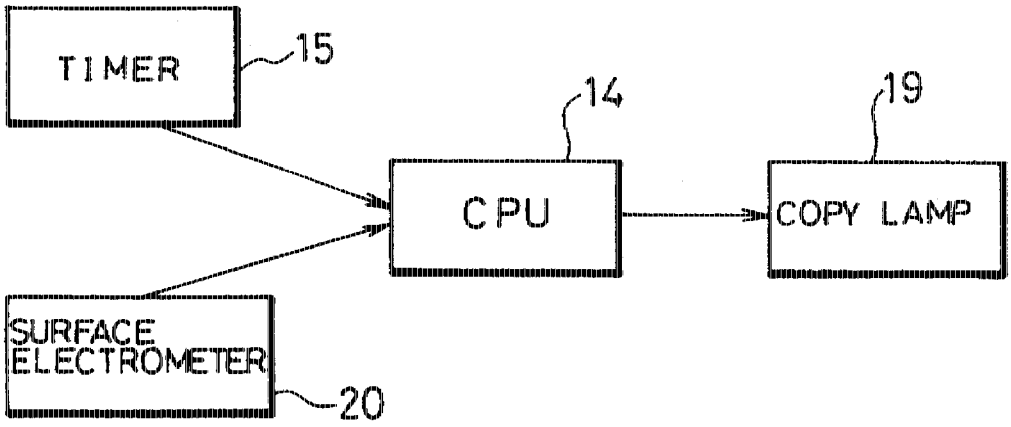
FIG. 39 is a block diagram illustrating a structure of a control system in a copying machine having an image-quality stabilizer according to still another embodiment of the present invention.

The following description discusses still another embodiment of the present invention with reference to FIGS. 2, 18 and 39. The members having the same function as in the above-mentioned embodiment will be designated by the same code and their description will be omitted.

As illustrated in FIG. 2, a copying machine as an electrophotographic apparatus including an image-quality stabilizer of this embodiment has the photoreceptor drum 1, and the copy lamp 19 for scanning the image of a document from the B direction. As illustrated in FIG. 38, this image-quality stabilizer includes the surface electrometer 20, the timer 15, and the CPU 14. The CPU 14 feedback-controls the exposure level by controlling the light amount of the copy lamp 19 during a rotation of the photoreceptor drum 1 after a copying operation according to the amount of charges on the photoreceptor drum 1 detected by the surface electrometer 20, and one-way-controls the exposure level according to the time that the copying machine is left unused after the feedback control, counted by the timer 15. With these controlling operations, the changes in the copy brightness caused when the copying machine is used or left unused are corrected, thereby providing stable image quality.

The following description discusses the control of the exposure level.

The photoreceptor drum 1 is charged with a predetermined charger output, and a predetermined amount of light from the copy lamp 19 is applied to a reference plate of a predetermined brightness included in the exposure optical system during a rotation of the photoreceptor drum 1 after a copying operation. Reflected light from the reference plate is applied to the photoreceptor drum 1 so as to form a latent light patch. The amount of charges forming the latent light patch is detected by the surface electrometer 20. The CPU 14 feedback-controls the exposure level so that the value detected by the surface electrometer 20 becomes equal to a predetermined reference value. With this control, a decreased copy brightness due to a reduced amount of toner on the photoreceptor drum 1 resulting from a repeated use of the copying machine is brought back to the initial level.

The reference value is set before the copying machine is used, i.e., when the copying machine is assembled in a factory or when the copying machine is installed, and stored in the memory device, not shown, connected to the CPU 14.

Like embodiment 4, when an instruction to start the next copying operation is given, the CPU 14 one-way-controls the exposure level to have a correct value, which is determined in advance as shown in FIG. 18, according to the time that the copying machine is unused, counted by the timer 15. With this control, an excessively high copy brightness caused when the copying machine is left unused is further adjusted so that a copy produced by the next copying operation has an appropriate copy brightness. In other words, it is possible to prevent a fogged image.

With a combination of the feedback-control of the exposure level to be executed during a rotation of the photoreceptor drum 1 performed after a copying operation according to the amount of charges on the photoreceptor drum 1 and the one-way-control to be executed during a rotation of the photoreceptor drum 1 before the next copying operation according to the time that the copying machine is left unused, it is possible to appropriately correct the changes in the copy brightness and to provide stable image quality without increasing the consumption of toner and impairing the responsiveness of the copying machine.

Embodiment 20

The following description discusses another embodiment of the present invention with reference to FIGS. 2, 18, 24, and 40. The members having the same function as in the above-mentioned embodiment will be designated by the same code and their description will be omitted.

Figure 40:
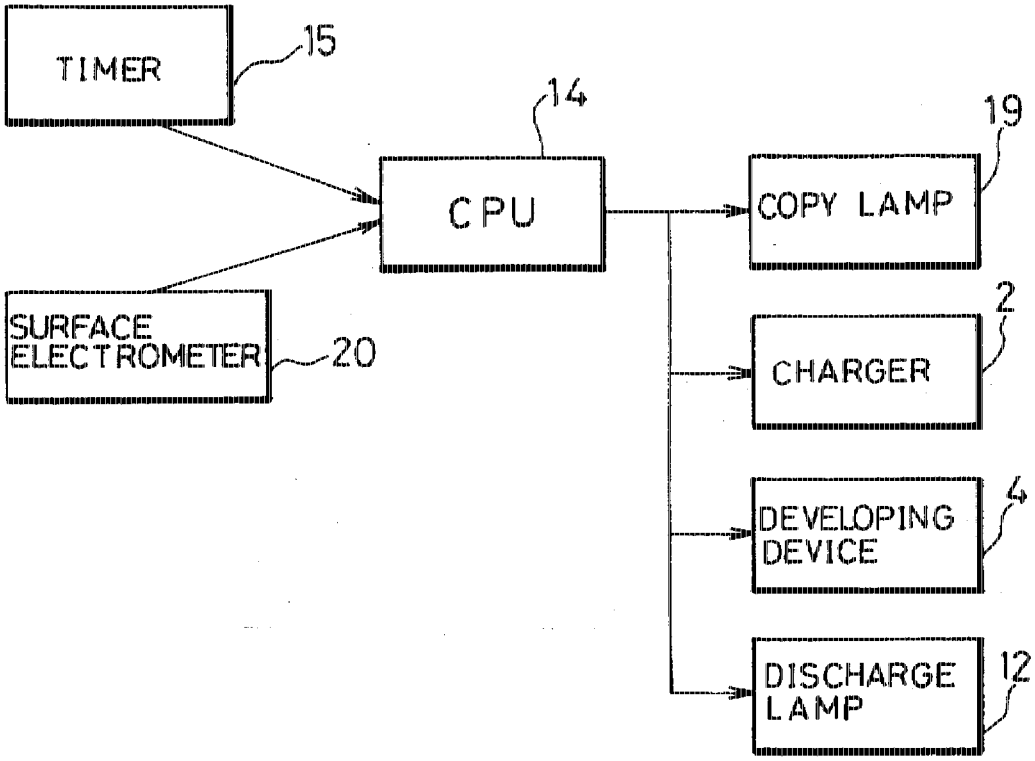
FIG. 40 is a block diagram illustrating a structure of a control system in a copying machine having an image-quality stabilizer according to another embodiment of the present invention.

As illustrated in FIGS. 2 and 40, a copying machine as an electrophotographic apparatus including an image-quality stabilizer of this embodiment has the photoreceptor drum 1, the charger 2, the developing device 4 and the discharge lamp 12, disposed around the photoreceptor drum 1, and the copy lamp 19 for scanning the image on a document from the B direction. The image-quality stabilizer includes the surface electrometer 20, the timer 15, and the CPU 14.

The CPU 14 feedback-controls at least one of the output of the charger 2, the development bias output of the developing device 4, and the amount of discharging light of the discharge lamp 12 as well as the exposure level (the light amount of the copy lamp 19) according to the amount of charges on the photoreceptor drum 1 detected by the surface electrometer 20. The CPU 14 also one-way-controls at least one of the charger output, the development bias output and the amount of discharging light as well as the exposure level according to the time that the copying machine left unused after the feedback control, counted by the timer 15 like in embodiment 5. With these controlling operations, the changes in the copy density and the copy brightness caused when the copying machine is used or left unused are adjusted, and stable image quality is obtained.

The following description discusses the control of each of the image forming devices.

Like embodiment 16, a latent dark patch is formed on the photoreceptor drum 1 during a rotation of the photoreceptor drum 1 after a copying operation. The amount of charges forming the latent dark patch is detected by the surface electrometer 20. The CPU 14 feedback-controls at least one of the charger output, the development bias output, and the a mount of discharging light so as to cause the value detected by the surface electrometer 20 to become equal to a predetermined reference value. With this control, a decreased copy density resulting from a repeated use of the copying machine is corrected.

Like embodiment 19, a latent light patch is formed on the photoreceptor drum 1 during a rotation of the photoreceptor drum 1 after a copying operation. The amount of charges forming the latent light patch is detected by the surface electrometer 20. The CPU 14 feedback-controls the exposure level so that the value detected by the surface electrometer 20 becomes equal to a predetermined reference value. With this control, the copy brightness which has been changed by a repeated use of the copying machine is corrected.

Like embodiment 5, when an instruction to start the next copying operation is given, the CPU 14 one-way-controls at least one of the charger output, the development bias output, and the amount of discharging light to have a correct value determined according to the time that the copying machine is left unused as shown in FIG. 24. Additionally, as shown in FIG. 18, the CPU 14 one-way-controls the exposure level to become equal to a correct value which is determined according to the time that the copying machine is left unused. As a result, the copy density and the copy brightness which have been increased excessively when the copying machine was left unused are further adjusted. Therefore, a copy produced by the next copying operation has appropriate copy density and brightness.

As described above, with a combination of the feedback-control to be executed during a rotation of the photoreceptor drum 1 performed after a copying operation according to the amount of charges on the photoreceptor drum 1 and the one-way-control to be executed before the next copying operation according to the time that the copying machine is left unused, it is possible to provide stable image quality without increasing the consumption of toner and impairing the responsiveness of the copying machine. Furthermore, since the dark portion corresponding to the high-dense portion of the image is adjusted by controlling the charger output, the development bias output or the amount of discharging light and the bright portion corresponding to the low-dense portion of the image is adjusted by controlling the exposure level, stable image quality is obtained in terms of copy density and brightness.

Embodiment 21

The following description discusses another embodiment of the present invention with reference to FIGS. 2, 26, 27 and 36. The members having the same function as in the above-mentioned embodiment will be designated by the same code and their description will be omitted.

As illustrated in FIG. 2, a copying machine as an electrophotographic apparatus including an image-quality stabilizer of this embodiment has the photoreceptor drum 1, the charger 2 disposed around the photoreceptor drum 1. As illustrated in FIG. 36, the image-quality stabilizer includes the surface electrometer 20, the timer 15, and the CPU 14. The CPU 14 is connected to the memory device, not shown, storing the function representing the surface-potential recovering ability of the photoreceptor drum 1 described in embodiment 6 (see FIG. 26).

The CPU 14 feedback-controls the output of the charger 2 according to the amount of charges on the photoreceptor drum 1 detected by the surface electrometer 20 like embodiment 16. In addition, the CPU 14 one-way-controls the charger output according to the time that the copying machine is left unused, counted by the timer 15, using the function. With these controlling operations, the changes in the copy density caused when the copying machine is used or left unused are corrected, thereby providing stable image quality.

The following description discusses the control of the charger output.

Like the copying machine of embodiment 16, in the copying machine of this embodiment, a latent dark patch is formed on the photoreceptor drum 1 during a rotation of the photoreceptor drum 1 after a copying operation. The amount of charges on the surface of the photoreceptor drum 1 forming the latent dark patch is detected by the surface electrometer 20. The CPU 14 feedback-controls the charger output according to the amount of charges detected by the surface electrometer 20. With this control, a decreased copy density resulting from a repeated use of the copying machine is brought back to the initial level.

After the feedback control, the recovery of the surface potential of the photoreceptor drum 1 is calculated from the time that the copying machine is left unused using the function. To adjust the recovery of the surface potential before starting the next copying operation, the CPU 14 one-way-controls the charger output according to the relationship between the charger output and the surface potential shown in FIG. 27. With this control, an excessively high copy density caused when the copying machine is left unused is corrected. Therefore, a copy produced by the next copying operation has an appropriate density.

As described above, the image-quality stabilizer of this embodiment one-way-controls the charger output according to the surface-potential recovering ability, and feedback-controls the charger output according to the amount of charges on the photoreceptor drum 1. It is therefore possible to always have the copy density within a suitable range without impairing the responsiveness of the copying machine and increasing the consumption of toner. Additionally, the image-quality stabilizer one-way-controls the charger output using the approximate function representing the surface-potential recovering ability of the photoreceptor drum 1. The image-quality stabilizer of this embodiment thus enables a more appropriate correction of the image quality in comparison with the control using the-predetermined correct value.

Embodiment 22

The following description discusses another embodiment of the present invention with reference to FIGS. 2, 26, 28 and 41. The members having the same function as in the above-mentioned embodiment will be designated by the same code and their description will be omitted.

Figure 41:
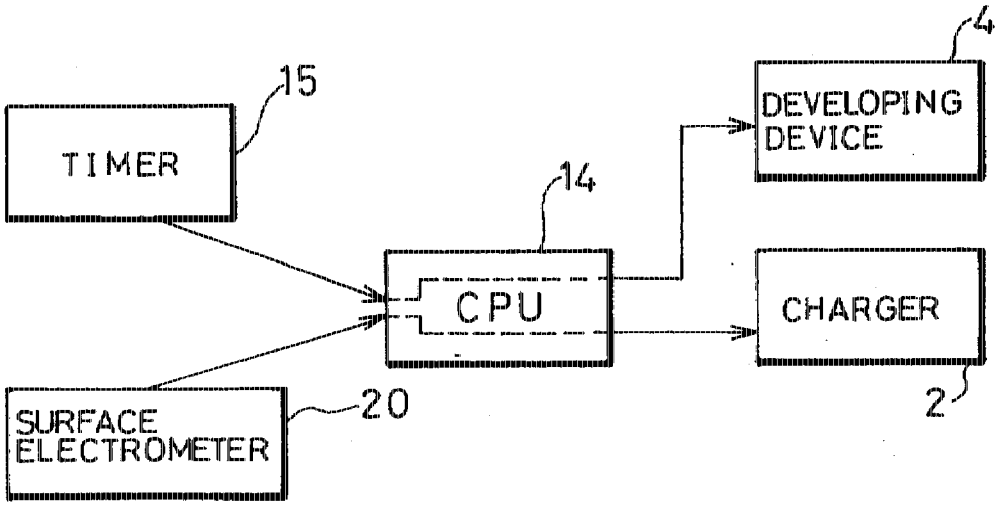
FIG. 41 is a block diagram illustrating a structure of a control system in a copying machine having an image-quality stabilizer according to still another embodiment of the present invention.

As illustrated in FIG. 2, a copying machine as an electrophotographic apparatus including an image-quality stabilizer of this embodiment has the photoreceptor drum 1, the charger 2 and the developing device 4, disposed around the photoreceptor drum 1. As illustrated in FIG. 41, the image-quality stabilizer includes the surface electrometer 20, the timer 15, and the CPU 14. The CPU 14 is connected to the memory device, not shown, storing the function representing the surface-potential recovering ability of the photoreceptor drum 1 described in embodiment 6 (see FIG. 26).

The CPU 14 feedback-controls the output of the charger 2 according to the amount of charges on the photoreceptor drum 1 detected by the surface electrometer 20. In addition, the CPU 14 one-way-controls the development bias output of the developing device 4 according to the time that the copying machine is left unused, counted by the timer 15, using the function. With these controlling operations, the changes in the copy density caused when the copying machine is used or left unused are corrected, thereby providing stable image quality.

The following description discusses the control of the developing bias output and of the charger output.

Like the copying machine of embodiment 16, in the copying machine of this embodiment, a latent dark patch is formed on the photoreceptor drum 1 during a rotation of the photoreceptor drum 1 after a copying operation. The amount of charges on the surface of the photoreceptor drum 1 forming the latent dark patch is detected by the surface electrometer 20. The CPU 14 feedback-controls the charger output according to the amount of charges detected by the surface electrometer 20. With this control, a decreased copy density resulting from a repeated use of the copying machine is brought back to the initial level.

After the feedback control, the recovery of the surface potential of the photoreceptor drum 1 is calculated from the time that the copying machine is left unused using the function. To adjust the recovery of the surface potential before starting the next copying operation, the CPU 14 one-way-controls the development bias output according to the relationship between the development bias output and the development potential shown in FIG. 28. With this control, an excessively high copy density caused when the copying machine is left unused is corrected. Therefore, a copy produced by the next copying operation has an appropriate density.

As described above, the image-quality stabilizer of this embodiment one-way-controls the development bias output using the approximate function representing the surface-potential recovering ability, and feedback-controls the charger output according to the amount of charges on the photoreceptor drum 1. It is therefore possible to always have the copy density within a suitable range without impairing the responsiveness of the copying machine and increasing the consumption of toner. Additionally, the image-quality stabilizer one-way-controls the development bias output using the approximate function representing the surface-potential recovering ability of the photoreceptor drum 1. Thus the image-quality stabilizer of this embodiment enables a more appropriate correction of the image quality in comparison with the control using the predetermined correct value.

Embodiment 23

The following description discusses another embodiment of the present invention with reference to FIGS. 2, 26, 30 and 42. The members having the same function as in the above-mentioned embodiment will be designated by the same code and their description will be omitted.

Figure 42:
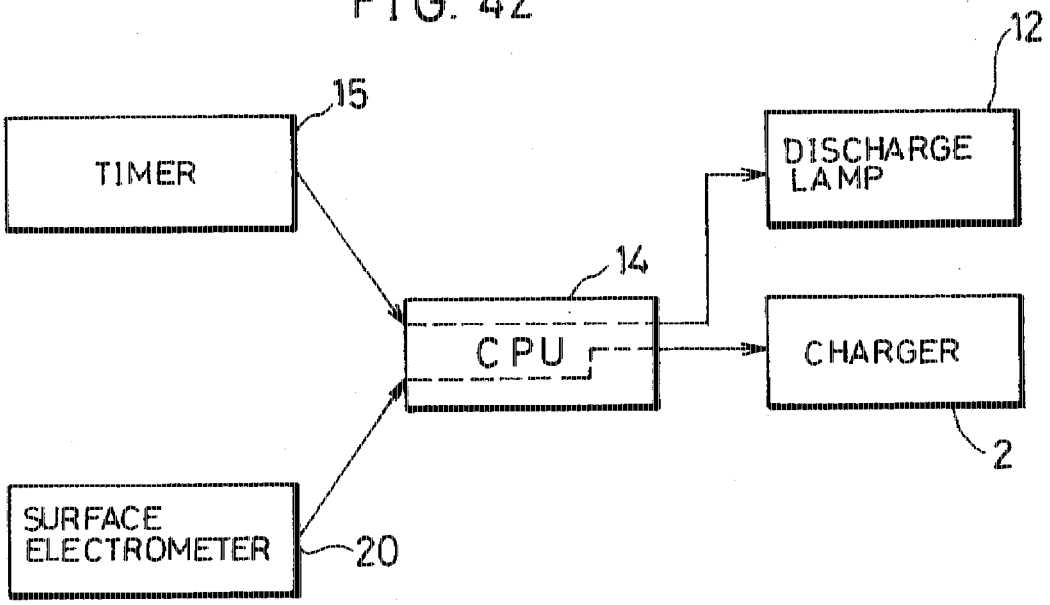
FIG. 42 is a block diagram illustrating a structure of a control system in a copying machine having an image-quality stabilizer according to yet another embodiment of the present invention.

As illustrated in FIG. 2, a copying machine as an electrophotographic apparatus including an image-quality stabilizer of this embodiment has the photoreceptor drum 1, the charger 2 and the discharge lamp 12, disposed around the photoreceptor drum 1. As illustrated in FIG. 42, the image-quality stabilizer includes the surface electrometer 20, the timer 15, and the CPU 14. The CPU 14 is connected to the memory device, not shown, storing the function representing the surface-potential recovering ability of the photoreceptor drum 1 described in embodiment 6 (see FIG. 26).

The CPU 14 feedback-controls the output of the charger 2 according to the amount of charges on the photoreceptor drum 1 detected by the surface electrometer 20. In addition, the CPU 14 one-way-controls the amount of discharging light of the discharge lamp 12 according to the time that the copying machine is left unused, counted by the timer 15, using the function. These controlling operations prevent the copy density from being changed when the copying machine is used or left unused, thereby achieving stable image quality.

The following description discusses the control of the amount of discharging light and of the charger output.

Like the copying machine of embodiment 16, a latent dark patch is formed on the photoreceptor drum 1 during a rotation of the photoreceptor drum 1 after a copying operation. The amount of charges forming the latent dark patch on the surface of the photoreceptor drum 1 is detected by the surface electrometer 20. The CPU 14 feedback-controls the charger output according to the amount of charges detected by the surface electrometer 20. With this control, the copy density which have been decreased by a repeated use of the copying machine is brought back to the initial level.

After the feedback control, the recovery of the surface potential of the photoreceptor drum 1 is calculated from the time that the copying machine is left unused, counted by the timer 15, using the function. To adjust the recovery of the surface potential before starting the next copying operation, the CPU 14 one-way-controls the amount of discharging light according to the relationship between the amount of discharging light and the surface potential described in embodiment 8 (see FIG. 30). With this control, an excessively high copy density caused when the copying machine is left unused is corrected. Therefore, a copy produced by the next copying operation has an appropriate density.

As described above, the image-quality stabilizer of this embodiment one-way-controls the amount of discharging light using the approximate function representing the surface-potential recovering ability, and feedback-controls the charger output according to the amount of charges on the photoreceptor drum 1. It is therefore possible to always have the copy density within a suitable range and to provide stable image quality without impairing the responsiveness of the copying machine and increasing the consumption of toner. Thus, the image-quality stabilizer of this embodiment enables a more appropriate correction of the image quality in comparison with the control using the predetermined correct value.

Embodiment 24

The following description discusses another embodiment of the present invention with reference to FIGS. 2, 26, 31 and 39. The members having the same function as in the above-mentioned embodiment will be designated by the same code and their description will be omitted.

As illustrated in FIG. 2, a copying machine as an electrophotographic apparatus including an image-quality stabilizer of this embodiment has the photoreceptor drum 1, and the copy lamp 19 for scanning the image of a document from the B direction. As illustrated in FIG. 39, the image-quality stabilizer includes the surface electrometer 20, the timer 15, and the CPU 14. The CPU 14 is connected to the memory device, not shown, storing the function representing the surface-potential recovering ability of the photoreceptor drum 1 described in embodiment 6 (see FIG. 26).

The CPU 14 feedback-controls the exposure level by controlling the amount of light from the copy lamp 19 according to the amount of charges on the photoreceptor drum 1 detected by the surface electrometer 20. In addition, the CPU 14 one-way-controls the exposure level according to the time that the copying machine is left unused, counted by the timer 15, using the function. With these controlling operations, the changes in the copy brightness caused when the copying machine is used or left unused are adjusted, thereby achieving stable image quality.

The following description discusses the control of the exposure level.

Like the copying machine of embodiment 19, a latent light patch is formed on the photoreceptor drum 1 during a rotation of the photoreceptor drum 1 after a copying operation. The amount of charges forming the latent light patch on the surface of the photoreceptor drum 1 is detected by the surface-electrometer 20. The CPU 14 feedback-controls the exposure level according to the amount of charges detected by the surface electrometer 20. With this control, the copy brightness which has been changed by a repeated use of the copying machine is brought back to the initial level.

After the feedback control, the recovery of the surface potential of the photoreceptor drum 1 is calculated from the time that the copying machine is left unused, counted by the timer 15, using the function. To adjust the recovery of the surface potential just before starting the next copying operation, the CPU 14 one-way-controls the exposure level according to the relationship between the exposure level and the surface potential shown in FIG. 31. This control prevents a fogged image from being produced when the copying machine is left unused. Therefore, a copy produced by the next copying operation has an appropriate brightness.

As described above, the image-quality stabilizer of this embodiment one-way-controls the exposure level using the approximate function representing the surface-potential recovering ability, and feedback-controls the exposure level according to the amount of charges on the photoreceptor drum 1. It is therefore possible to always have the copy brightness within a suitable range-and to provide stable image quality without impairing the responsiveness of the copying machine and increasing the consumption of toner. Thus, the one-way control of the exposure level using the approximate function representing the surface-potential recovering ability of the photoreceptor drum 1 achieves a more appropriate correction of the image quality in comparison with the control using the predetermined correct value.

Embodiment 25

The following description discusses another embodiment of the present invention with reference to FIGS. 2, 26, 31, 32 and 40. The members having the same function as in the above-mentioned embodiment will be designated by the same code and their description will be omitted.

As illustrated in FIGS. 2 and 40, a copying machine as an electrophotographic apparatus including an image-quality stabilizer of this embodiment has the photoreceptor drum 1, the charger 2, the developing device 4 and the discharge lamp 12, disposed around the photoreceptor drum 1, as well as the copy lamp 19 for scanning the image of a document from the B direction. The image-quality stabilizer includes the surface electrometer 20, the timer 15, and the CPU 14. The CPU 14 is connected to the memory device, not shown, storing the function representing the surface-potential recovering ability of the photoreceptor drum 1 described in embodiment 6 (see FIG. 26).

The CPU 14 feedback-controls at least one of the output of the charger 2, the development bias output of the developing device 4, and the amount of discharging light of the discharge lamp 12 as well as the exposure level (the light amount of the copy lamp 19) according to the amount of charges on the photoreceptor drum 1 detected by the surface electrometer 20. In addition, the CPU 14 one-way-controls at least one of the charger output, the development bias output and the amount of discharging light as well as the exposure level according to the time that the copying machine left unused after the feedback control, counted by the timer 15, using the function. With these controlling operations, the changes in the copy density and the copy brightness caused when the copying machine is used or left unused are corrected, thereby achieving stable image quality.

The following description discusses the control of processing sections.

Like embodiment 20, a latent dark patch and a latent light patch are formed on the photoreceptor drum 1 during a rotation of the photoreceptor drum 1 after a copying operation. The amounts of charges forming the dark and latent light patches are respectively detected by the surface electrometer 20. The CPU 14 feedback-controls at least one of the charger output, the development bias output, and the amount of discharging light as well as the exposure level. With this control, the copy density and the copy brightness which have been decreased due to a repeated use of the copying machine are brought back to the initial levels.

After the feedback control, the recovery of the surface potential of the photoreceptor drum 1 is calculated from the time that the copying machine is left unused, counted by the timer 15, using the function. To adjust the recovery of the surface potential just before starting the next copying operation, the CPU 14 one-way-controls at least one of the charger output, the development bias output, and the amount of discharging light according to the relationship between the charger output, the development bias output and the amount of discharging light, and the surface potential (development potential) described in embodiments 6 to 8 (see FIG. 32), and one-way-controls the exposure level according to the relationship between the exposure level and the surface potential described in embodiment 9 (see FIG. 31). The one-way control further adjusts the copy density and the copy brightness which have been increased excessively when the copying machine is left unused. Consequently, a copy produced by the next copying operation has appropriate density and brightness.

As described above, the image-quality stabilizer of this embodiment one-way-controls at least one of the charger output, the development bias output, and the amount of discharging light as well as the exposure level using the approximate function representing the surface-potential recovering ability, and feedback-controls at least one of the charger output, the development bias output, and the amount of discharging light as well as the exposure level according to the amount of charges of the photoreceptor drum 1. It is therefore possible to always have the copy density and the copy brightness within suitable ranges and to provide stable image quality without impairing the responsiveness of the copying machine and increasing the consumption of toner. Thus, the one-way control using the approximate function representing the surface-potential recovering ability of the photoreceptor drum 1 enables a more appropriate correction of the image quality in comparison with the control using the correct values which are predetermined according to the time that the copying machine is left unused. Namely, it is possible to prevent an increase in the copy density and a fogged image from being caused when the copying machine is left unused.

Furthermore, in terms of the copy density and brightness, stable image quality is obtained by adjusting the density a dark portion corresponding to a high-dense portion of the image with the control of the charger output, the development bias output or the amount of discharging light and by adjusting the brightness of a bright portion corresponding to a low-dense portion of the image with the control of the exposure level.

Embodiment 26

The following description discusses another embodiment of the present invention with reference to FIGS. 2, 6 and 36. The members having the same function as in the above-mentioned embodiment will be designated by the same code and their description will be omitted.

As illustrated in FIG. 2, a copying machine as an electrophotographic apparatus including an image-quality stabilizer of this embodiment has the photoreceptor drum 1, and the charger 2 disposed around the photoreceptor drum 1. As illustrated in FIG. 36, the image-quality stabilizer includes the surface electrometer 20, the timer 15, and the CPU 14.

The CPU 14 feedback-controls the output of the charger 2 at intervals of, for example, predetermined number of copies or predetermined time intervals according to the amount of charges on the photoreceptor drum 1 detected by the surface electrometer 20, and one-way-controls the charger output according to the time that the copying machine is left unused, counted by the timer 15. These controlling operations correct changes in the copy density caused when the copying machine is used and left unused, providing stable image quality.

The following description discusses the control of the charger output in detail.

Like embodiment 16, a latent dark patch is formed on the photoreceptor drum 1 every time a predetermined number of copies are produced or at predetermined time intervals. The amount of charges forming the latent dark patch is detected by the surface electrometer 20. The CPU 14 feedback-controls the charger output according to the amount of charges detected by the surface electrometer 20. This controls allows the copy density which is decreased when the copying machine is used to be brought back to the initial level.

The intervals of performing the feedback control which are given, for example, by the number of copies produced or a period of time, are determined so as to make the copy density which is lowered by a repeated use of the copying machine within a suitable range even before the control.

Similar to embodiment 16, when the copying machine is left unused after a copying operation, the CPU 14 one-way-controls the charger output to have the correct value determined as shown in FIG. 6 according to the time that the copying machine is left unused, counted by the timer 15, just before starting the next copying operation. With this control, an excessively high copy density resulting from leaving the copying machine unused is further adjusted. Therefore, an appropriate copy density is obtained by the next copying operation.

As described above, the image-quality stabilizer of this embodiment feedback-controls the charger output at intervals of predetermined number of copies or predetermined time intervals according to the amount of charges on the photoreceptor drum 1 detected by the surface electrometer 20, and one-way-controls the charger output according to the time that the copying machine is left unused. It is therefore possible to appropriately correct the changes in the copy density caused when the copying machine is used or left unused without increasing the consumption of toner and impairing the responsiveness of the copying machine. In addition, in the image-quality stabilizer of this embodiment, since the charger output is feedback-controlled at intervals of, for example, predetermined number of copies or predetermined time intervals, the frequency of performing the feedback control is reduced in comparison with the feedback control performed during a rotation of the photoreceptor drum 1 every after a copying operation. Namely, laborsaving control and less toner consumption are achieved.

Embodiment 27

The following description discusses another embodiment of the present invention with reference to FIGS. 2, 10 and 37. The member having the same function as in the above-mentioned embodiment will be designated by the same code and their description will be omitted.

As illustrated in FIG. 2, a copying machine as an electrophotographic apparatus including an image-quality stabilizer of this embodiment has the photoreceptor drum 1, and the developing device 4 disposed around the photoreceptor drum 1. As illustrated in FIG. 37, the image-quality stabilizer includes the surface electrometer 20, the timer 15, and the CPU 14.

The CPU 14 feedback-controls the development bias output of the developing device 4 at intervals of, for example, predetermined number of copies or predetermined time intervals according to the amount of charges on the photoreceptor drum 1 detected by the surface electrometer 20, and one-way-controls the development bias output according to the time that the copying machine is left unused, counted by the timer 15. These controlling operations correct changes in the copy density caused when the copying machine is used and left unused, achieving stable image quality.

The following description discusses the control of the development bias output in detail.

Like embodiment 16, a latent dark patch is formed on the photoreceptor drum 1 every time a predetermined number of copies are produced or at predetermined time intervals. The amount of charges forming the latent dark patch is detected by the surface electrometer 20. The CPU 14 feedback-controls the development bias output according to the amount of charges detected by the surface electrometer 20. This control allows the copy density which has been decreased when the copying machine is used to be brought back to the initial level.

Similar to embodiment 17, when the copying machine is left unused after a copying operation, the CPU 14 one-way-controls the development bias output to have the correct value determined as shown in FIG. 10 according to the time that the copying machine is left unused, counted by the timer 15 just before starting the next copying operation. With this control, an excessively high copy density resulting from leaving the copying machine unused is corrected. Therefore, -an appropriate copy density is obtained by the next copying operation.

As described above, the image-quality stabilizer of this embodiment feedback-controls the development bias output at intervals of predetermined number of copies or predetermined time intervals according to the amount of charges on the photoreceptor drum 1 detected by the surface electrometer 20, and one-way-controls the development bias output according to the time that the copying machine is left unused. It is thus possible to appropriately correct the changes in the copy density without increasing the consumption of toner and impairing the responsiveness of the copying machine.

In addition, in the image-quality stabilizer of this embodiment, since the development bias output is feedback-controlled at intervals of, for example, predetermined number of copies or predetermined time intervals, the frequency of performing the feedback control is reduced in comparison with the feedback control performed during a rotation of the photoreceptor drum 1 every after a copying operation. Namely, laborsaving control and less toner consumption are achieved.

Embodiment 28

The following description discusses another embodiment of the present invention with reference to FIGS. 2, 13 and 38. The members having the same function as in the above-mentioned embodiment will be designated by the same code and their description will be omitted.

As illustrated in FIG. 2, a copying machine as an electrophotographic apparatus including an image-quality stabilizer of this embodiment has the photoreceptor drum 1, and the discharge lamp 12 disposed around the photoreceptor drum 1. As illustrated in FIG. 38, the image-quality stabilizer includes the surface electrometer 20, the timer 15, and the CPU 14.

The CPU 14 feedback-controls the amount of discharging light of the discharge lamp 12 at intervals of, for example, predetermined number of copies or predetermined time intervals according to the amount of charges on the photoreceptor drum 1 detected by the surface electrometer 20, and one-way-controls the amount of discharging light according to the time that the copying machine is left unused, counted by the timer 15. These controlling operations correct changes in the copy density caused when the copying machine is used and left unused, thereby achieving stable image quality.

The following description discusses the control of the amount of discharging light in detail.

Like embodiment 16, a latent dark patch is formed on the photoreceptor drum 1 every time a predetermined number of copies are produced or at predetermined time intervals. The amount of charges forming the latent dark patch is detected by the surface electrometer 20. The CPU 14 feedback-controls the amount of discharging light according to the amount of charges detected by the surface electrometer 20. This control allows the copy density which is lowered when the copying machine is used to be brought back to the initial level.

Similar to embodiment 18, when the copying machine is left unused after a copying operation, the CPU 14 one-way-controls the amount of discharging light to have the correct value determined as shown in FIG. 13 according to the time that the copying machine is left unused, counted by the timer 15, just before starting the next copying operation. With this control, the excessively high copy density resulting from leaving the copying machine unused is corrected. Therefore, an appropriate copy density is obtained by the next copying operation.

As described above, the image-quality stabilizer of this embodiment feedback-controls the amount of discharging light at intervals of predetermined number of copies or predetermined time intervals according to the amount of charges on the photoreceptor drum 1 detected by the surface electrometer 20, and one-way-controls the amount of discharging light of the discharge lamp 12 according to the time that the copying machine is left unused. It is thus possible to appropriately correct the changes in the copy density without increasing the consumption of toner and impairing the responsiveness of the copying machine.

In addition, in the image-quality stabilizer of this embodiment, since the amount of discharging light is feedback-controlled at intervals of, for example, predetermined number of copies or predetermined time intervals, the frequency of performing the feedback control is reduced in comparison with the feedback control performed during a rotation of the photoreceptor drum 1 every after a copying operation. Namely, laborsaving control and less toner consumption are achieved.

Embodiment 29

The following description discusses another embodiment of the present invention with reference to FIGS. 2, 18 and 39. The members having the same function as in the above-mentioned embodiment will be designated by the same code and their description will be omitted.

As illustrated in FIG. 2, a copying machine as an electrophotographic apparatus including an image-quality stabilizer of this embodiment has the photoreceptor drum 1, and the copy lamp 19 for scanning the image of a document from the B direction. As illustrated in FIG. 39, the image-quality stabilizer includes the surface electrometer 20, the timer 15, and the CPU 14.

The CPU 14 feedback-controls the exposure level by controlling the amount of light from the copy lamp 19 at intervals of, for example, predetermined number of copies or predetermined time intervals according to the amount of charges on the photoreceptor drum 1 detected by the surface electrometer 20, and one-way-controls the exposure level according to the time that the copying machine is left unused, counted by the timer 15. These controlling operations correct changes in the copy brightness caused when the copying machine is used and left unused, thereby achieving stable image quality.

The following description discusses the control of the exposure level in detail.

Like embodiment 19, a latent light patch is formed on the photoreceptor drum 1 every time a predetermined number of copies are produced or at predetermined time intervals. The amount of charges forming the latent light patch is detected by the surface electrometer 20. The CPU 14 feedback-controls the exposure level according to the amount of charges detected by the surface electrometer 20. This control allows the copy brightness which has been changed when the copying machine is used to be brought back to the initial level.

Similar to embodiment 19, when the copying machine is left unused after a copying operation, the CPU 14 one-way-controls the exposure level to have the correct value determined as shown in FIG. 18 according to the time that the copying machine is left unused, counted by the timer 15, just before starting the next copying operation. With this control, the excessively high copy brightness resulting from leaving the copying machine unused is corrected. It is therefore possible to prevent a fogged image and to obtain a copy with an appropriate copy brightness by the next copying operation.

As described above, the image-quality stabilizer of this embodiment feedback-controls the exposure level at intervals of predetermined number of copies or predetermined time intervals according to the amount of charges on the photoreceptor drum 1 detected by the surface electrometer 20, and one-way-controls the exposure level according to the time that the copying machine is left unused. It is thus possible to appropriately correct the changes in the copy brightness without increasing the consumption of toner and impairing the responsiveness of the copying machine.

In addition, in the image-quality stabilizer of this embodiment, since the exposure level is feedback-controlled at intervals of, for example, predetermined number of copies or predetermined time intervals, the frequency of performing the feedback control is reduced in comparison with the feedback control performed during a rotation of the photoreceptor drum 1 every after a copying operation. Namely, laborsaving control and less toner consumption are achieved.

Embodiment 30

The following description discusses another embodiment of the present invention with reference to FIGS. 2, 18, 24 and 40. The members having the same function as in the above-mentioned embodiment will be designated by the same code and their description will be omitted.

As illustrated in FIGS. 2 and 40, a copying machine as an electrophotographic apparatus including an image-quality stabilizer of this embodiment has the photoreceptor drum 1, the charger 2, the developing device 4 and the discharge lamp 12, disposed around the photoreceptor drum 1, as well as the copy lamp 19 for scanning the image of a document from the B direction. The image-quality stabilizer includes the surface electrometer 20, the timer 15, and the CPU 14.

The CPU 14 feedback-controls at least one of the output of the charger 2, the development bias output of the developing device 4, the amount of discharging light of the discharge lamp 12 as well as the exposure level (the light amount of the copy lamp 19) at intervals of, for example, predetermined number of copies or predetermined time intervals according to the amount of charges on the photoreceptor drum 1 detected by the surface electrometer 20. The CPU 14 also one-way-controls at least one of the charger output, the development bias output and the amount of discharging light as well as the exposure level according to the time that the copying machine is left unused, counted by the timer 15. With these controlling operations, changes in the copy density and the copy brightness caused when the copying machine is used or left unused are appropriately corrected and stable image quality is obtained.

The following description discusses the control of each of the image forming devices.

Like embodiments 16 and 19, a latent dark patch and a latent light patch are formed on the photoreceptor drum 1 every time a predetermined number of copies are produced or at predetermined time intervals. The amounts of charges forming the dark and light patches are respectively detected by the surface electrometer 20. The CPU 14 feedback-controls at least one of the charger output, the development bias output, and the amount of discharging light as well as the exposure level according to the amounts detected by the surface electrometer 20. With this control, the copy density and copy brightness which have been changed when the copying machine was used are brought back to the initial levels.

Like embodiment 20, the CPU 14 one-way-controls at least one of the charger output, the development bias output, and the amount of discharging light to have a correct value determined as shown in FIG. 24, and the exposure level to have a correct value determined as shown in FIG. 28 according to the time that the copying machine is left unused, counted by the timer 15, just before starting the next copy operation. As a result, the copy density and the copy brightness which have been increased excessively when the copying machine was left unused are further adjusted suitably. Therefore, a copy produced by the next copying operation has appropriate copy density and brightness.

As described above, the CPU 14 feedback-controls at least one of the charger output, the development bias output, and the amount of discharging light as well as the exposure level every time a predetermined number of copies are produced or at predetermined time intervals according to the amount of charges on the surface of the photoreceptor drum 1, and one-way-controls at least one of the charger output, the development bias output, and the amount of discharging light as well as the exposure level according to the time that the copying machine is left unused. As a result; the copy density and the copy brightness which have been changed when the copying machine was used or left unused are appropriately corrected without increasing the consumption of toner and impairing the responsiveness of the copying machine.

Moreover, since the feedback control is performed at intervals of, for example, a predetermined number of copies or predetermined time intervals, the frequency of performing the feedback control is reduced in comparison with the feedback control executed during a rotation of the photoreceptor drum 1 every after a copying operation, achieving laborsaving and timesaving control.

It is also possible to use a combination of one-way-control of the image-forming devices to be performed using the function representing the surface-potential recovering ability of the photoreceptor drum 1 described in embodiments 21 to 25 (see FIG. 26) and the feedback control of the image-forming devices to be performed at predetermined intervals according to the amount of surface charges, described in embodiments 26 to 30. With the combination of control operations, it is possible to efficiently produce stable image quality like the above-mentioned embodiments.

It is also possible incorporate into the image-quality stabilizer two timers, one counting time that the photoreceptor drum 1 is active and the other counting time that the photoreceptor drum 1 is inactive. With this structure, the control corresponding to the fatigue characteristic of the photoreceptor drum shown in FIG. 26 is performed by the CPU as image-quality adjusting means according to the time that the photoreceptor drum 1 is active, while the control corresponding to the surface-potential recovering ability is performed according to the time that the photoreceptor drum 1 is inactive. Furthermore, the feedback control is executed at intervals of predetermined number of copies or predetermined time intervals according to the amount of charges on the surface of the photoreceptor drum 1.

With this structure, like the above-mentioned embodiments, it is also possible to correct the changes in the image quality caused when the copying machine is used or left unused. More specifically, the fatigue of the photoreceptor drum caused in a relatively short time is one-way-controlled according to the time that the photoreceptor drum 1 is active. And, a change in the image quality that is hard to predict and caused in a relatively long time is feedback-controlled according to the amount of charges on the surface of the photoreceptor drum 1 at predetermined intervals regardless of if a copying operation, or a rotation of the photoreceptor drum after/before a copying operation is in progress. With a combination of the one-way control to be performed according to the time that the photoreceptor drum is active or inactive and the feedback control to be performed at predetermined intervals according to the amount of charges on the surface of the photoreceptor drum, the image quality is more appropriately corrected while reducing the frequency to perform the feedback control which consumes a large amount time and labor.

In this case, like the above-mentioned embodiments, the charger output, the development bias output, the amount of discharging light and the exposure level, or a combination thereof are controlled.

Embodiment 31

The following description discusses another embodiment of the present invention with reference to FIGS. 2, 5, 43 and 44. The members having the same function as in the above-mentioned embodiment will be designated by the same code and their description will be omitted.

Figure 43:
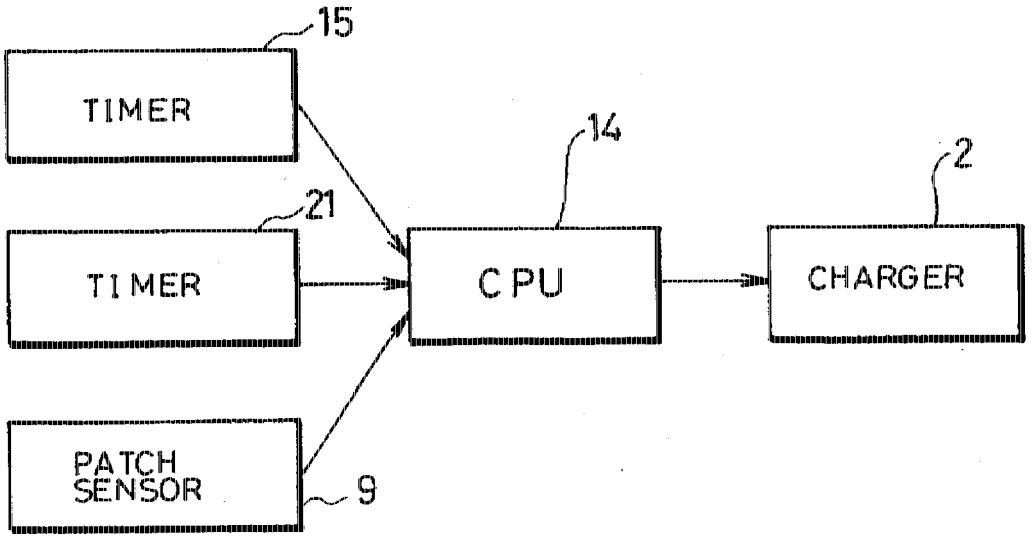
FIG. 43 is a block diagram illustrating a structure of a control system in a copying machine having an image-quality stabilizer according to another embodiment of the present invention.

As illustrated in FIG. 2, a copying machine as an electrophotographic apparatus including an image-quality stabilizer of this embodiment has the photoreceptor drum 1, and the charger 2 disposed around the photoreceptor drum 1. As illustrated in FIG. 43, the image-quality stabilizer also includes the patch sensor 9, a timer 21 for accumulating copying time, the timer 15 for counting the time that the copying machine is left unused, and the CPU 14.

The timer 21 accumulates the time that the copying machine actually performs copying operations (the time taken for imaging operations) by taking account of the time that the photoreceptor drum 1 is active and the number of rotations performed by the photoreceptor drum 1. The timer 15 counts the time that the photoreceptor drum 1 is stopped rotating.

When the copying time accumulated by the timer 21 reaches a predetermined time, the CPU 14 executes process control by feedback-controlling the output of the charger 2 so as to cause the amount of toner on the photoreceptor drum 1 detected by the patch sensor 9 to be equal to a preset reference value. The process control is performed when the timer 21 counts the predetermined time regardless of the state of the photoreceptor drum 1, for example, whether the photoreceptor drum 1 is rotated before a copying operation, the photoreceptor drum 1 is used for the copying operation, or the photoreceptor drum 1 is rotated after a copying operation.

The CPU 14 performs the process control during a rotation of the photoreceptor drum 1 before the next copying operation if the time that the copying machine is left unused, counted by the timer 15, reaches or exceeds a predetermined time. Since the CPU 14 feedback-controls the charger output according to a value detected by the patch sensor 9 when each of the timers 15 and 21 counts the predetermined time, changes in the copy density caused when the copying machine is used or left unused are corrected and stable image quality is obtained.

The timer 21 is reset when the process control is performed. The timer 15 is rest when the process control is performed and a copying operation is started.

Figure 44:
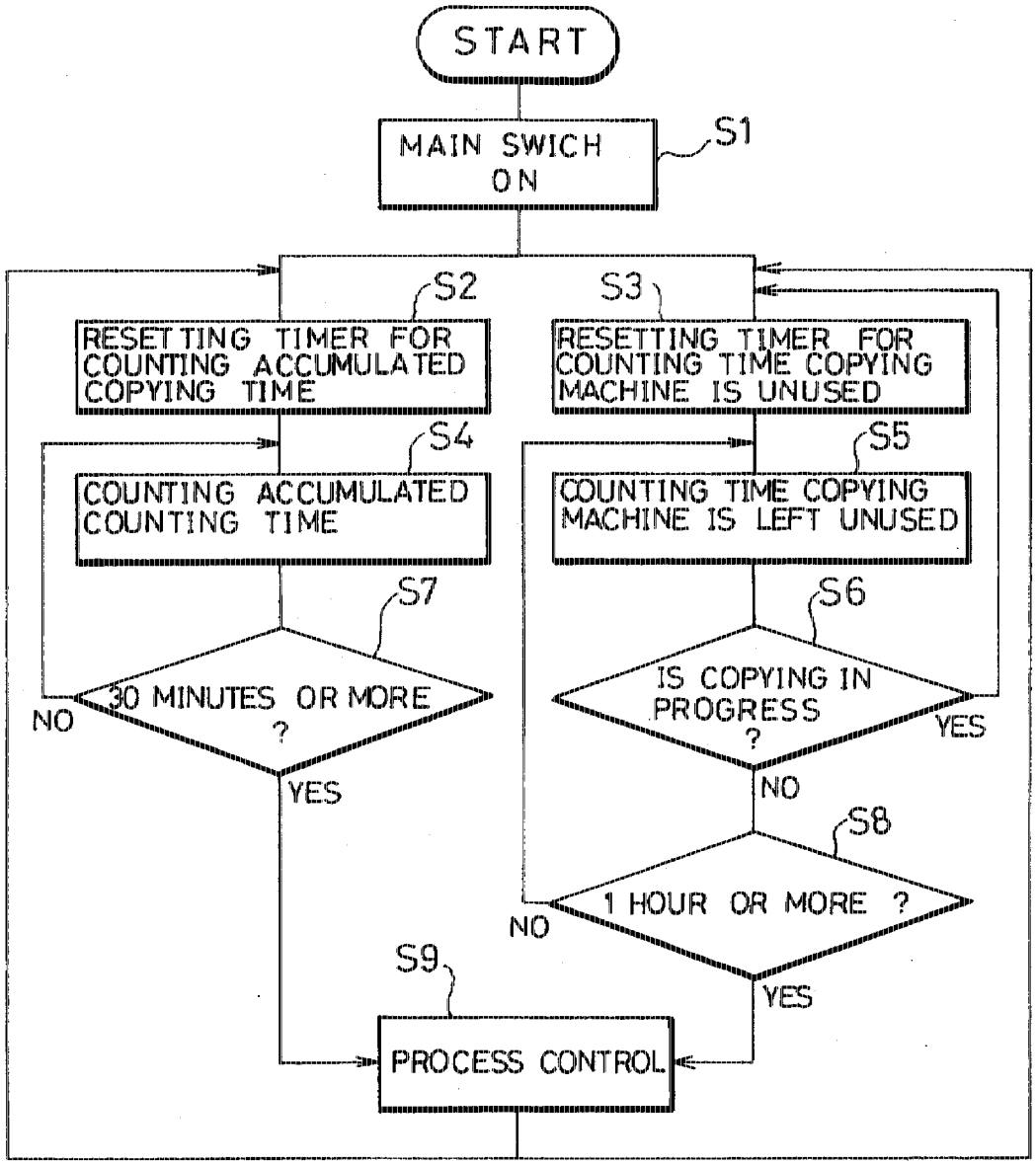
FIG. 44 is a flowchart illustrating the operations of a timer for measuring accumulated copying time and a timer for measuring time that the electrophotographic apparatus is left inactive when the process control is performed by the control system of FIG. 43.

With reference to the flowchart of FIG. 44, controlling operations executed by the CPU 14 are described below. In this embodiment, for example, the process control is performed when the accumulated copying time reaches 30 minutes and the time that the copying machine is left unused reaches one hour. The interval between the process control operations varies depending on the characteristics of each copying machine, and therefore the predetermined times are not restricted to the above-mentioned figures.

When the main switch of the copying machine is turned on (step 1), the copying machine is warmed up. Then, like embodiment 1, a dark toner patch is formed on the photoreceptor drum 1, and the amount of toner forming the dark toner patch is detected by the patch sensor 9. The process control is performed by feedback-controlling the charger output according to the amount of toner detected by the patch sensor 9, and the copying machine becomes ready to perform a copying operation.

When the process control is performed, the timers 21 and 15 are reset (steps 2 and 3). After resetting the timers 15 and 21, if the copying machine is left unused, the timer 15 counts time that the copying machine is left unused (step 5). On the other hand, if a copying operation is started (step 6), the timer 15 is again rest (step 3) and the timer 21 starts accumulating the copying time (step 4).

When the accumulated copying time counted by the timer 21 reaches 30 minutes (step 7), the process control is performed (step 9) and a decrease in the copy density resulting from a repeated use of the copying machine is corrected. When the process control is performed, the timer 21 and the timer 15 are rest (steps 2 and 3)

In this state, if a copying operation is not started, the timer 15 starts counting time that the copying machine is left unused (step 5). The photoreceptor drum 1 recovers from fatigue and is overcompensated if the timer 15 has counted one hour or more (step 8). Therefore, when the timer 15 counts one hour, the process control is again performed (step 9) before starting the copying operation. With this arrangement, since the overcompensated photoreceptor drum 1 is further adjusted, an increase in the copy density is prevented. When the process control is performed, the timers 21 and 15 are reset (steps 2 and 3).

On the other hand, when the time that the copying machine is left unused, counted by the timer 15, does not reach one hour, the photoreceptor drum 1 has not yet fully recovered. Namely, the photoreceptor drum 1 is not overcompensated. Therefore, the next copying operation is started without performing the process control. When the copying operation which takes less than 30 minutes is performed several times after leaving the copying machine unused for less than one hour, the timer 15 is reset every time the copying operation is started (steps 6 and 3). However, the timer 21 is not reset, and accumulates the copying time. When the accumulated copying time reaches 30 minutes (step 7), the process control is performed (step 9) to correct a decrease in the copy density.

As mentioned in embodiment 1, the relationship between the charger output and the copy density is shown in FIG. 5. The process control controls the charger output to become higher when the copy density is decreased by a repeated use of the copying machine, while it controls the charger output to become lower when the copying density is increased as a result of leaving the copying machine unused. Thus, the change in the copy density is corrected.

When the process control is performed at predetermined intervals, even if a great number of copying operations are repeatedly performed within a short time and if the copy density becomes lower due to the fatigue of the photoreceptor drum 1, the process control is not performed until a predetermined time passes. Consequently, the image quality deteriorates. On the other hand, when the frequency of using the copying machine is relatively low, even if the copy density is not changed much, the process control is unnecessarily performed at predetermined intervals. Therefore, unnecessarily longer time is taken to make the copying machine ready and an excessive amount of charges is consumed.

Meanwhile, when the process control is performed every time a predetermined number of copies are produced, even if the copying machine is left unused for a long time after the process control and is overcompensated, changes in the copy density are not corrected until the predetermined number of copies are produced.

However, with the image-quality stabilizer, since the process control is performed when the accumulated copying time reaches a predetermined time, the process control is not performed until the accumulated copying time reaches the predetermined time when the frequency of using the copying machine is low. Therefore, if the frequency of using the copying machine is low, the interval between the controlling operations automatically becomes longer, thereby eliminating unnecessary control.

On the other hand, when the frequency of using the copying machine is high, the process control is performed frequently at relatively short intervals. Consequently, it is possible to timely correct a decrease in the image density caused when the copying operation is repeatedly performed.

Regarding the control for preventing the copy density from being increased when the copying machine is left unused, since the process control is performed when the copying machine is left unused more than a predetermined time, the photoreceptor drum 1 which has been overcompensated as a result of leaving the copy machine unused is appropriately corrected. Moreover, when the copying machine is left unused for a relatively short time, the copy density is not changed much. At this time, the process control is not performed. It is therefore possible to minimize the frequency of performing the control.

Thus, changes in the copy density are timely corrected according to the frequency of using the copying machine and the time that the copying machine is left unused. Furthermore, since the frequency of performing the control is minimized, the time taken to make the copying machine ready and the toner consumption are decreased. As a result, the changes in the copy density are appropriately corrected without increasing the consumption of toner and impairing the responsiveness of the copying machine. Namely, stable image quality is efficiently obtained with a reduced number of control operations.

Embodiment 32

Figure 45:
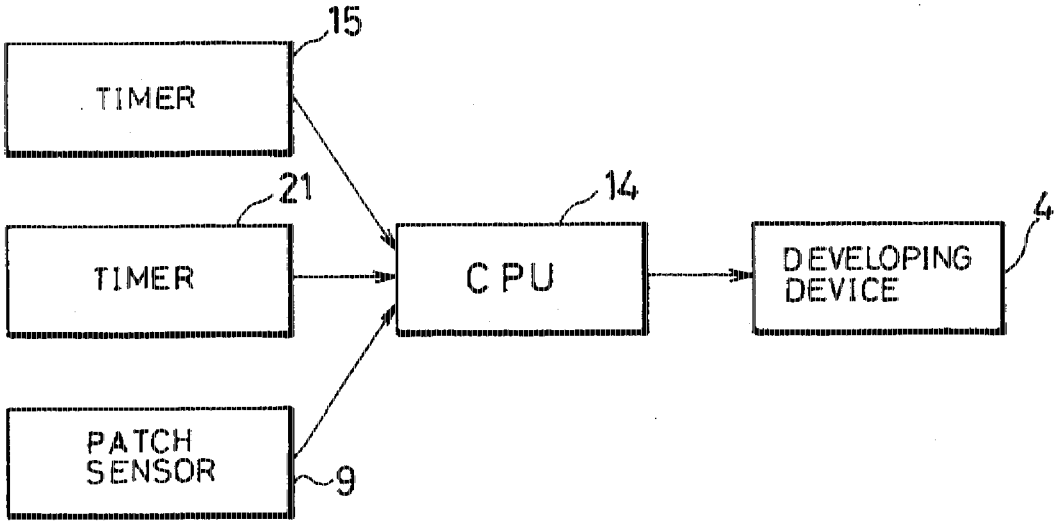
FIG. 45 is a block diagram illustrating a structure of a control system in a copying machine having an image-quality stabilizer according to another embodiment of the present invention.

The following description discusses another embodiment of the present invention with reference to FIGS. 2, 9 and 45. The members having the same function as in the above-mentioned embodiment will be designated by the same code and their description will be omitted.

As illustrated in FIG. 2, a copying machine as an electrophotographic apparatus including an image-quality stabilizer of this embodiment has the photoreceptor drum 1, and the developing device 4 disposed around the photoreceptor drum 1. As illustrated in FIG. 45, the image-quality stabilizer also includes the patch sensor 9, the timer 21 for accumulating copying time, the timer 15 for counting time that the copying machine is left unused, and the CPU 14.

When the copying time accumulated by the timer 21 reaches a predetermined time, the CPU 14 executes process control by feedback-controlling the development bias output of the developing device 4 so as to cause the amount of toner on the photoreceptor drum 1 detected by the patch sensor 9 to be equal to a preset reference value during a rotation of the photoreceptor drum 1 before a copying operation, copying, or a rotation of the photoreceptor drum 1 after the copying operation. The process control is performed during a rotation of the photoreceptor drum before starting the next copying operation if the time that the copying machine is left unused, counted by the timer 15, reaches or exceeds a predetermined time.

Since the CPU 14 feedback-controls the development bias output according to a value detected by the patch sensor 9 when the timers 15 and 21 count predetermined time, changes in the copy density caused when the copying machine is used or left unused are corrected and stable image quality is obtained.

The timers 21 and 15 are reset in the same manner as in embodiment 31.

The following description discusses the process control of the development bias output which was performed by setting the accumulated copying time to 30 minutes and the time that the copying machine is left unused to at least one hour.

When the accumulated copying time counted by the timer 21 reaches 30 minutes, a dark toner patch is formed on the photoreceptor drum 1 like embodiment 1 even if a copying operation is in progress. The amount of toner forming the dark toner patch is detected by the patch sensor 9. The CPU 14 performs the process control by feedback-controlling the development bias output according to the amount of toner detected by the patch sensor 9. With this control, the copy density which has been lowered when the copying machine was used is corrected.

The CPU 14 performs the same process control during a rotation of the photoreceptor drum 1 before starting the next copying operation if the timer 15 counts one hour or more after the copying machine is left unused. With this control, the copy density which has been increased as a result of leaving the copying machine unused is corrected.

As mentioned in embodiment 2, the relationship between the development bias output and the copy density is shown in FIG. 9. The process control controls the development bias output to become lower when the copy density is decreased by the repeatedly performed copying operations, while it controls the development bias output to become higher when the copying density is increased as a result of leaving the copying machine unused and the overcompensated photoreceptor drum 1. Thus, changes in the copy density are corrected.

Thus, by feedback-controlling the development bias output according to the amount of toner on the photoreceptor drum 1, the accumulated copying time counted by the timer 21 and the time that the copying machine is left unused, counted by the timer 15, changes in the copy density are timely corrected depending on the frequency of using the copying machine and the time that the copying machine is left unused like embodiment 31. Furthermore, since the frequency of performing the control is minimized, the time taken to make the copying machine ready and the toner consumption are decreased. As a result, the changes in the copy density are appropriately corrected without increasing the consumption of toner and impairing the responsiveness of the copying machine. Namely, stable image quality is efficiently obtained with a reduced number of control operations.

Embodiment 33

Figure 46:
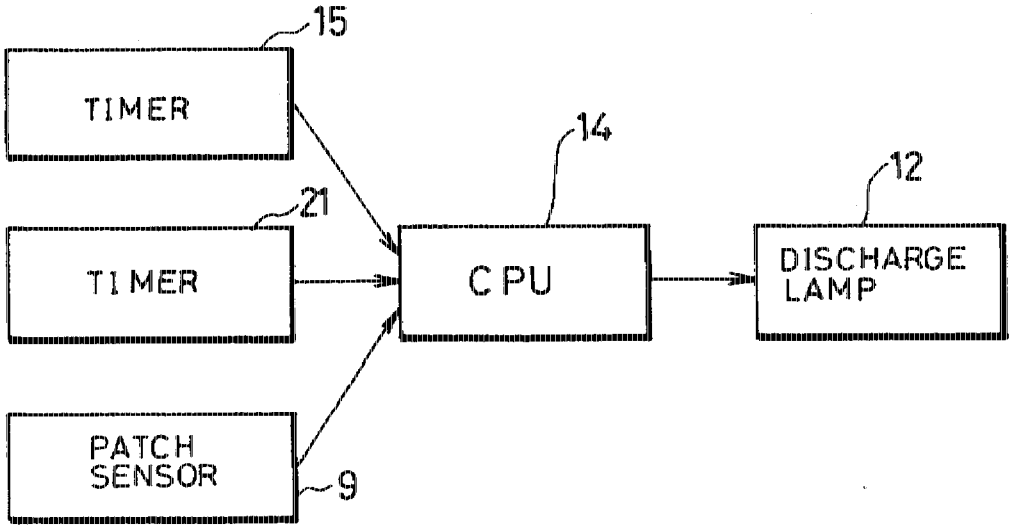
FIG. 46 is a block diagram illustrating a structure of a control system in a copying machine having an image-quality stabilizer according to still another embodiment of the present invention.

The following description discusses another embodiment of the present invention with reference to FIGS. 2, 12 and 46. The members having the same function as in the above-mentioned embodiment will be designated by the same code and their description will be omitted.

As illustrated in FIG. 2, a copying machine as an electrophotographic apparatus including an image-quality stabilizer of this embodiment has the photoreceptor drum 1, and the discharge lamp 12 disposed around the photoreceptor drum 1. As illustrated in FIG. 46, the image-quality stabilizer also includes the patch sensor 9, the timer 21 for accumulating copying time, the timer 15 for counting time that the copying machine is inactive, and the CPU 14.

When the copying time accumulated by the timer 21 reaches a predetermined time, the CPU 14 executes process control by feedback-controlling the amount of discharging light of the discharge lamp 12 so as to cause the amount of toner on the photoreceptor drum 1 detected by the patch sensor 9 to be equal to a preset reference value during a rotation of the photoreceptor drum 1 before a copying operation, copying, or a rotation of the photoreceptor drum 1 after the copying operation. The process control is performed during a rotation of the photoreceptor drum 1 before starting the next copying operation if the time that the copying machine is left unused, counted by the timer 15, reaches or exceeds a predetermined time.

Since the CPU 14 feedback-controls the amount of discharging light of the discharge lamp 12 according to a value detected by the patch sensor 9 when each of the timers 15 and 21 counts the predetermined time, the changes in the copy density caused when the copying machine is used or left unused are corrected and stable image quality is obtained.

The timers 21 and 15 are reset in the same manner as in embodiment 31.

The following description discusses the process control of the amount of discharging light which was performed by setting the accumulated copying time to 30 minutes and the time that the copying machine is left unused to at least one hour.

When the accumulated copying time counted by the timer 21 reaches 30 minutes, a dark toner patch is formed on the photoreceptor drum 1 like embodiment 1 even when a copying operation is in progress. The amount of toner forming the dark toner patch is detected by the patch sensor 9. The CPU 14 performs the process control by feedback-controlling the amount of discharging light according to the amount of toner detected by the patch sensor 9. With this control, the copy density which has been lowered when the copying machine was used is corrected.

The CPU 14 performs the same process control during a rotation of the photoreceptor drum 1 before starting the next copying operation if the timer 15 has counted one hour after the copying machine is left unused. With this control, the copy density which has been increased as a result of leaving the copying machine unused is corrected.

As mentioned in embodiment 3, the relationship between the amount of discharging light and the copy density is shown in FIG. 12. The process control controls the amount of discharging light to become lower when the copy density is decreased by the repeatedly performed copying operations, while it controls the amount of discharging light to become higher when the copying density is increased as a result of leaving the copying machine unused and the overcompensated photoreceptor drum 1. The image quality is thus corrected.

As described above, by feedback-controlling the amount of discharging light according to the amount of toner on the photoreceptor drum 1, the accumulated copying time counted by the timer 21 and the time that the copying machine left unused, counted by the timer 15, changes in the copy density are timely corrected depending on the frequency of using the copying machine and the time that the copying machine is left unused like embodiment 31. Furthermore, since the frequency of performing control operations is minimized, the time taken to make the copying machine ready and the toner consumption are decreased. As a result, the changes in the copy density are appropriately corrected without increasing the consumption of toner and impairing the responsiveness of the copying machine. Namely, stable image quality is efficiently obtained with a reduced number of control operations.

Embodiment 34

Figure 47:
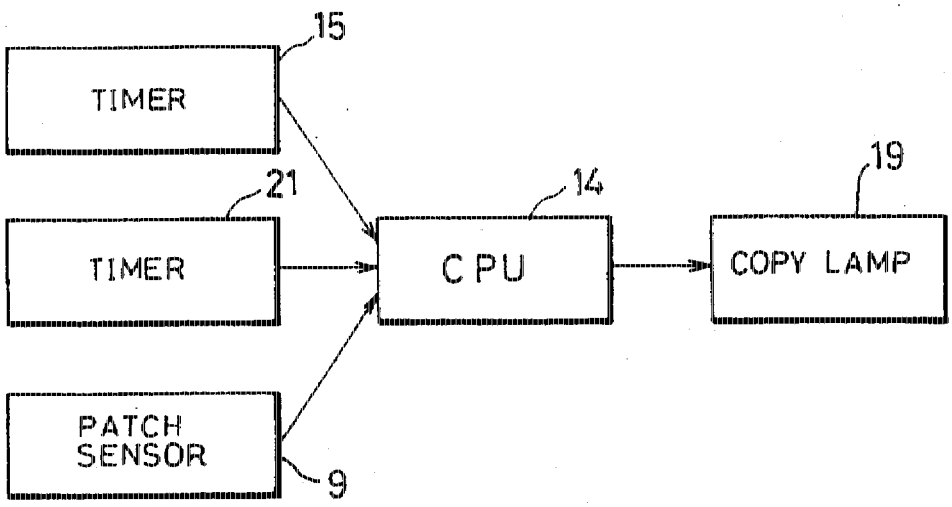
FIG. 47 is a block diagram illustrating a structure of a control system in a copying machine having an image-quality stabilizer according to yet another embodiment of the present invention.

The following description discusses another embodiment of the present invention with reference to FIGS. 2, 17 and 47. The members having the same function as in the above-mentioned embodiment will be designated by the same code and their description will be omitted.

As illustrated in FIGS. 2 and 47, a copying machine as an electrophotographic apparatus including an image-quality stabilizer of this embodiment has the photoreceptor drum 1, and the copy lamp 19 for scanning the image on a document from the B direction. The image-quality stabilizer also includes the patch sensor 9, the timer 21 for accumulating copying time, the timer 15 for counting time that the copying machine is inactive, and the CPU 14.

When the copying time accumulated by the timer 21 reaches a predetermined time, the CPU 14 executes process control by feedback-controlling the exposure level (the amount of light) of the copy lamp 19 so as to cause the amount of toner on the photoreceptor drum 1 detected by the patch sensor 9 to be equal to a preset reference value during a rotation of the photoreceptor drum 1 before a copying operation, copying, or a rotation of the photoreceptor drum 1 after the copying operation. The process control is performed during a rotation of the photoreceptor drum 1 before starting the next copying operation if the time that the copying machine is left unused, counted by the timer 15, reaches or exceeds a predetermined time.

Since the CPU 14 feedback-controls the exposure level according to a value detected by the patch sensor 9 when each of the timers 15 and 21 counts the predetermined time, changes in the copy brightness caused when the copying machine is used or left unused are corrected and stable image quality is obtained.

The timers 21 and 15 are reset in the same manner as in embodiment 31.

The following description discusses the process control of the exposure level which was performed by setting the accumulated copying time to 30 minutes and the time that the copying machine is left unused to at least one hour.

When the accumulated copying time counted by the timer 21 reaches 30 minutes, a light toner patch is formed on the photoreceptor drum 1 like embodiment 4 even when a copying operation is in progress. The amount of toner forming the light toner patch is detected by the patch sensor 9. The CPU 14 performs the process control by feedback-controlling the development bias output according to the amount of toner detected by the patch sensor 9. With this control, the copy density which has been changed when the copying machine was used is corrected.

The CPU 14 performs the same process control during a rotation of the photoreceptor drum 1 before starting the next copying operation if the timer 15 has counted one hour after the copying machine is left unused. With this control, the copy brightness which has been changed as a result of leaving the copying machine unused is corrected, thereby preventing a fogged image.

As mentioned in embodiment 4, the relationship between the exposure level and the copy brightness is shown in FIG. 17. The process control controls the exposure level to become lower when the image becomes too bright by copying operations, while it controls the exposure level to become higher when the image becomes too dark at the time the photoreceptor drum 1 is overcompensated by leaving the copying machine unused. The image brightness is thus corrected.

As described above, by feedback-controlling the exposure level according to the amount of toner on the photoreceptor drum 1 when each of the accumulated copying time counted by the timer 21 and the time that the copying machine is left unused counted by the timer 15 reaches the predetermined time, the process control is performed frequently at relatively short intervals if the frequency of using the copying machine is high. It is therefore possible to timely correct the changes in the copy brightness which are caused when the copying operations are repeatedly performed. On the other hand, when the frequency of using the copying machine is low, the control is not performed until the accumulated copying time reaches a predetermined time. It is thus possible to eliminate unnecessary control, and to reduce the time taken to make the copying machine ready and the toner consumption.

Furthermore, since the control of the changes in the copy brightness is not performed until the time that the copying machine is left unused reaches a predetermined time, the frequency of performing the control is minimized.

As a result, the changes in the copy brightness are appropriately corrected without increasing the consumption of toner and impairing the responsiveness of the copying machine. Namely, stable image quality is efficiently obtained with a reduced number of control operations.

Embodiment 35

The following description discusses another embodiment of the present invention with reference to FIGS. 2, 17, 23 and 48. The members having the same function as in the above-mentioned embodiment will be designated by the same code and their description will be omitted.

Figure 48:
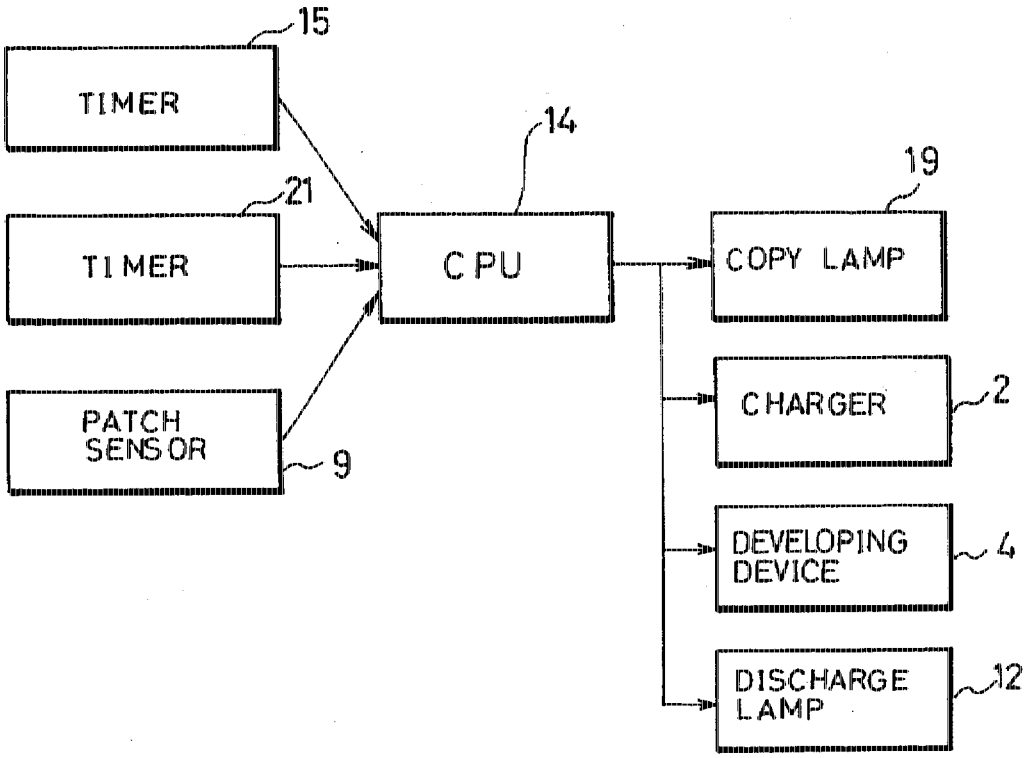
FIG. 48 is a block diagram illustrating a structure of a control system in a copying machine having an image-quality stabilizer according to another embodiment of the present invention.

As illustrated in FIGS. 2 and 48, a copying machine as an electrophotographic apparatus including an image-quality stabilizer of this embodiment has the photoreceptor drum 1, the charger 2, the developing device 4, the discharge lamp 12, disposed around the photoreceptor drum 1, and the copy lamp 19 for scanning the image on a document from the B direction. The image-quality stabilizer also includes the patch sensor 9, the timer 21 for accumulating copying time, the timer 15 for counting time that the copying machine is inactive, and the CPU 14.

When the copying time accumulated by the timer 21 reaches a predetermined time, the CPU 14 executes process control by feedback-controlling at least one of the output of the charger 2, the development bias output of the developing device 4, and the amount of discharging light of the discharge lamp 12 as well as the exposure level (the light amount of the copy lamp 19) so as to cause the amount of toner on the photoreceptor drum 1 detected by the patch sensor 9 to be equal to a preset reference value during a rotation of the photoreceptor drum 1 before a copying operation, copying, or a rotation of the photoreceptor drum 1 after the copying operation. The process control is performed during a rotation of the photoreceptor drum 1 before starting the next copying operation if the time that the copying machine is left unused, counted by the timer 15, reaches or exceeds a predetermined time.

Since the CPU 14 feedback-controls at least one of the charger output, the development bias output, and the amount of discharging light as well as the exposure level according to a value detected by the patch sensor 9 when each of the timers 15 and 21 counts the predetermined time, changes in the copy density caused when the copying machine is used or left unused are corrected and stable image quality is obtained.

The timers 21 and 15 are reset in the same manner as in embodiment 31.

The following description discusses the process control of the image-forming devices which was performed by setting the accumulated copying time to 30 minutes and the time that the copying machine is left unused to at least one hour.

When the accumulated copying time counted by the timer 21 reaches 30 minutes, dark and light toner patches are formed on the photoreceptor drum 1 like embodiments 1 and 4 even if a copying operation is in progress. The amounts of toner forming the dark and light toner patches are respectively detected by the patch sensor 9. The CPU 14 performs the process control by controlling at least one of the charger output, the development bias output, and the amount of discharging light as well as the exposure level according to the amounts of toner detected by the patch sensor 9. With this control, the copy density and copy brightness which have been changed when the copying operations were performed are corrected.

The CPU 14 performs the same process control during a rotation of the photoreceptor drum 1 before starting the next copying operation if the timer 15 counts one hour or more after the copying machine is left unused. With this control, the copy density and copy brightness which have been changed as a result of leaving the copying machine unused are corrected.

Figure 23:
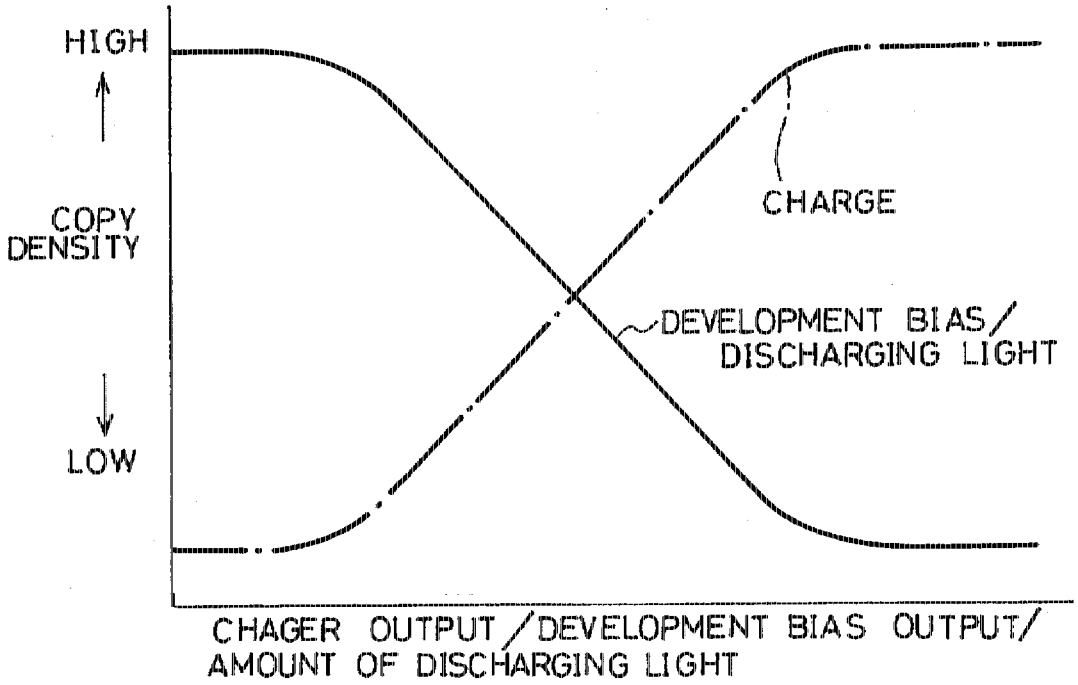
FIG. 23 is a graph showing the relationship between the charger output, development bias output and the amount of discharging light, and the copy density.

As mentioned in embodiment 5, the relationship between the charger output, the development bias output and the amount of discharging light, and the copy density is shown in FIG. 23. The relationship between the exposure level and the copy brightness is shown in FIG. 17. With the process control, when copying operations cause a lowered copy density and a too bright image, at least the charger output is increased, the development bias output is lowered, or the amount of discharging light is lowered, while the exposure level is decreased. When the photoreceptor drum 1 is overcompensated as a result of leaving the copying machine unused, the copy density is increased and the image becomes too dark. In this case, with the process control, at least the charger output is decreased, the development bias output is increased, or the amount of discharging light is increased, while the exposure level is increased. As a result, the changes in the copy density and copy brightness caused when the copying machine is used or left unused are corrected, thereby providing stable image quality.

As described above, by feedback-controlling at least one of the charger output, the development bias output, and the amount of discharging light as well as the exposure level according to the amount of toner on the photoreceptor drum 1, the accumulated copying time counted by the timer 21 and the time that the copying machine is left unused counted by the timer 15, the process control is performed frequently at relatively short intervals when the frequency of using the copying machine is high. It is therefore possible to timely correct the changes in the copy density and copy brightness which are caused when the copying operations are repeatedly performed. On the other hand, when the frequency of using the copying machine is low, the control is not performed until the accumulated copying time reaches a predetermined time. It is thus possible to eliminate unnecessary control, and to reduce the time taken to make the copying machine ready and the toner consumption.

Furthermore, since the control of the changes in the copy density and copy brightness is not performed until the copying machine is left unused for a predetermined time, the frequency of performing the control is minimized.

As a result, the changes in the copy density and copy brightness are appropriately corrected without increasing the consumption of toner and impairing the responsiveness of the copying machine. Namely, stable image quality is efficiently obtained with a reduced number of control operations.

Embodiment 36

Figure 49:
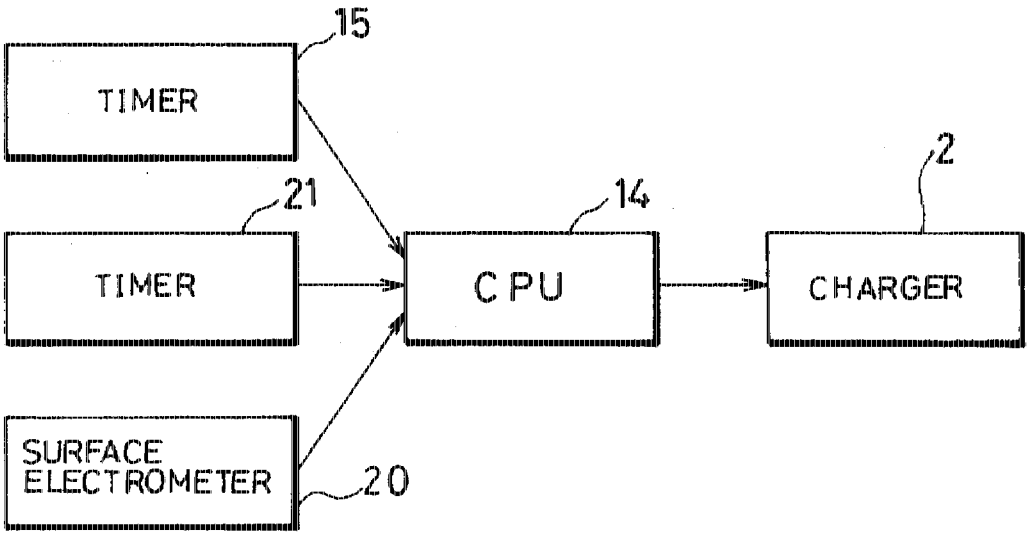
FIG. 49 is a block diagram illustrating a structure of a control system in a copying machine having an image-quality stabilizer according to still another embodiment of the present invention.

The following description discusses another embodiment of the present invention with reference to FIGS. 2, 5 and 49. The members having the same function as in the above-mentioned embodiment will be designated by the same code and their description will be omitted.

As illustrated in FIG. 2, a copying machine as an electrophotographic apparatus including an image-quality stabilizer of this embodiment has the photoreceptor drum 1, and the charger 2 disposed around the photoreceptor drum 1. As shown in FIG. 49, the image-quality stabilizer also includes the surface electrometer 20, the timer 21 for accumulating copying time, the timer 15 for counting time that the copying machine is unused, and the CPU 14.

When the copying time accumulated by the timer 21 reaches a predetermined time, the CPU 14 executes process control by feedback-controlling the output of the charger 2 so as to cause the amount of charges on the photoreceptor drum 1 detected by the surface electrometer 20 to be equal to a preset reference value during a rotation of the photoreceptor drum 1 before a copying operation, copying, or a rotation of the photoreceptor drum 1 after the copying operation. The process control is performed during a rotation of the photoreceptor drum 1 before starting the next copying operation if the timer 15 has counted a predetermined time after the copying machine is left unused.

Since the CPU 14 feedback-controls the charger output according to the time counted by the timers 15 and 21, the changes in the copy density caused when the copying machine is used or left unused are corrected and stable image quality is obtained.

The timers 21 and 15 are reset in the same manner as in embodiment 31.

The following description discusses the process control of the charger output which was performed by setting the accumulated copying time to 30 minutes and the time that the copying machine is left unused to at least one hour.

When the accumulated copying time counted by the timer 21 reaches 30 minutes, a latent dark patch is formed on the photoreceptor drum 1 like embodiment 16 even if a copying operation is in progress. The amount of charges forming the latent dark patch is detected by the surface electrometer 20. The CPU 14 performs the process control by feedback-controlling the charger output according to the amount of charges detected by the surface electrometer 20. With this control, the copy density which has been changed when the copying machine was used is corrected.

The CPU 14 performs the same process control during a rotation of the photoreceptor drum 1 before starting the next copying operation if the time that the timer 15 counts one hour or more after the copying machine is left unused. With this control, the copy density which has been changed as a result of leaving the copying machine unused is corrected.

As mentioned in embodiment 1, the relationship between the charger output and the copy density is shown in FIG. 5. With the process control, when the copy density is lowered by the repeatedly performed copying operations, the charger output is increased. On the other hand, when the photoreceptor drum 1 is overcompensated as a result of leaving the copying machine unused, the copy density is increased. In this case, the charger output is decreased by the process control. As a result, the changes in the copy density are corrected.

As described above, by feedback-controlling the charger output according to the amount of charges on the photoreceptor drum 1, the accumulated copying time counted by the timer 21 and the time that the copying machine is left unused counted by the timer 15, the copy density is timely corrected only when the copy density is changed depending on the frequency of using the copying machine and the time that the copying machine is left unused. It is thus possible to minimize the frequency of performing the control, and to reduce the time taken to make the copying machine ready. As a result, the changes in the copy density are appropriately corrected without increasing the consumption of toner and impairing the responsiveness of the copying machine. Namely, stable image quality is efficiently obtained with a reduced number of control operations.

Embodiment 37

Figure 50:
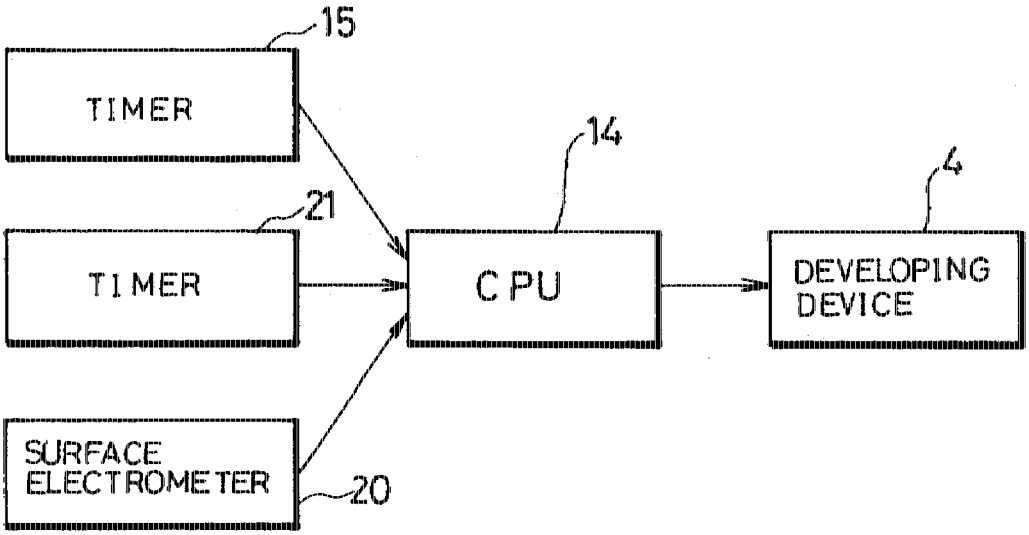
FIG. 50 is a block diagram illustrating a structure of a control system in a copying machine having an image-quality stabilizer according to yet another embodiment of the present invention.

The following description discusses another embodiment of the present invention with reference to FIGS. 2, 9 and 50. The members having the same function as in the above-mentioned embodiment will be designated by the same code and their description will be omitted.

As illustrated in FIG. 2, a copying machine as an electrophotographic apparatus including an image-quality stabilizer of this embodiment has the photoreceptor drum 1, and the developing device 4 disposed around the photoreceptor drum 1. As shown in FIG. 50, the image-quality stabilizer also includes the surface electrometer 20, the timer 21 for accumulating copying time, the timer 15 for counting time that the copying machine is inactive, and the CPU 14.

When the copying time accumulated by the timer 21 reaches a predetermined time, the CPU 14 executes process control by feedback-controlling the development bias output of the developing device 4 so as to cause the amount of charges on the photoreceptor drum 1 detected by the surface electrometer 20 to be equal to a preset reference value during a rotation of the photoreceptor drum 1 before a copying operation, copying, or a rotation of the photoreceptor drum 1 after the copying operation. The process control is performed during a rotation of the photoreceptor drum 1 before starting the next copying operation if the timer 15 counts a predetermined time after the copying machine is left unused.

Since the CPU 14 feedback-controls the development bias output according to the time counted by the timers 15 and 21, the changes in the copy density caused when the copying machine is used or left unused are corrected and stable image quality is obtained.

The timers 21 and 15 are reset in the same manner as in embodiment 31.

The following description discusses the process control of the development bias output which was performed by setting the accumulated copying time to 30 minutes and the time that the copying machine is left unused to at least one hour.

When the accumulated copying time counted by the timer 21 reaches 30 minutes, a latent dark patch is formed on the photoreceptor drum 1 like embodiment 16 even if a copying operation is in progress. The amount of charges forming the latent dark patch is detected by the surface electrometer 20. The CPU 14 performs the process control by controlling the development bias output according to the amount of charges detected by the surface electrometer 20. With this control, the copy density which has been changed when the copying machine was used is corrected.

The CPU 14 performs the same process control during a rotation of the photoreceptor drum 1 before starting the next copying operation if the timer 15 counts one hour or more after the copying machine is left unused. With this control, the copy density which has been changed as a result of leaving the copying machine unused is corrected.

As mentioned in embodiment 2, the relationship between the development bias output and the copy density is shown in FIG. 9. With the process control, when the copy density is lowered by the repeatedly performed copying operations, the development bias output is decreased. On the other hand, when the photoreceptor drum 1 is overcompensated as a result of leaving the copying machine unused, the copy density is increased. In this case, the development bias output is increased by the process control. As a result, the changes in the copy density are corrected.

As described above, by feedback-controlling the development bias output according to the amount of charges on the photoreceptor drum 1, the accumulated copying time counted by the timer 21 and the time that the copying machine is left unused counted by the timer 15, the copy density is timely corrected only when the copy density is changed depending on the frequency of using the copying machine and the time that the copying machine is left unused. It is thus possible to minimize the frequency of performing the control, and to reduce the time taken to make the copying machine ready. As a result, the changes in the copy density are appropriately corrected without increasing the consumption of toner and impairing the responsiveness of the copying machine. Namely, stable image quality is efficiently obtained with a reduced number of control operations.

Embodiment 38

Figure 51:
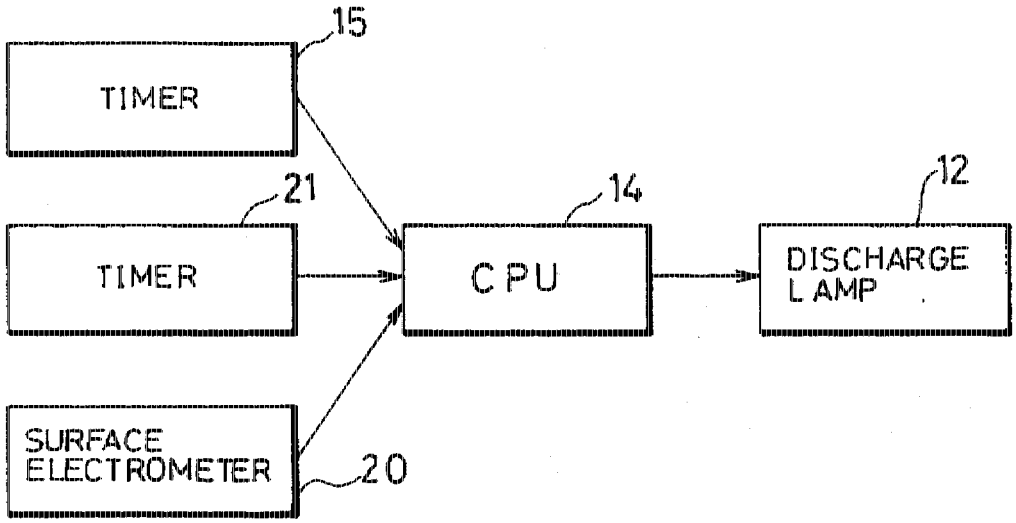
FIG. 51 is a block diagram illustrating a structure of a control system in a copying machine having an image-quality stabilizer according to another embodiment of the present invention.

The following description discusses another embodiment of the present invention with reference to FIGS. 2, 12 and 51. The members having the same function as in the above-mentioned embodiment will be designated by the same code and their description will be omitted.

As illustrated in FIG. 2, a copying machine as an electrophotographic apparatus including an image-quality stabilizer of this embodiment has the photoreceptor drum 1, and the discharge lamp 12 disposed around the photoreceptor drum 1. As shown in FIG. 51, the image-quality stabilizer- also includes the surface electrometer 20, the timer 21 for accumulating copying time, the timer 15 for counting time that the copying machine is inactive, and the CPU 14.

When the copying time accumulated by the timer 21 reaches a predetermined time, the CPU 14 executes process control by feedback-controlling the amount of discharging light of the discharge lamp 12 so as to cause the amount of charges on the photoreceptor drum 1 detected by the surface electrometer 20 to be equal to a preset reference value during a rotation of the photoreceptor drum 1 before a copying operation, copying, or a rotation of the photoreceptor drum 1 after the copying operation. The process control is performed during a rotation of the photoreceptor drum 1 before starting the next copying operation if the timer 15 counts a predetermined time after the copying machine is left unused.

Since the CPU 14 feedback-controls the amount of discharging light according to the time counted by the timers 15 and 21, the changes in the copy density caused when the copying machine is used or left unused are corrected and stable image quality is obtained.

The timers 21 and 15 are reset in the same manner as in embodiment 31.

The following description discusses the process control of the amount of discharging light which was performed by setting the accumulated copying time to 30 minutes and the time that the copying machine is left unused to at least one hour.

When the accumulated copying time counted by the timer 21 reaches 30 minutes, a latent dark patch is formed on the photoreceptor drum 1 like embodiment 16 even if a copying operation is in progress. The amount of charges forming the latent dark patch is detected by the surface electrometer 20. The CPU 14 performs the process control by controlling the amount of discharging light according to the amount of charges detected by the surface electrometer 20. With this control, the copy density which has been lowered when the copying machine was used is corrected.

The CPU 14 performs the same process control during a rotation of the photoreceptor drum 1 before starting the next copying operation if the timer 15 counts one hour or more after the copying machine is left unused. With this control, the copy density which has been increased as a result of leaving the copying machine unused is corrected.

As mentioned in embodiment 3, the relationship between the amount of discharging light and the copy density is shown in FIG. 12. With the process control, when the copy density is lowered after performing copying operations, the amount of discharging light is decreased. On the other hand, when the photoreceptor drum 1 is overcompensated as a result of leaving the copying machine unused, the copy density is increased. Namely, the amount of discharging light is increased to adjust image quality.

As described above, by feedback-controlling the amount of discharging light according to the amount of charges on the photoreceptor drum 1, the accumulated copying time counted by the timer 21 and the time that the copying machine is left unused counted by the timer 15, the copy density is timely corrected only when the copy density is changed depending on the frequency of using the copying machine and the time that the copying machine is left unused. It is thus possible to minimize the frequency of performing the control, and to reduce the time taken to make the copying machine ready. As a result, the changes in the copy density are appropriately corrected without increasing the consumption of toner and impairing the responsiveness of the copying machine. Namely, stable image quality is efficiently obtained with a reduced number of control operations.

Embodiment 39

Figure 52:
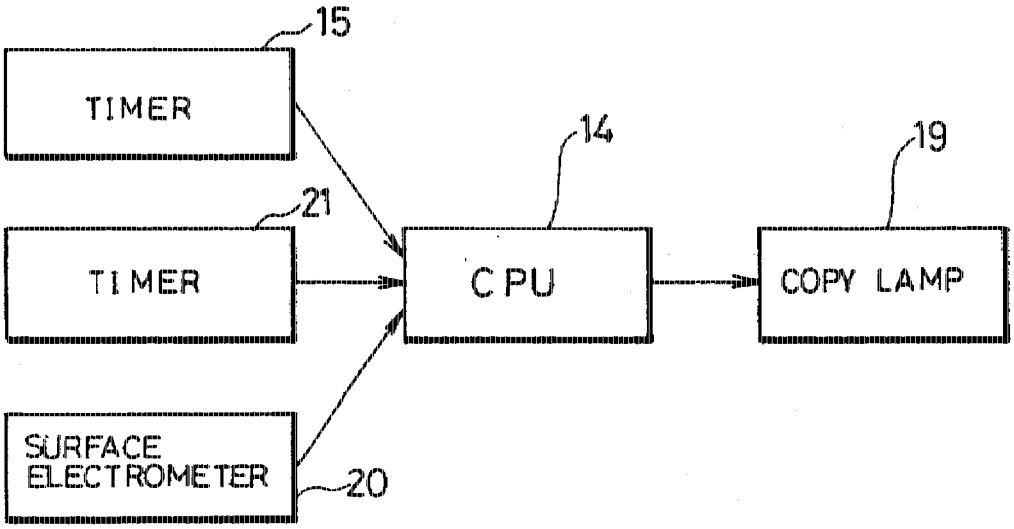
FIG. 52 is a block diagram illustrating a structure of a control system in a copying machine having an image-quality stabilizer according to still another embodiment of the present invention.

The following description discusses another embodiment of the present invention with reference to FIGS. 2, 17 and 52. The members having the same function as in the above-mentioned embodiment will be designated by the same code and their description will be omitted.

As illustrated in FIGS. 2 and 52, a copying machine as an electrophotographic apparatus including an image-quality stabilizer of this embodiment has the photoreceptor drum 1, and the copy lamp 19 for scanning the image of a document from the B direction. The image-quality stabilizer also includes the surface electrometer 20, the timer 21 for accumulating copying time, the timer 15 for counting time that the copying machine is inactive, and the CPU 14.

When the copying time accumulated by the timer 21 reaches a predetermined time, the CPU 14 executes process control by feedback-controlling the exposure level (the amount of light) of the copy lamp 19 so as to cause the amount of charges on the photoreceptor drum 1 detected by the surface electrometer 20 to be equal to a preset reference value during a rotation of the photoreceptor drum 1 before a copying operation, copying, or a rotation of the photoreceptor drum 1 after the copying operation. The process control is performed during a rotation of the photoreceptor drum 1 before starting the next copying operation if the timer 15 counts a predetermined time after the copying machine is left unused.

Since the CPU 14 feedback-controls the exposure level according to the time counted by the timers 15 and 21, the changes in the copy brightness caused when the copying machine is used or left unused are corrected and stable image quality is obtained.

The timers 21 and 15 are reset in the same manner as in embodiment 31.

The following description discusses the process control of the exposure level which was performed by setting the accumulated copying time to 30 minutes and the time that the copying machine is left unused to at least one hour.

When the accumulated copying time counted by the timer 21 reaches 30 minutes, a latent light patch is formed on the photoreceptor drum 1 like embodiment 19 even if a copying operation is in progress. The amount of charges forming the latent light patch is detected by the surface electrometer 20. The CPU 14 performs the process control by controlling the exposure level according to the amount of charges detected by the surface electrometer 20. With this control, the copy brightness which has been changed when the copying machine was used is corrected.

The CPU 14 performs the same process control during a rotation of the photoreceptor drum 1 before starting the next copying operation if the timer 15 counts one hour or more after the copying machine is left unused. With this control, the copy brightness which has been changed as a result of leaving the copying machine unused is corrected, thereby preventing a fogged image.

As mentioned in embodiment 4, the relationship between the exposure level and the copy brightness is shown in FIG. 17. With the process control, when the image becomes too bright after performing copying operations, the exposure level is decreased. On the other hand, when the photoreceptor drum 1 is overcompensated as a result of leaving the copying machine unused, the image becomes too dark. Namely, the exposure level is increased to adjust image quality.

As described above, by feedback-controlling the exposure level according to the amount of charges on the photoreceptor drum 1, the accumulated copying time counted by the timer 21 and the time that the copying machine is left unused counted by the timer 15, the copy brightness is timely corrected only when the copy brightness is changed depending on the frequency of using the copying machine and the time that the copying machine is left unused. It is thus possible to minimize the frequency of performing the control, and to reduce the time taken to make the copying machine ready. As a result, the changes in the copy brightness are appropriately corrected without increasing the consumption of toner and impairing the responsiveness of the copying machine. Namely, stable image quality is efficiently obtained with a reduced number of control operations.

Embodiment 40

The following description discusses another embodiment of the present invention with reference to FIGS. 2, 17, 23 and 53. The members having the same function as in the above-mentioned embodiment will be designated by the same code and their description will be omitted.

Figure 53:
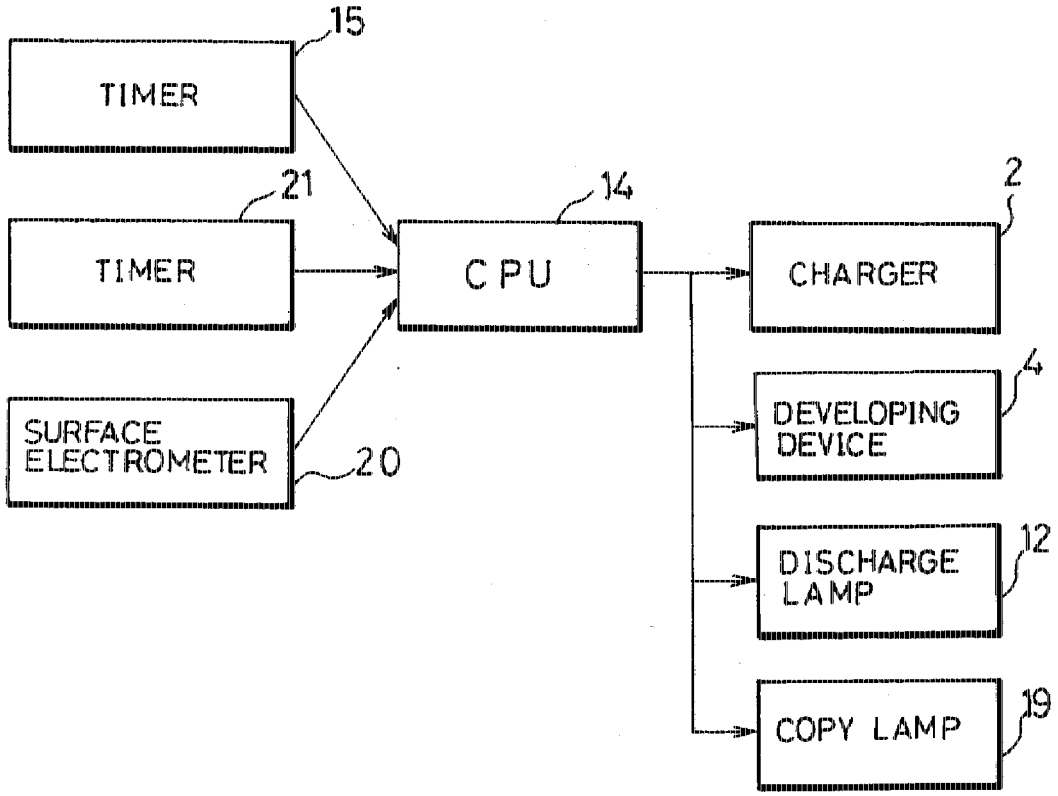
FIG. 53 is a block diagram illustrating a structure of a control system in a copying machine having an image-quality stabilizer according to yet another embodiment of the present invention.
Figure 54:
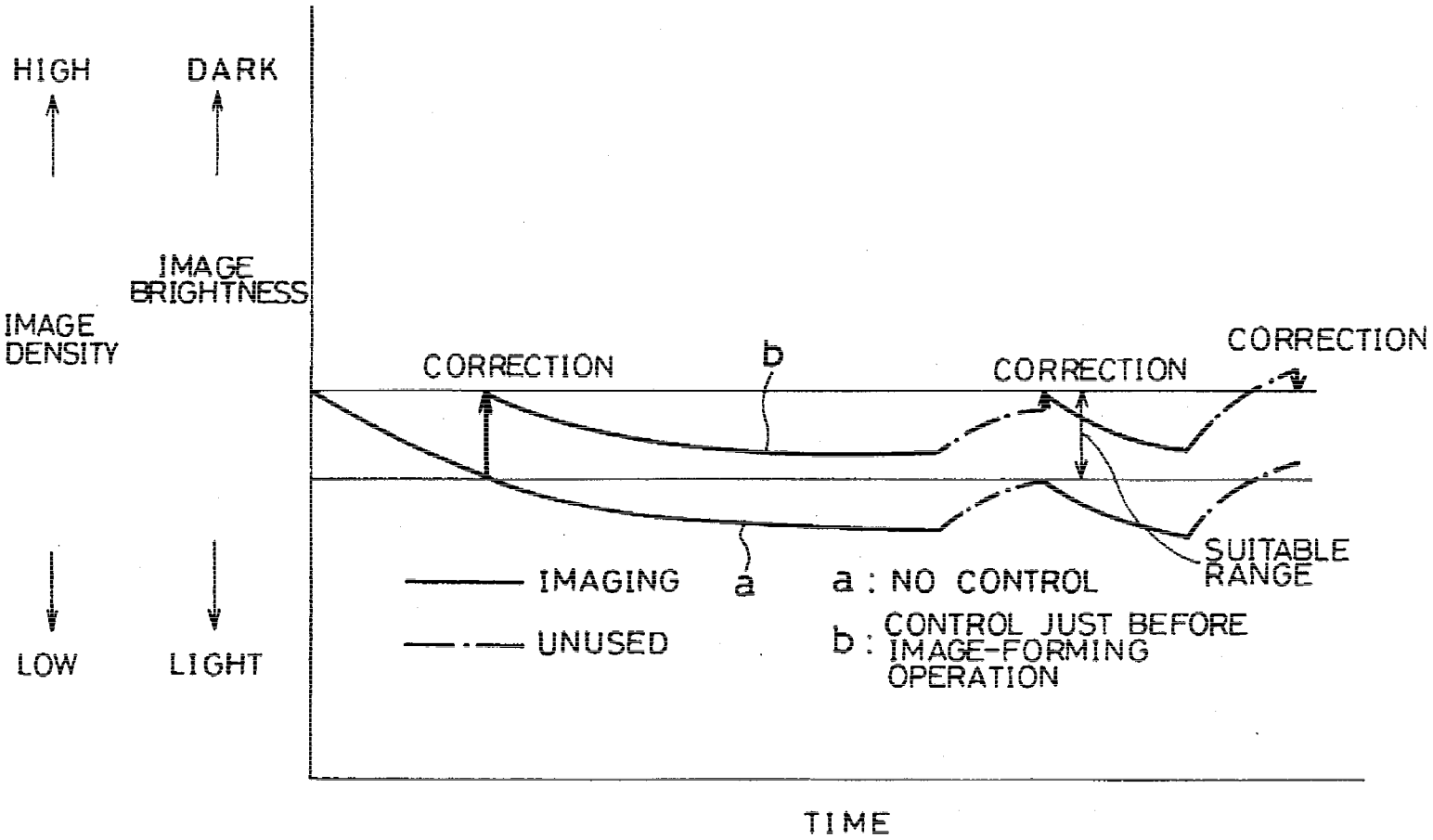
FIG. 54 is a graph showing changes in the copy density and the copy brightness when the feedback control is performed immediately before an image-forming operation according to a conventional image-quality stabilizer.
Figure 55:
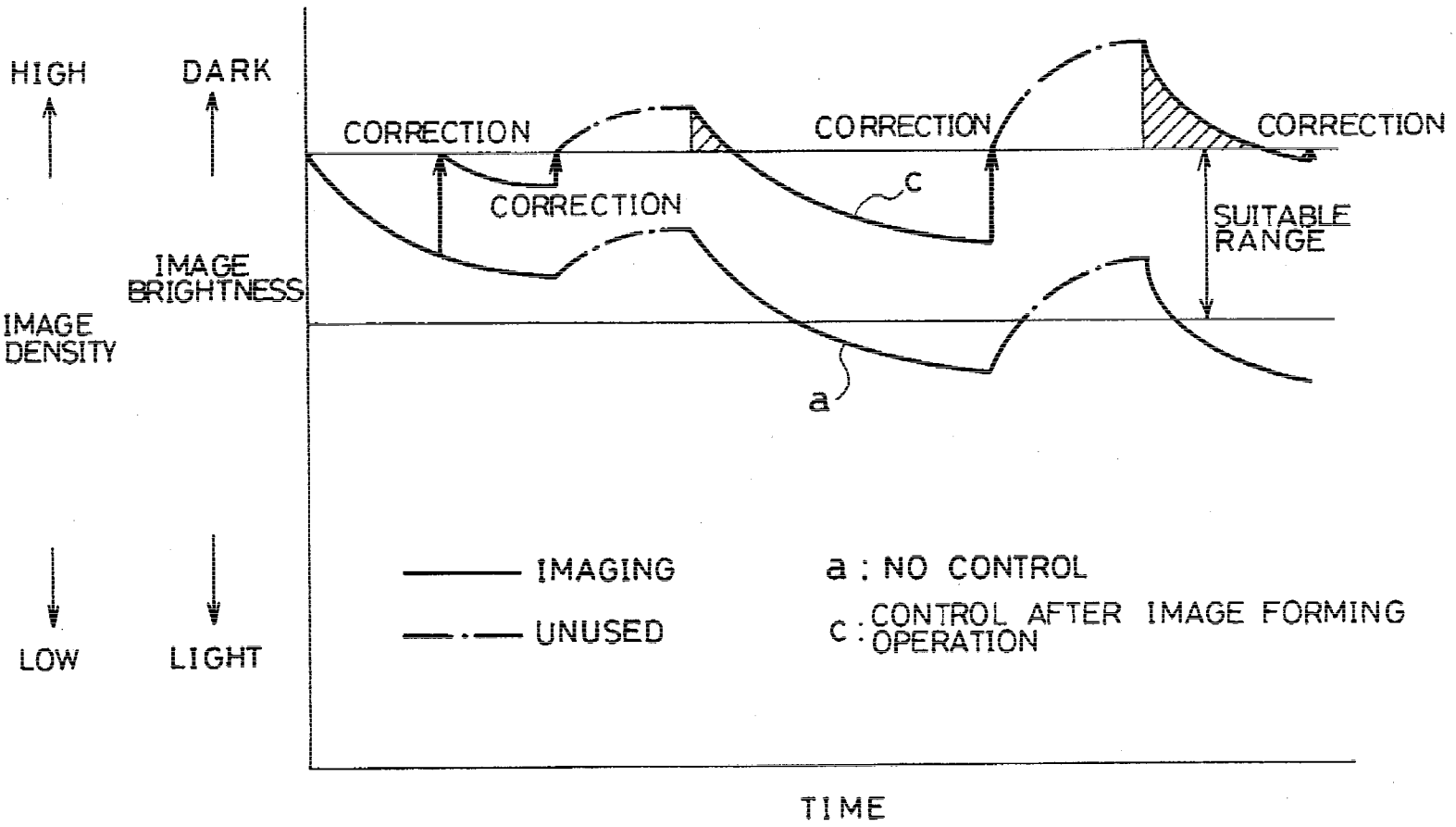
FIG. 55 is a graph showing changes in the copy density and the copy brightness when the feedback control is performed after the image-forming operation according to the conventional image-quality stabilizer.

As illustrated in FIGS. 2 and 53, a copying machine as an electrophotographic apparatus including an image-quality stabilizer of this embodiment has the photoreceptor drum 1, the charger 2, the developing device 4 and the discharge lamp 12, disposed around the photoreceptor drum 1, and the copy lamp 19 for scanning the image of a document from the B direction. The image-quality stabilizer also includes the surface electrometer 20, the timer 21 for accumulating copying time, the timer 15 for counting time that the copying machine is inactive, and the CPU 14.

When the copying time accumulated by the timer 21 reaches a predetermined time, the CPU 14 executes process control by feedback-controlling at least one of the output of the charger 2, the development bias output of the developing device 4, and the amount of discharging light of the discharge lamp 12 as well as the exposure level (the amount of light of the copy lamp 19) so as to cause the amount of charges on the photoreceptor drum 1 detected by the surface electrometer 20 to be equal to a preset reference value during a rotation of the photoreceptor drum 1 before a copying operation, copying, or a rotation of the photoreceptor drum 1 after the copying operation.

The process control is performed during a rotation of the photoreceptor drum 1 before starting the next copying operation if the timer 15 has counted a predetermined time after the copying machine is left unused.

Since the CPU 14 feedback-controls at least one of the charger output, the development bias output and the amount of discharging light as well as the exposure level according to the time counted by the timers 15 and 21, the changes in the copy density and copy brightness caused when the copying machine is used or left unused are corrected and stable image quality is obtained.

The timers 21 and 15 are reset in the same manner as in embodiment 31.

The following description discusses the process control of the image-forming devices which was performed by setting the accumulated copying time to 30 minutes and the time that the copying machine is left unused to at least one hour.

When the accumulated copying time counted by the timer 21 reaches 30 minutes, dark and latent light patches are formed on the photoreceptor drum 1 like embodiments 16 and 19 even if a copying operation is in progress. The amounts of charges forming the dark and latent light patches are respectively detected by the surface electrometer 20. The CPU 14 performs the process control by controlling at least one of the output charger, the development bias output and the amount of discharging light as well as the exposure level according to the amounts of charges detected by the surface electrometer 20. With this control, the copy density and copy brightness which have been changed when the copying operations were performed are corrected.

The CPU 14 performs the same process control during a rotation of the photoreceptor drum 1 before starting the next copying operation if the timer 15 counts one hour or more after the copying machine is left unused. With this control, the copy density and copy brightness which have been changed as a result of leaving the copying machine unused are corrected.

As mentioned in embodiment 5, the relationship between the charger output, the development bias output and the amount of discharging light, and the copy density is shown in FIG. 23. The relationship between the exposure level and the copy brightness is shown in FIG. 17.

When the copy density is lowered and the image becomes too bright after the copying operations, the process control is performed by at least increasing the charger output, decreasing the development bias output, or decreasing the amount of discharging light while lowering the exposure level. On the other hand, when the photoreceptor drum 1 is overcompensated as a result of leaving the copying machine unused, the copy density is increased and the image becomes too dark. In this case, the process control is performed by at least decreasing the charger output, increasing the development bias output, or increasing the amount of discharging light while increasing the exposure level. As a result, the copy density and copy brightness which have changed as a result of using the copying machine or leaving the copying machine unused are corrected, achieving stable image quality.

As described above, by feedback-controlling at least one of the charger output, the development bias output and the amount of discharging light as well as the exposure level according to the amount of charges on the photoreceptor drum 1, the accumulated copying time counted by the timer 21 and the time that the copying machine is left unused counted by the timer 15, the copy density and and the copy brightness are timely corrected only when the copy density and copy brightness are changed depending on the frequency of using the copying machine and the time that the copying machine is left unused.

It is thus possible to minimize the frequency of performing the control, and to reduce the time taken to make the copying machine ready. As a result, the changes in the copy density and copy brightness are appropriately corrected without increasing the consumption of toner and impairing the responsiveness of the copying machine. Namely, stable image quality is efficiently obtained with a reduced number of control operations.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An image-quality stabilizer comprising:

image forming means for forming an image using a photoreceptor;

reference toner image forming means for forming on said photoreceptor a reference toner image for image-quality adjusting;

detecting means for detecting an amount of the reference toner image formed on said photoreceptor;

a first timer for counting time that said photoreceptor is inactive;

image-quality adjusting means for controlling said reference toner image forming means, so as to form the reference toner image on said photoreceptor, and for controlling said detecting means so as to detect the amount of the reference toner image formed on said photoreceptor, the controlling being carried out using a rotation of said photoreceptor performed after an image formation by said image forming means, and for controlling, so as to maintain a predetermined relationship, said image forming means in accordance with (a) a value detected by said detecting means and (b) an inactive time, of said photoreceptor, counted by said first timer.

2. The image-quality stabilizer according to claim 1, further comprising memory means for storing a correct value of said image forming means, the correct value being determined to change gradually according to time that said photoreceptor is inactive, wherein said image-quality adjusting means controls said image forming means to have the correct value stored in said memory means according to time counted by said first timer.

3. The image-quality stabilizer according to claim 1, further comprising memory means for storing surface-potential recovery characteristics of said photoreceptor which is approximated as a function of time that said photoreceptor is inactive, wherein said image-quality adjusting means calculates a recovery of surface potential of said photoreceptor according to a value detected by said first timer using the function, and controls said image forming means so as to adjust the recovery.

4. The image-quality stabilizer according to claim 1, wherein said image forming means is charging means.

5. The image-quality stabilizer according to claim 1, wherein said image forming means is developing means.

6. The image-quality stabilizer according to claim 1, wherein said image forming means is discharging means.

7. The image-quality stabilizer according to claim 1, wherein said image forming means is exposure means.

8. The image-quality stabilizer according to claim 1, wherein said image-quality adjusting means includes control means which controls at least one of charging means, developing means; and discharging means as well as exposure means.

9. An image-quality stabilizer for use in an electrophotographic apparatus including a photoreceptor, and image forming means for performing an image-forming operation using said photoreceptor, said image-quality stabilizer comprising:

toner detecting means for detecting an amount of toner forming a reference toner image on said photoreceptor;

a first timer for detecting time that said photoreceptor is inactive; and image-quality adjusting means for controlling said image forming means at predetermined intervals according to a value detected by said toner detecting means so as to cause the amount of toner forming the reference toner image to be equal to a predetermined reference value, and for controlling said image forming means according to a value detected by said first timer so as to maintain a predetermined relationship.

10. The image-quality stabilizer according to claim 9, wherein the predetermined intervals at which said image-quality adjusting means controls said image forming means are given by the number of times the image-forming operation is performed.

11. The image-quality stabilizer according to claim 9, wherein the predetermined intervals at which said image-quality adjusting means controls said image forming means are given by a period of time.

12. The image-quality stabilizer according to claim 9, further comprising memory means for storing a correct value which varies according to time that said photoreceptor is inactive, wherein said image-quality adjusting means controls said image forming means to have a correct value according to a value detected by said first timer.

13. The image-quality stabilizer according to claim 9, further comprising memory means for storing surface-potential recovery characteristics of said photoreceptor approximated as a function of time that said photoreceptor is inactive, wherein said image-quality adjusting means calculates a recovery of surface potential of said photoreceptor from the time detected by said first timer using the function, and controls said image forming means so as to adjust the recovery.

14. The image-quality stabilizer according to claim 9, wherein said image forming means is charging means.

15. The image-quality stabilizer according to claim 9, wherein said image forming means is developing means.

16. The image-quality stabilizer according to claim 9, wherein said image forming means is discharging means.

17. The image-quality stabilizer according to claim 9, wherein said image forming means is exposure means.

18. The image-quality stabilizer according to claim 9, wherein said image-quality adjusting means includes control means which controls at least one of charging means, developing means, and discharging means as well as exposure means.

19. An image-quality stabilizer for use in an electrophotographic apparatus including a photoreceptor, and image forming means for forming an image using said photoreceptor, said image-quality stabilizer comprising:

toner detecting means for detecting an amount of toner forming a reference toner image on said photoreceptor;

a first timer for counting time that said photoreceptor is inactive; and a second timer for counting time that said photoreceptor is active;

image-quality adjusting means for controlling said image forming means according to the time counted by said second timer by taking account of surface-potential lowering characteristics of said photoreceptor relating to fatigue of said photoreceptor, controlling said image forming means according to the time counted by said first timer by taking account of surface-potential recovery characteristics, and controlling said image forming means at predetermined intervals according to a value detected by said toner detecting means so as to cause the amount of toner forming the reference toner image to be equal to a predetermined reference value.

20. The image-quality stabilizer according to claim 19, wherein said image forming means is charging means.

21. The image-quality stabilizer according to claim 19, wherein said image forming means is developing means.

22. The image-quality stabilizer according to claim 19, wherein said image forming means is discharging means.

23. The image-quality stabilizer according to claim 19, wherein said image forming means is exposure means.

24. The image-quality stabilizer according to claim 19, wherein said image-quality adjusting means includes control means which controls at least one of charging means, developing means, and discharging means as well as exposure means.

25. An image-quality stabilizer comprising:

image forming means for forming an image using a photoreceptor;

reference latent image forming means for forming on said photoreceptor a reference latent image for image-quality adjusting;

detecting means for detecting an amount of charges forming the reference latent image formed on said photoreceptor;

a first timer for counting time that said photoreceptor is inactive;

image-quality adjusting means for controlling said reference latent image forming means so as to form the reference latent image on said photoreceptor and controlling said detecting means so as to detect the amount of charges forming the reference latent image formed on said photoreceptor, the controlling being carried out using a rotation of said photoreceptor performed after an image formation by said image forming means, and for controlling, so as to maintain a predetermined relationship, said image forming means in accordance with (a) a value detected by said detecting means and (b) an inactive time, of said photoreceptor, counted by said first timer.

26. The image-quality stabilizer according to claim 25, further comprising memory means for storing a correct value of said image forming means, the correct value being determined to change gradually according to the time that said photoreceptor is inactive, wherein said image-quality adjusting means controls said image forming means to have the correct value stored in said memory means according to the time counted by said first timer.

27. The image-quality stabilizer according to claim 25, further comprising memory means for storing surface-potential recovery characteristics of said photoreceptor which is approximated as a function of time that said photoreceptor is inactive, wherein said image-quality adjusting means calculates a recovery of surface potential of said photoreceptor from the time counted by said first timer using the function, and controls said image forming means so as to adjust the recovery.

28. The image-quality stabilizer according to claim 25, wherein said image forming means is charging means.

29. The image-quality stabilizer according to claim 25, wherein said image forming means is developing means.

30. The image-quality stabilizer according to claim 25, wherein said image forming means is discharging means.

31. The image-quality stabilizer according to claim 25, wherein said image forming means is exposure means.

32. The image-quality stabilizer according to claim 25, wherein said image-quality adjusting means includes control means which controls at least one of charging means, developing means, and discharging means as well as exposure means.

33. An image-quality stabilizer for use in an electrophotographic apparatus including a photoreceptor and image forming means for performing an image-forming operation using said photoreceptor, said image-quality stabilizer comprising:

charge detecting means for detecting an amount of charges forming a reference latent image on said photoreceptor;

a first timer for detecting time that said photoreceptor is inactive; and image-quality adjusting means for controlling said image forming means at predetermined intervals according to a value detected by said charge detecting means so as to cause the amount of charges forming the reference latent image to be equal to a predetermined reference value, and for controlling said image forming means according to the time counted by said first timer so as to maintain a predetermined relationship.

34. The image-quality stabilizer according to claim 33, wherein the predetermined intervals at which said image-quality adjusting means controls said image forming means are given by the number of times the image-forming operation is performed.

35. The image-quality stabilizer according to claim 33, wherein the predetermined intervals at which said image-quality adjusting means controls said image forming means are given by a period of time.

36. The image-quality stabilizer according to claim 33, further comprising memory means for storing a correct value of said image forming means, the correct value being determined to change gradually according to the time that said photoreceptor is inactive, wherein said image-quality adjusting means controls said image forming means to have the correct value stored in said memory means according to the time counted by said first timer.

37. The image-quality stabilizer according to claim 33, further comprising memory means for storing surface-potential recovery characteristics of said photoreceptor which is approximated as a function of time that said photoreceptor is inactive, wherein said image-quality adjusting means calculates a recovery of surface potential of said photoreceptor from the time detected by said first timer using the function, and controls said image forming means so as to adjust the recovery.

38. The image-quality stabilizer according to claim 33, wherein said image forming means is charging means.

39. The image-quality stabilizer according to claim 33, wherein said image forming means is developing means.

40. The image-quality stabilizer according to claim 33, wherein said image forming means is discharging means.

41. The image-quality stabilizer according to claim 33, wherein said image forming means is exposure means.

42. The image-quality stabilizer according to claim 33, wherein said image-quality adjusting means includes control means which controls at least one of charging means, developing means, and discharging means as well as exposure means.

43. An image-quality stabilizer for use in an electrophotographic apparatus including a photoreceptor and image forming means for performing an image-forming operation using said photoreceptor, said image-quality stabilizer comprising:

charge detecting means for detecting an amount of charges forming a reference latent image on said photoreceptor;

a first timer for detecting time that said photoreceptor is inactive;

a second timer for detecting time that said photoreceptor is active; and image-quality adjusting means for controlling said image forming means according to a value detected by said charge detecting means by taking account of surface-potential lowering characteristics of said photoreceptor relating to fatigue of said photoreceptor, controlling said image forming means according to the time counted by said first timer by taking account of surface-potential recovery characteristics of said photoreceptor, and controlling said image forming means at predetermined intervals according to a value detected by said charge detecting means so as to cause the amount of charges forming a reference latent image on said photoreceptor to be equal to a predetermined reference value.

44. The image-quality stabilizer according to claim 43, wherein said image forming means is charging means.

45. The image-quality stabilizer according to claim 43, wherein said image forming means is developing means.

46. The image-quality stabilizer according to claim 43, wherein said image forming means is discharging means.

47. The image-quality stabilizer according to claim 43, wherein said image forming means is exposure means.

48. The image-quality stabilizer according to claim 43, wherein said image-quality adjusting means includes control means which controls at least one of charging means, developing means, and discharging means as well as exposure means.

49. An image-quality stabilizer for use in an electrophotographic apparatus including a photoreceptor and image forming means for performing an image-forming operation using said photoreceptor, said image-quality stabilizer comprising:

toner detecting means for detecting an amount of toner forming a reference toner image on said photoreceptor;

a first timer for detecting time that said photoreceptor is inactive;

a second timer for detecting an accumulated time of image-forming operations; and image-quality adjusting means for controlling said image forming means according to a value detected by said toner detecting means so as to cause an amount of toner forming the reference toner image to be equal to a predetermined reference value when the accumulated time counted by said second timer reaches a predetermined time, and controlling said image forming means according to time that said photoreceptor is inactive if the time counted by said first timer reaches a predetermined time.

50. The image-quality stabilizer according to claim 49, wherein said image forming means is charging means.

51. The image-quality stabilizer according to claim 49, wherein said image forming means is developing means.

52. The image-quality stabilizer according to claim 49, wherein said image forming means is discharging means.

53. The image-quality stabilizer according to claim 49, wherein said image forming means is exposure means.

54. The image-quality stabilizer according to claim 49, wherein said image-quality adjusting means includes control means which controls at least one of charging means, developing means, and discharging means as well as exposure means.

55. An image-quality stabilizer for use in an electrophotographic apparatus including a photoreceptor and image forming means for performing an image-forming operation using said photoreceptor, said image-quality stabilizer comprising:

charge detecting means for detecting an amount of charges forming a reference latent image on said photoreceptor;

a first timer for detecting time that said photoreceptor is inactive;

a second timer for detecting an accumulated time of image-forming operations; and image-quality adjusting means for controlling said image forming means according to a value detected by said charge detecting means so as to cause an amount of charges forming the reference latent image to be equal to a predetermined reference value when the accumulated time counted by said second timer reaches a predetermined time, and controlling said image forming means according to the time that said photoreceptor is inactive if the time counted by said first timer reaches a predetermined time.

56. The image-quality stabilizer according to claim 55, wherein said image forming means is charging means.

57. The image-quality stabilizer according to claim 55, wherein said image forming means is developing means.

58. The image-quality stabilizer according to claim 55, wherein said image forming means is discharging means.

59. The image-quality stabilizer according to claim 55, wherein said image forming means is exposure means.

60. The image-quality stabilizer according to claim 55, wherein said image-quality adjusting means includes control means which controls at least one of charging means, developing means, and discharging means as well as exposure means.

61. A method of controlling image quality with an image-quality stabilizer in an electrophotographic apparatus including a photoreceptor and image forming means, comprising the steps of:

forming a reference toner image on said photoreceptor during a rotation of said photoreceptor performed after an image-forming operation;

detecting means for detecting an amount of toner forming the reference toner image;

controlling said image forming means so as to cause a detected amount of toner on said photoreceptor to be equal to a predetermined reference value every port-rotation of said photoreceptor;

detecting time that said photoreceptor is inactive if said photoreceptor is left unused after the image forming operation; and controlling said image forming means according to the detected time so as to maintain a predetermined relationship.

62. A method of controlling image quality with an image-quality stabilizer in an electrophotographic apparatus including a photoreceptor and image forming means, comprising the steps of:

forming a reference toner image on said photoreceptor at predetermined intervals;

detecting an amount of toner forming the reference toner image;

controlling said image forming means so as to cause a detected amount of toner on said photoreceptor to be equal to a predetermined reference value;

detecting time that said photoreceptor is inactive if said photoreceptor is left unused after the image forming operation; and controlling said image forming means according to the detected time so as to maintain a predetermined relationship.

63. A method of controlling image quality with an image-quality stabilizer in an electrophotographic apparatus including a photoreceptor and image forming means, comprising the steps of:

detecting time that said photoreceptor is active;

controlling said image forming means according to the detected time by taking account of surface-potential lowering characteristics of said photoreceptor relating to fatigue of said photoreceptor;

detecting time that said photoreceptor is inactive;

controlling said image forming means according to the detected time that said photoreceptor is inactive by taking account of surface-potential recovery characteristics;

forming a reference toner image on said photoreceptor at predetermined intervals;

detecting an amount of toner forming the reference toner image on said photoreceptor; and controlling said image forming means at predetermined intervals so as to cause the detected amount of toner to be equal to a predetermined reference value.

64. A method of controlling image quality with an image-quality stabilizer in an electrophotographic apparatus including a photoreceptor and image forming means, comprising the steps of:

forming a reference latent image on said photoreceptor during a rotation of said photoreceptor performed after an image-forming operation;

detecting an amount of charges forming the reference latent image on said photoreceptor;

controlling said image forming means so as to cause a detected amount of charges to be equal to a predetermined reference value every post-rotation of said photoreceptor;

detecting time that said photoreceptor is inactive if said photoreceptor is inactive after the image forming operation; and controlling said image forming means according to the detected time that said photoreceptor is inactive so as to maintain a predetermined relationship.

65. A method of controlling image quality with an image-quality stabilizer in an electrophotographic apparatus including a photoreceptor and image forming means, comprising the steps of:

forming a reference latent image on said photoreceptor at predetermined intervals;

detecting an amount of charges forming the reference latent image on said photoreceptor;

controlling said image forming means so as to cause a detected amount of charges to be equal to a predetermined reference value;

detecting time that said photoreceptor is inactive if said photoreceptor is left unused after the image forming operation; and controlling said image forming means according to the detected time that said photoreceptor is inactive so as to maintain a predetermined relationship.

66. A method of controlling image quality with an image-quality stabilizer in an electrophotographic apparatus including a photoreceptor and image forming means, comprising the steps of:

detecting time that said photoreceptor is active;

controlling said image forming means according to the detected time by taking account of surface-potential lowering characteristics of said photoreceptor relating to fatigue of said photoreceptor;

detecting time that said photoreceptor is inactive;

controlling said image forming means according to the detected time that said photoreceptor is inactive by taking account of surface-potential recovery characteristics of said photoreceptor;

forming a reference latent image on a photoreceptor at predetermined intervals;

detecting an amount of charges forming the reference latent image on said photoreceptor;

controlling said image forming means at predetermined intervals so as to cause a detected amount of charges to be equal to a predetermined reference value.

67. A method of controlling image quality with an image-quality stabilizer in an electrophotographic apparatus including a photoreceptor and image forming means, comprising the steps of:

detecting an accumulated time of image forming operations;

forming a reference toner image on said photoreceptor when the accumulated time reaches a predetermined time;

detecting an amount of toner forming the toner image;

controlling said image forming means so as to cause the detected toner amount to be equal to a predetermined reference value;

detecting time that said photoreceptor is inactive; and controlling said image forming means according to the detected time that said photoreceptor is inactive.

68. A method of controlling image quality with an image-quality stabilizer in an electrophotographic apparatus including a photoreceptor and image forming means, comprising the steps of:

detecting an accumulated time of image forming operations;

forming a reference latent image on said photoreceptor when the accumulated time reaches a predetermined time;

detecting an amount of charges forming the reference latent image;

controlling said image forming means so as to cause the detected amount of charges to be equal to a predetermined reference value;

detecting time that said photoreceptor is inactive; and controlling said image forming means according to the detected time that said photoreceptor is inactive.

* * * * *